US008292414B2

(12) United States Patent
Hayakawa et al.

(10) Patent No.: US 8,292,414 B2
(45) Date of Patent: Oct. 23, 2012

(54) INK CARTRIDGE AND AN IMAGING APPARATUS

(75) Inventors: Tadashi Hayakawa, Kanagawa (JP); Shotaro Takeuchi, Kanagawa (JP); Toshiroh Tokuno, Tokyo (JP); Tomomi Katoh, Kanagawa (JP); Masanori Kusunoki, Kanagawa (JP); Akiko Bannai, Kanagawa (JP); Masahiro Kuwata, Kanagawa (JP); Ikoh Soh, Kanagawa (JP)

(73) Assignee: Ricoh Company, Ltd., Tokyo (JP)

( * ) Notice: Subject to any disclaimer, the term of this patent is extended or adjusted under 35 U.S.C. 154(b) by 384 days.

(21) Appl. No.: 12/682,954

(22) PCT Filed: Sep. 25, 2009

(86) PCT No.: PCT/JP2009/067197

§ 371 (c)(1), (2), (4) Date: Apr. 14, 2010

(87) PCT Pub. No.: WO2010/035898

PCT Pub. Date: Apr. 1, 2010

(65) Prior Publication Data

US 2010/0225716 A1 Sep. 9, 2010

(30) Foreign Application Priority Data

| | | |
|---|---|---|
| Sep. 29, 2008 | (JP) | 2008-249423 |
| Mar. 18, 2009 | (JP) | 2009-065382 |
| Jun. 9, 2009 | (JP) | 2009-138055 |
| Jul. 7, 2009 | (JP) | 2009-160364 |
| Jul. 7, 2009 | (JP) | 2009-160421 |

(51) Int. Cl.
*B41J 2/175* (2006.01)

(52) U.S. Cl. ..... 347/85

(58) Field of Classification Search ..... 347/7, 49, 347/19, 84–87
See application file for complete search history.

(56) References Cited

U.S. PATENT DOCUMENTS 5,969,737 A 10/1999 Koyama et al.
(Continued)

FOREIGN PATENT DOCUMENTS

EP 1 053 881 A1 11/2000
(Continued)

OTHER PUBLICATIONS

Extended European Search Report issued Mar. 15, 2012, in Patent Application No. 09816308.2.

*Primary Examiner* — Anh T. N. Vo
(74) *Attorney, Agent, or Firm* — Oblon, Spivak, McClelland, Maier & Neustadt, L.L.P.

(57) ABSTRACT

An ink cartridge attachable to and detachable from an imaging apparatus, and including an ink accommodating unit; and a cartridge casing having an opening, whereby the ink accommodating unit includes: an ink accommodating body; and an ink supplying portion including a nozzle insertion path and connected to the ink accommodating body, whereby the ink supplying portion is held by the cartridge casing so that the ink supplying portion is rotatable between a position where the nozzle insertion path faces the opening and a position where the nozzle insertion path faces an inner wall surface of the cartridge casing, and when the ink cartridge is attached to the imaging apparatus the ink supplying portion is rotated to direct the nozzle insertion path toward the opening, and when the ink cartridge is detached the ink supplying portion is rotated to direct the nozzle insertion path toward the inner wall surface.

15 Claims, 44 Drawing Sheets

U.S. PATENT DOCUMENTS

| | | | | |
|---|---|---|---|---|
| 5,971,534 | A * | 10/1999 | Sasaki et al. | 347/86 |
| 6,099,112 | A * | 8/2000 | Olazabal | 347/85 |
| 7,055,904 | B2 | 6/2006 | Skelly et al. | |
| 7,249,816 | B2 | 7/2007 | Kusunoki et al. | |
| 7,325,908 | B2 | 2/2008 | Katoh et al. | |
| 7,540,598 | B2 | 6/2009 | Hori et al. | |
| 2005/0270342 | A1 | 12/2005 | Ogura et al. | |
| 2005/0275699 | A1 | 12/2005 | Sasaki | |
| 2008/0124133 | A1 | 5/2008 | Yoshizawa et al. | |

FOREIGN PATENT DOCUMENTS

| | | | |
|---|---|---|---|
| EP | 1 327 525 | A2 | 7/2003 |
| JP | 61-284445 | | 12/1986 |
| JP | 5 254138 | | 10/1993 |
| JP | 6 328718 | | 11/1994 |
| JP | 2001 88318 | | 4/2001 |
| JP | 2002 103644 | | 4/2002 |
| JP | 2003 220710 | | 8/2003 |
| JP | 2004 276538 | | 10/2004 |
| JP | 2004 306505 | | 11/2004 |
| JP | 2005 22124 | | 1/2005 |
| JP | 2005 349786 | | 12/2005 |
| JP | 3919734 | | 2/2007 |
| WO | WO 2008/047584 | A1 | 4/2008 |

* cited by examiner

INK CARTRIDGE AND AN IMAGING APPARATUS

TECHNICAL FIELD

The present invention generally relates to an ink cartridge and an imaging apparatus, and more particularly, to an imaging apparatus equipped with a recording head discharging droplets and an ink cartridge attached that can be attached to and detached from the imaging apparatus.

BACKGROUND ART

The imaging apparatus includes a printer, a fax machine, and a multifunction machine. Another example of the imaging apparatus is an inkjet printer of a liquid discharging type that uses a recording head discharging ink droplets.

The inkjet printer of the liquid discharging type can make an image (recording, printing, or the like) by discharging the ink droplets or other liquids onto a paper, a viewgraph for an overhead projector (OHP), or the like, which are generally called a recording medium or a recording paper, for example. The imaging apparatuses are loosely grouped as a serial type imaging apparatus and a line type imaging apparatus. The serial type imaging apparatus is configured to make an image while moving its recording head in a main scanning direction. The line type imaging apparatus is configured to make an image without moving its recording head.

Hereinafter, "imaging apparatus of a liquid discharging type" is configured to discharge the droplets to a medium such as papers, textile threads, textile, cloths, leathers, metals, plastics, glasses, lumber, and ceramics. Further, "imaging" means not only making an image such as a character, a letter and a figure but also making dots of droplets on a medium. Further, "ink" is used as a generic designation of recording liquids, fixing liquids, liquids and so on, and includes deoxyribonucleic acid (DNA) samples, resist materials, pattern materials, and resins, for example.

Hereinafter, the imaging apparatus of this kind is referred to as an "inkjet recording apparatus". Conventionally, the inkjet recording apparatus has a carriage equipped with a recording head and a sub tank, a buffer tank or a head tank for supplying ink to the recording head, and a main ink tank or a main ink cartridge that is attachable to or detachable from an inkjet recording apparatus thereby supplying ink from the main ink tank of the main ink cartridge to the sub tank, the buffer tank or the head tank.

Conventionally, the main ink tank or the ink cartridge is configured by an ink bag and a holding member having an ink discharge port and an ink supply port connected to the ink bag by, for example, welding, and a splittable cartridge accommodating the holding member and the bag, as disclosed in Patent Documents 1 and 2. Conventionally, an ink cartridge of an integrated ink head type has an ink discharging portion provided with an ink discharging nozzle and a shutter member for covering or exposing the ink discharging nozzle depending on a surrounding temperature by sliding the shutter member in a direction perpendicular to a direction of discharging the ink, as disclosed in Patent Document 3.

Conventionally, there are the following methods of supplying ink. First, a hollow needle of an inkjet recording apparatus pierces a supply port of an ink cartridge and suctions the ink, as disclosed in Patent Document 1. Second, a deformable ink bag is surrounded by an outer air bag, and a gas is supplied between an outer side of the ink bag and an inner side of the air bag thereby compressing the ink bag by the gas, as disclosed in Patent Documents 4 and 5.

[Patent Document 1] Japanese Patent No. 3919734

[Patent Document 2] Japanese Unexamined Patent Application Publication No. 2004-276538

[Patent Document 3] Japanese Unexamined Patent Application Publication No. H6-328718

[Patent Document 4] Japanese Unexamined Patent Application Publication No. 2004-306505

[Patent Document 5] Japanese Unexamined Patent Application Publication No. 2003-220710

In the above-mentioned inkjet recording apparatus which is configured to have the ink cartridge attached to or detached from the inkjet recording apparatus, the ink cartridge is exchanged by a user after the ink cartridge is spent. When the cartridge is exchanged by taking a hollow needle out of the spent ink cartridge, an ink may adhere to an ink supply port. Then it is necessary to treat the spent ink cartridge so as not to soil a hand or other components of the inkjet recording apparatus with the adhered ink.

Meanwhile, when a new ink cartridge is attached to the inkjet recording apparatus, extraneous material or sebum from a hand may adhere to an ink supply port while opening a package of the new cartridge. In this case, after the new ink cartridge is attached to the inkjet recording apparatus, the extraneous material or the sebum from the hand may intrude into an ink supply path of the inkjet recording apparatus, thereby causing erroneous discharge of droplets.

As such, the conventional ink cartridge has problems so that an exchange of a spent ink cartridge is bothersome and erroneous discharge of the droplets may occur.

Further, if a discharging action is carried out without attaching an ink cartridge to an inkjet recording apparatus, air may intrude into an ink supply path thereby causing erroneous discharge. For this reason, it is ordinarily determined whether an ink cartridge is attached, and a recording operation is stopped when it is determined that the ink cartridge is not attached.

DISCLOSURE OF INVENTION

Accordingly, it is an object of the present invention to provide a novel and useful ink cartridge and an imaging apparatus.

Another and more specific object of the present invention is to improve ease in handling and diminish the likelihood of causing erroneous discharge of a droplet.

Another and more specific object of the present invention is to stop an ink supply operation when an ink cartridge is not mounted on an inkjet recording apparatus using a simple structure.

Other objects, features, and advantages of the present invention will become more apparent from the following detailed description when read in conjunction with the accompanying drawings.

According to a first aspect of the present invention, there is provided an ink cartridge that is attachable to and detachable from an imaging apparatus, and includes an ink accommodating unit; and a cartridge casing having an opening, wherein the ink accommodating unit includes: an ink accommodating body accommodating an ink; and an ink supplying portion which includes a nozzle insertion path and is connected to the ink accommodating body to enable suction of the ink via the opening of the cartridge casing by an suction nozzle of the imaging apparatus, wherein the ink supplying portion is held by the cartridge casing so that the ink supplying portion is rotatable relative to the cartridge casing between a position where the nozzle insertion path faces the opening of the cartridge casing and a position where the nozzle insertion path faces an inner wall surface of the cartridge casing, and when the ink cartridge is attached to the imaging apparatus the ink supplying portion is rotated to direct the nozzle insertion path toward the opening of the ink cartridge, and when the ink cartridge is detached from the imaging apparatus the ink supplying portion is rotated to direct the nozzle insertion path toward the inner wall surface of the cartridge casing.

According to a second aspect of the present invention, there is provided the ink cartridge according to the first aspect, wherein the ink accommodating unit is configured to bend at a part between the ink accommodating body and the ink supplying portion along with the rotation of the ink supplying portion.

According to a third aspect of the present invention, there is provided the ink cartridge according to the first or second aspect of the present invention, wherein the ink accommodating unit further includes: a biasing unit configured to rotate the ink supplying portion to the position where the nozzle insertion path faces the inner wall surface of the cartridge casing.

According to a fourth aspect of the present invention, there is provided the ink cartridge according to the preceding aspects of the present invention, wherein the ink supplying portion includes an information memory unit storing information about the ink or information about the ink cartridge.

According to a fifth aspect of the present invention, there is provided the ink cartridge according to the preceding aspects of the present invention, wherein the ink supplying portion includes a pinion integrally formed in it, and the ink supplying portion is rotated by engaging a rack of the imaging apparatus.

According to a sixth aspect of the present invention, there is provided the ink cartridge according to the preceding aspects of the present invention, wherein the ink supplying portion includes a cam integrally formed in it, and the ink supplying portion is rotated by a force applied through the cam.

The objects, features, and advantages of the aspects are that under a state where the ink cartridge is not attached, the ink supplying portion is drawn inside the cartridge casing, whereby handling of the ink cartridge is improved and a possibility of causing an erroneous discharge of a droplet is lowered. under a state where the ink cartridge is not attached, the ink supplying portion is drawn inside the cartridge casing, whereby handling of the ink cartridge is improved and a possibility of causing an erroneous discharge of a droplet is lowered.

According to a seventh aspect of the present invention, there is provided an ink cartridge that can be attached to and detached from an imaging apparatus, including: an cartridge casing having an opening; an ink accommodating body accommodating an ink; a nozzle insertion unit which includes a nozzle insertion path and is connected to the ink accommodating body to enable suction of the ink via the opening of the cartridge casing by a suction nozzle of the imaging apparatus; a shielding unit configured to shield the nozzle insertion path from the outside; and a moving unit configured to move the nozzle insertion unit to a position where the nozzle insertion path faces the suction nozzle when the ink cartridge is attached to the imaging apparatus and to move the nozzle insertion unit to a position where the nozzle insertion path faces the shielding unit when the ink cartridge is detached from the imaging apparatus.

The objects, features, and advantages of the aspect are that under a state where the ink cartridge is not attached, the ink supplying portion is drawn inside the cartridge casing, whereby handling of the ink cartridge is improved and a possibility of causing an erroneous discharge of a droplet is lowered.

According to an eighth aspect of the present invention, there is provided an imaging apparatus configured to attach and detach the ink cartridge according to the preceding aspects.

According to a ninth aspect of the present invention, there is provided an imaging apparatus configured to attach and detach the ink cartridge according to the preceding aspect, and includes a rack engaged with the pinion.

According to a tenth aspect of the present invention, there is provided the imaging apparatus according to the preceding aspect, wherein the rack is held by the imaging apparatus to be movable in directions of attaching and detaching the ink cartridge, and biased in the direction of detaching the ink cartridge.

According to an eleventh aspect of the present invention, there is provided an imaging apparatus configured to attach and detach the ink cartridge according to the preceding aspect, and includes a counter cam face engaged with the cam.

According to a twelfth aspect of the present invention, there is provided the imaging apparatus according to the preceding aspect, wherein the counter cam face is a slider cam held by the imaging apparatus to be movable in directions of attaching and detaching the ink cartridge, and biased in the direction of detaching the ink cartridge.

The objects, features, and advantages of the aspects are that handling in an exchange work of the ink cartridge is improved and a possibility of causing an erroneous discharge of a droplet by intrusion of extraneous matter from the ink supplying portion to an inside of the imaging apparatus is lowered.

According to a thirtieth aspect of the present invention, there is provided an ink cartridge that can be attached to and detached from an imaging apparatus, including: an ink accommodating unit accommodating an ink; a cartridge casing accommodating the ink accommodating unit; an ink supplying port connected to the ink accommodating unit and enabling insertion of a hollow needle of the imaging apparatus; a moving unit configured to move the ink supplying port between an ink supplying position where the hollow needle is inserted and a shielding position where the ink supplying port is shielded from the outside; and a starting unit configured to contribute an ink supply to the imaging apparatus when the ink cartridge is attached to the imaging apparatus.

The objects, features, and advantages of the aspect are that handling of the ink cartridge is improved, and a possibility of causing an erroneous discharge of a droplet is lowered, and an ink supplying operation is stopped when the ink cartridge is not attached.

According to a fourteenth aspect of the present invention, there is provided the ink cartridge according to the preceding aspect, wherein the starting unit is drawn inside the cartridge casing when the ink supplying port is in the shielded position, and protrudes outside the cartridge casing when the ink supplying port is in the ink supplying position.

According to a fifteenth aspect of the present invention, there is provided the ink cartridge according to the preceding aspects, wherein the ink supplying port is held to be rotatable relative to the cartridge casing, and the moving unit rotates the ink supplying port when the ink cartridge is attached to the imaging apparatus.

According to a sixteenth aspect of the present invention, there is provided the ink cartridge according to the preceding aspect, wherein a direction of an axis around which the moving unit rotates is the same as a direction of inserting the hollow needle.

According to a seventeenth aspect of the present invention, there is provided the ink cartridge according to the preceding aspects, wherein the moving unit is integrally formed with the ink supplying port According to an eighteenth aspect of the present invention, there is provided the ink cartridge according to the preceding aspects, wherein the starting unit is provided opposite to the ink supplying port with respect to the axis around which the moving unit rotates.

According to a nineteenth aspect of the present invention, there is provided the ink cartridge according to the preceding aspects, further including: an air accommodating unit configured to hermetically seal the ink accommodating unit inside the air accommodating unit and to receive an air in a space between the air accommodating unit and the ink accommodating unit; and a nozzle connector configured to connect an air nozzle member injecting the air from the imaging apparatus to the space between the air accommodating unit and the ink accommodating unit.

According to a twentieth aspect of the present invention, there is provided the ink cartridge according to the preceding aspect, wherein the nozzle connector is moved between a connecting position where the air nozzle member is connected and a shielding position shielded from an outside.

The objects, features, and advantages of the aspects are that handling of the ink cartridge is improved, and a possibility of causing an erroneous discharge of a droplet is lowered, and an ink supplying operation is stopped with a simple structure when the ink cartridge is not attached.

According to a twenty first aspect of the present invention, there is provided an imaging apparatus including: the ink cartridge according to the preceding aspects; a unit configured to move the moving unit; and a unit configured to feed the ink when activated by the starting unit.

According to a twenty second aspect of the present invention, there is provided the imaging apparatus according to the preceding aspect, further including: a shielding member configured to shield the hollow needle; and a releasing member configured to engage the shielding member at a shielding position and release the engagement of the shielding member when activated by the starting unit of the ink cartridge.

According to a twenty third aspect of the present invention, there is provided the imaging apparatus according to the preceding aspects, wherein the unit configured to feed the ink is activated by releasing an operation prohibiting state of prohibiting to feed the ink by receiving an electric signal.

According to a twenty fourth aspect of the present invention, there is provided an imaging apparatus including: the ink cartridge according to the preceding aspect; and a portion configured to push the starting unit when the ink cartridge is attached to the imaging apparatus and the starting unit protrudes outside the cartridge casing.

The objects, features, and advantages of the aspects are that a possibility of causing an erroneous discharge of a droplet is lowered, and an ink supplying operation is stopped with a simple structure when the ink cartridge is not attached.

According to a twenty fifth aspect of the present invention, there is provided an ink charging jig used to charge an ink, including: an ink accommodating unit configured to accommodate the ink; a cartridge casing accommodating the ink accommodating unit; an ink supplying unit which is connected to the ink accommodating unit and is to be inserted by a supplying nozzle from an imaging apparatus; and a moving unit configured to move a part of the ink supplying unit between an ink supplying position where the charging nozzle is inserted in the ink supplying unit and a shielding position where the ink supplying unit is shielded from an outside, the ink charging jig, including: a positioning unit which engages the cartridge casing and determines a position of the charging nozzle of the charging unit; and an engaging unit which engages the moving unit in a state where the position of the charging unit is determined and moves the part of the ink supplying unit to the ink supplying position.

The objects, features, and advantages of the aspect are that the ink supplying unit moves when the jig is attached to the ink cartridge, workability of charging the ink into the ink cartridge of which ink supplying port is shielded from an outside can be improved.

According to a twenty sixth aspect of the present invention, there is provided an ink charging jig according to the preceding aspect, further including: a hold unit configured to hold the charging unit having the charging nozzle.

According to a twenty seventh aspect of the present invention, there is provided the ink charging jig according to the preceding aspects, wherein the positioning unit engages a cutout in the cartridge casing at a position facing the moving unit.

According to a twenty eighth aspect of the present invention, there is provided the ink charging jig according to the preceding aspects, wherein the moving unit has a pinion and the engaging unit has a rack engaging the pinion.

According to a twenty ninth aspect of the present invention, there is provided the ink charging jig according to the preceding aspects, wherein the moving unit has a cam and the engaging unit has a counter cam face contacting the cam.

The objects, features, and advantages of the aspects are that the ink supplying unit moves when the jig is attached to the ink cartridge, workability of charging the ink into the ink cartridge of which ink supplying port is shielded from an outside can be improved.

According to a thirtieth aspect of the present invention, there is provided an ink charging device used to charge an ink to the ink cartridge including: an ink accommodating unit configured to accommodate the ink; a cartridge casing accommodating the ink accommodating unit; an ink supplying unit which is connected to the ink accommodating unit and is to be inserted by a supplying nozzle from an imaging apparatus; and a moving unit configured to move a part of the ink supplying unit between an ink supplying position where the charging nozzle is inserted in the ink supplying unit and a shielding position where the ink supplying unit is shielded from an outside, the ink charging device, including: the charging jig according to the preceding aspects; and a charging unit which is held by the ink charging jig to move forward and backward by an elastic member and has the charging nozzle inserted in the ink supplying unit.

The objects, features, and advantages of the aspects are that the ink supplying unit moves when the jig is attached to the ink cartridge, workability of charging the ink into the ink cartridge of which ink supplying port is shielded from an outside can be improved.

According to a thirteen first aspect of the present invention, there is provided an ink charging method of charging an ink to the ink cartridge including: an ink accommodating unit configured to accommodate the ink; a cartridge casing accommodating the ink accommodating unit; an ink supplying unit which is connected to the ink accommodating unit and is to be inserted by a supplying nozzle from an imaging apparatus; and a moving unit configured to move a part of the ink supplying unit between an ink supplying position where the charging nozzle is inserted in the ink supplying unit and a shielding position where the ink supplying unit is shielded from an outside, the ink charging method, including: moving the ink supplying unit to the ink supplying position by the charging jig according to the preceding aspects; and inserting the charging nozzle of the ink supplying unit into the ink supplying unit; and charging the ink via the charging nozzle.

The objects, features, and advantages of the aspect are that workability of charging the ink into the ink cartridge of which ink supplying port is shielded from an outside can be improved.

According to a thirteen second aspect of the present invention, there is provided an ink charging kit used to charge an ink to the ink cartridge including an ink accommodating unit configured to accommodate the ink; a cartridge casing accommodating the ink accommodating unit; an ink supplying unit which is connected to the ink accommodating unit and is to be inserted by a supplying nozzle from an imaging apparatus; and a moving unit configured to move a part of the ink supplying unit between an ink supplying position where the charging nozzle is inserted in the ink supplying unit and a shielding position where the ink supplying unit is shielded from an outside, the ink charging kit, including: the charging jig according to the preceding aspects; a charging unit which is held by the ink charging jig and has the charging nozzle inserted in the ink supplying unit; and a package body configured to accommodate the charging jig and the charging unit.

According to a thirteen third aspect of the present invention, there is provided the ink charging kit according to the preceding aspect, wherein the package body further includes a charging ink.

The objects, features, and advantages of the aspects are that the ink supplying unit moves when the jig is attached to the ink cartridge, workability of charging the ink into the ink cartridge of which ink supplying port is shielded from an outside can be improved.

According to a thirteen fourth aspect of the present invention, there is provided an ink charging jig used to charge an ink in an ink cartridge including: an ink accommodating unit configured to accommodate the ink; a cartridge casing accommodating the ink accommodating unit; an ink supplying unit which is connected to the ink accommodating unit and is to be inserted by a supplying nozzle from an imaging apparatus; a moving unit configured to move the ink supplying unit between an ink supplying position where the charging nozzle is inserted in the ink supplying unit and a shielding position where the ink supplying unit is shielded from an outside, the ink charging jig, including: a fixing unit which fixes the moving unit at the ink supplying position; and a holding unit configured to hold the charging nozzle.

The objects, features, and advantages of the aspect are that the ink supplying unit moves when the jig is attached to the ink cartridge, and the ink can be charged via the charging nozzle inserted in the ink supplying unit, whereby workability of charging the ink into the ink cartridge of which ink supplying port is shielded from an outside can be improved.

According to a thirteen fifth aspect of the present invention, there is provided the ink charging jig according to the preceding aspect, wherein the fixing unit fixes a part protruding from the cartridge casing to the cartridge casing.

According to a thirteen sixth aspect of the present invention, there is provided the ink charging jig according to the preceding aspect, wherein the ink cartridge includes: an air accommodating unit configured to hermetically seal the ink accommodating unit inside the air accommodating unit and receive an air in a space between the air accommodating unit and the ink accommodating unit; and a nozzle connector configured to connect an air nozzle member injecting the air from an imaging apparatus to the space between the air accommodating unit and the ink accommodating unit, wherein the fixing unit fixes the nozzle connector at a position where the charging nozzle is connected.

According to a thirteen seventh aspect of the present invention, there is provided the ink charging jig according to the preceding aspect, wherein the fixing unit includes an air through hole connecting the air accommodating unit to an outside of the cartridge casing.

The objects, features, and advantages of the aspects are that the ink supplying unit moves when the jig is attached to the ink cartridge, and the ink can be charged via the charging nozzle inserted in the ink supplying unit, whereby workability of charging the ink into the ink cartridge of which ink supplying port is shielded from an outside can be improved.

According to a thirteen eighth aspect of the present invention, there is provided an ink charging device used to charge an ink in an ink cartridge including: an ink accommodating unit configured to accommodate the ink; a cartridge casing accommodating the ink accommodating unit; an ink supplying unit which is connected to the ink accommodating unit and is to be inserted by a supplying nozzle from an imaging apparatus; a moving unit configured to move the ink supplying unit between an ink supplying position where the charging nozzle is inserted in the ink supplying unit and a shielding position where the ink supplying unit is shielded from an outside, the ink charging device, including: the ink charging jig according to the preceding aspects; and a charging unit which is held by the ink charging jig by an elastic member to move forward and back and has the charging nozzle inserted in the ink supplying unit.

The objects, features, and advantages of the aspect are that workability of charging the ink into the ink cartridge of which ink supplying port is shielded from an outside can be improved According to a thirteen ninth aspect of the present invention, there is provided An ink charging method of charging an ink in an ink cartridge including: an ink accommodating unit configured to accommodate the ink; a cartridge casing accommodating the ink accommodating unit; an ink supplying unit which is connected to the ink accommodating unit and is to be inserted by a supplying nozzle from an imaging apparatus; a moving unit configured to move the ink supplying unit between an ink supplying position where the charging nozzle is inserted in the ink supplying unit and a shielding position where the ink supplying unit is shielded from an outside, the ink charging method, including: using the ink charging jig according to the preceding aspects; fixing the moving unit at the ink supplying position; inserting the charging nozzle in the ink supplying unit; and charging the ink via the charging nozzle.

The objects, features, and advantages of the aspect are that workability of charging the ink into the ink cartridge of which ink supplying port is shielded from an outside can be improved According to a fourteenth aspect of the present invention, there is provided an ink charging kit used to charge an ink in an ink cartridge including: an ink accommodating unit configured to accommodate the ink;

a cartridge casing accommodating the ink accommodating unit; an ink supplying unit which is connected to the ink accommodating unit and is to be inserted by a supplying nozzle from an imaging apparatus; a moving unit configured to move the ink supplying unit between an ink supplying position where the charging nozzle is inserted in the ink supplying unit and a shielding position where the ink supplying unit is shielded from an outside, the ink charging kit, including: the ink charging jig according to the preceding aspects; a charging unit which is held by the ink charging jig to move forward and backward by an elastic member and has the charging nozzle inserted in the ink supplying unit; and a package body configured to accommodate the charging jig and the charging unit.

According to a forty first aspect of the present invention, there is provided the ink charging kit according to the preceding aspect, wherein the package body further includes a charging ink.

The objects, features, and advantages of the aspects are that the ink supplying unit moves when the jig is attached to the ink cartridge, and the ink can be charged via the charging nozzle inserted in the ink supplying unit, whereby workability of charging the ink into the ink cartridge of which ink supplying port is shielded from an outside can be improved.

BEST MODE FOR CARRYING OUT THE INVENTION

Figure 66:
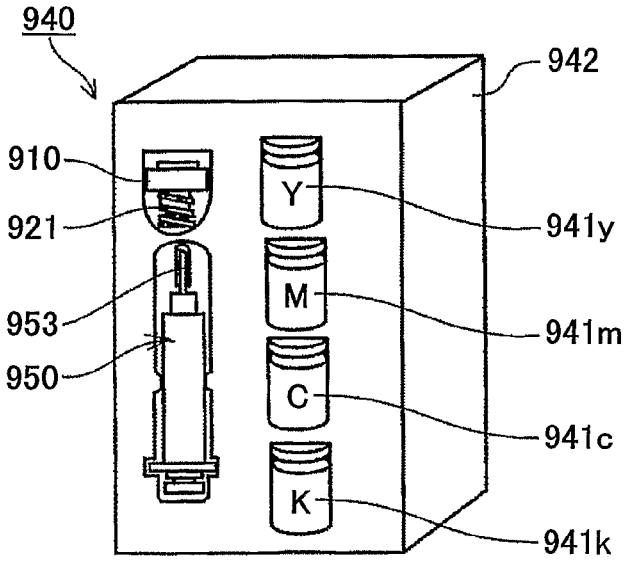
FIG. 66 a schematic view of an example of an ink charging kit.

A description will now be given, with reference to FIG. 1 through FIG. 66, of embodiments of an ink cartridge and an imaging apparatus of the present invention.

In the embodiments, numerical references are typically as follows.

1: main body; 2: paper feed tray; 3: paper ejection tray; 4: cartridge mount portion; 5: operation and indication portion; 10: ink cartridge; 21: side plate; 21*a*: left side plate; 21*b*: right side plate; 24: supply pump unit; 31: guide rod; 32: guide rod; 33: carriage; 34: recording head; 35: sub tank; 36: various color supply tube; 41: bottom plate; 42: paper; 43: paper feed roller; 44: separation pad; 45: guide member; 46: counter roller; 47: feeding guide; 48: holding member; 49: pressurizing skid; 51: feeding belt; 56: charged roller; 61: separation claw; 62: paper ejection roller; 63: spur; 71: double side unit; 72: manual paper feed tray; 81: maintaining and recovering unit; 82: cap; 83: wiper; 84: idle discharge receiver; 87: carriage lock; 88: idle discharge receiver; 89: opening; 90: first waste tank; 91: second waste tank; 102: ink bag (ink accommodating unit); 103: cartridge casing; 103*ba*: shield; 104: opening; 121: bag portion; 122: connecting member; 123: ink charging port; 124: ink supplying port; 125: ink supplying portion (moving unit); 125*a*: lever (starting unit); 126: nozzle insertion path; 127: sealing part; 127*a*: groove; 128: retainer; 128*a*: opening; 128*b*: four claws; 129: information storing unit; 130*a*: low-density polyethylene (LDPE); 130*b*: dry lamination; 130*c*: aluminum film; 130*d*: dry lamination; 130*e*: polyallomer (PA); 131: flange; 132: spindle; 133: pinion; 135: seat; 136: hedging portion; 137: upper rib; 138: spring; 138*a*: engaging part; 138*b*: engaging part; 139: protrusion; 141: screw; 142: boss; 144: guide portion; 145: guide portion; 146: guide portion; 150: cutout; 150*a*: back end; 163: cam (moving unit); 163*a*: cam lobe; 171: boss section; 172: cap; 174: rotating member; 175: sealing member receiving part; 175*a*: protrusion; 181: engaging rib; 182: engaging rib; 185: rotating member; 200: insertion slot; 200*a*: back wall; 200*b*: stopper; 201: hollow needle; 202: rack; 203: compression spring; 209: tag reader; 210: Locking member; 210*a*: engagement portion; 210*b*: slop portion; 211*a*: interlocking contact; 212: contact; 213*a*: rod pin; 214*a*: spring; 222: slider cam; 222*a*: counter cam face; 250: control unit; 251: driver; 252: pump driving unit; 300: ink supplying jig; 300*a*: clip; 300*b*: clip; 301: first positioning part; 302: second positioning part; 303: rack; 305: holding part; 300: ink charging jig; 310: ink charging jig; 313: cam; 320: ink charging device; 321: elastic member; 330: ink charging kit; 331: ink container; 332: package body; 333: cover; 340: ink charging kit; 341: ink container; 342: package body; 400: charger; 401: charger body; 402: cylindrical part; 403: charging nozzle; 501: main body; 503: guide rod; 504: guide rail; 505: carriage; 506: sub guide roller; 508: maintaining and recovering unit; 510: paper; 511: driving motor; 512: driving pulley; 513: driven pulley; 514: belt; 520: recording head; 520*a-j*: recording heads; 521: head portion; 522: buffer tank; 524: tube; 525: air supply pump; 526: tube; 530: cap; 600: ink cartridge; 601: cartridge casing; 602: ink bag; 603: air bag; 604: dual bag; 611: opening; 612: opening; 613: opening; 614: opening; 615: bearing; 617: shielding part; 618: escape hole; 619: color identification rib; 620: handle; 620*a*: locking tab; 621: rotating member (moving unit); 622: ink supplying port; 622*a*: supply path; 622*b*: elastic member; 623: nozzle connector; 625: ink supplying portion (moving unit); 627: pushed portion (starting unit); 626: sealing part; 628: protrusion (starting unit); 629: elastic part; 640: ink; 700: slot; 700*a*: back wall; 700*b*: stopper; 701: opening; 703: trigger; 706: escape groove; 707: escape groove; 709: position detecting part; 710: fixing part; 711: interlocking contact; 712: contact; 731: recess; 740: shield; 741: flange; 742: opening; 743: spring; 750: pivot; 751: lever; 752: engaging part; 753: receiver; 754: contact; 760: spring; 800: control unit; 801: driver; 802: pump driving unit; 850: hollow needle; 890: air nozzle member; 900: ink charging jig; 901: holder; 902: fixture; 903: boss; 904: positioning hole; 905: arm; 906: boss; 910: ink charging jig; 911: jig main body; 912: fixing part; 913: boss; 914: positioning hole; 915: step-like ring; 916: air through hole; 920: ink charging device; 921: elastic member; 930: ink charging kit; 931: ink container; 932: package body; 933: cover; 940: ink charging kit; 941: ink container; 942: package body; 950: charger; 951: charger body; 952: cylindrical part; and 953: charging nozzle (nozzle member)

Figure 1:
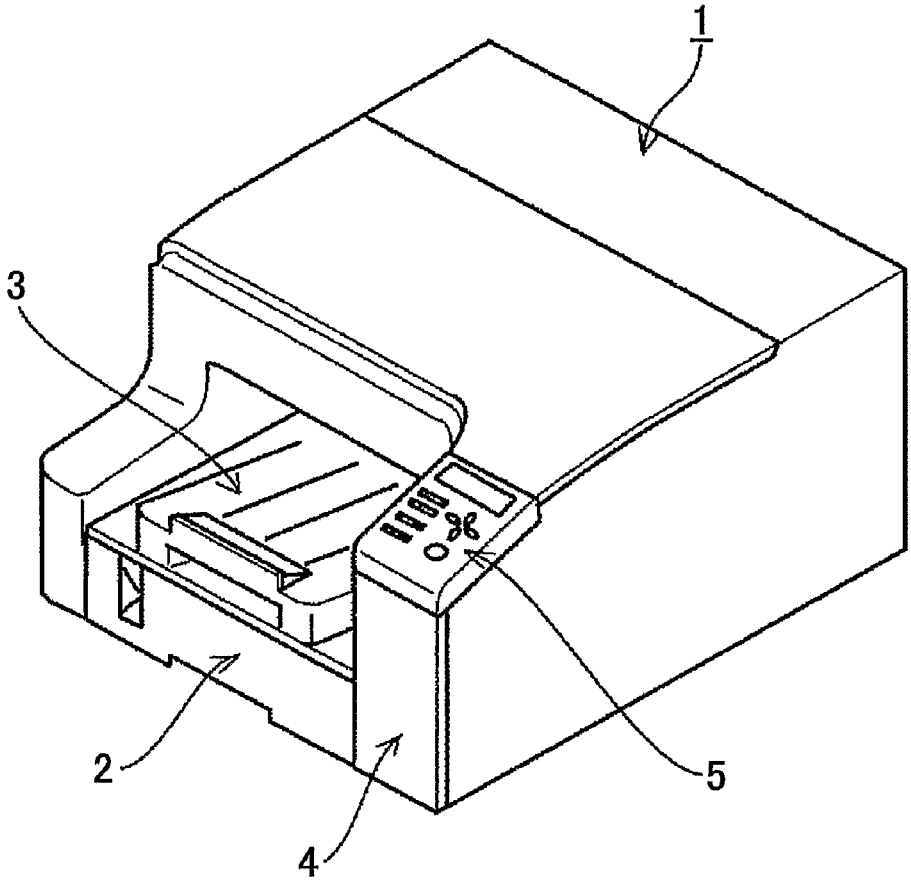
FIG. 1 is a perspective view of an imaging apparatus according to the present invention.

An example of the present invention is described in reference of FIG. 1. FIG. 1 is a perspective view of an imaging apparatus. An example of the imaging apparatus is a serial type inkjet printer and has a main body 1, a paper feed tray 2 which can be drawn from the main body 1 to a predetermined paper supplying position as in FIG. 2, and a paper ejection tray 3 which opens and closes an upper portion of the paper feed tray 2 *y* swinging relative to the main body 1. The paper feed tray 2 is stocked with papers to be supplied to the main body 1, and the paper ejection tray 3 stocks paper with an image recorded (formed) on it. An ink cartridge of an embodiment is mounted on a cartridge mount portion 4 at a one front end portion of the main body 1, and an operation and indication portion 5 including a manual operation button and an indicator are provided on an upper surface of the cartridge mount portion 4.

Figure 2:
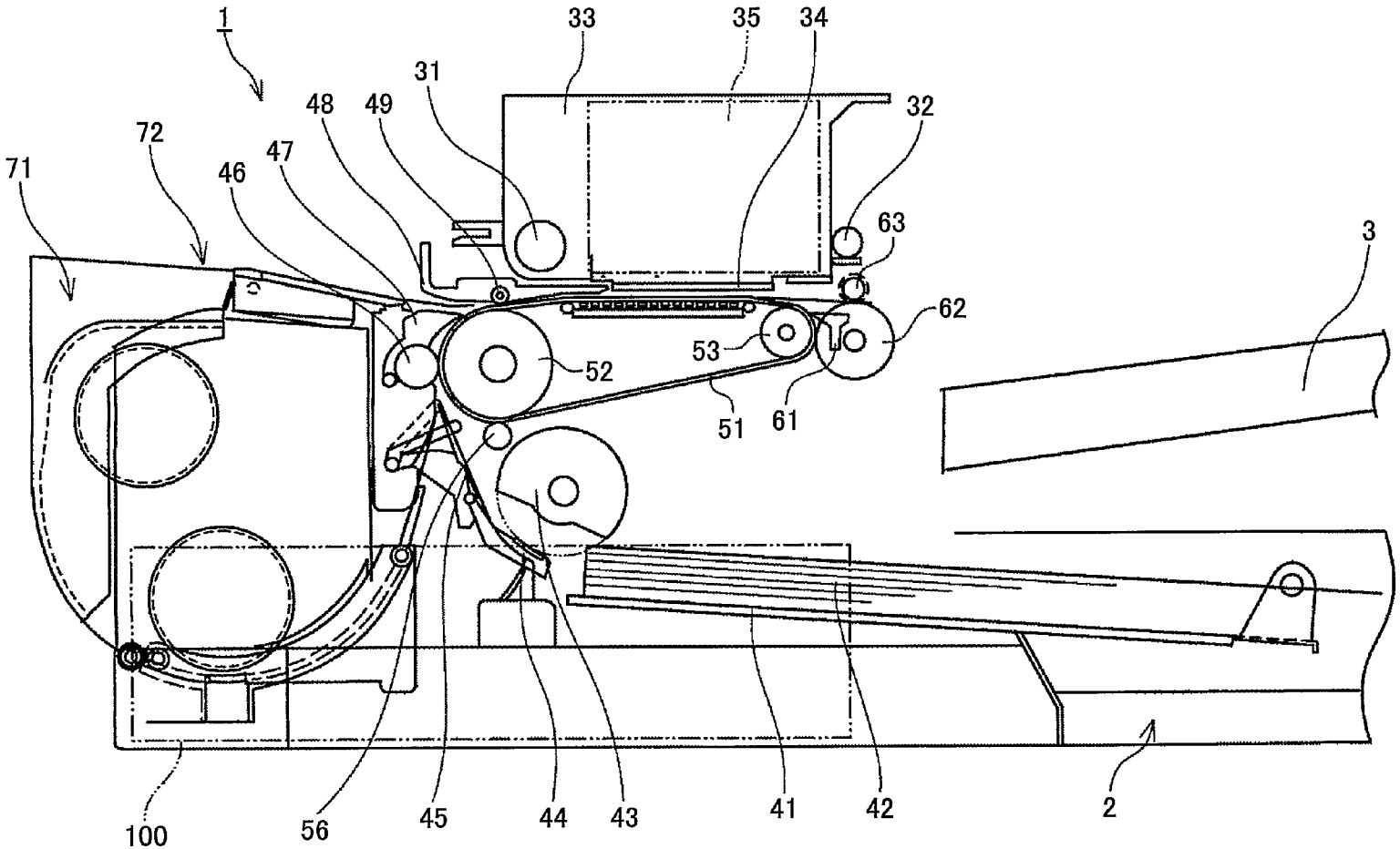
FIG. 2 is a side view of the imaging apparatus schematically showing its mechanical unit
Figure 3:
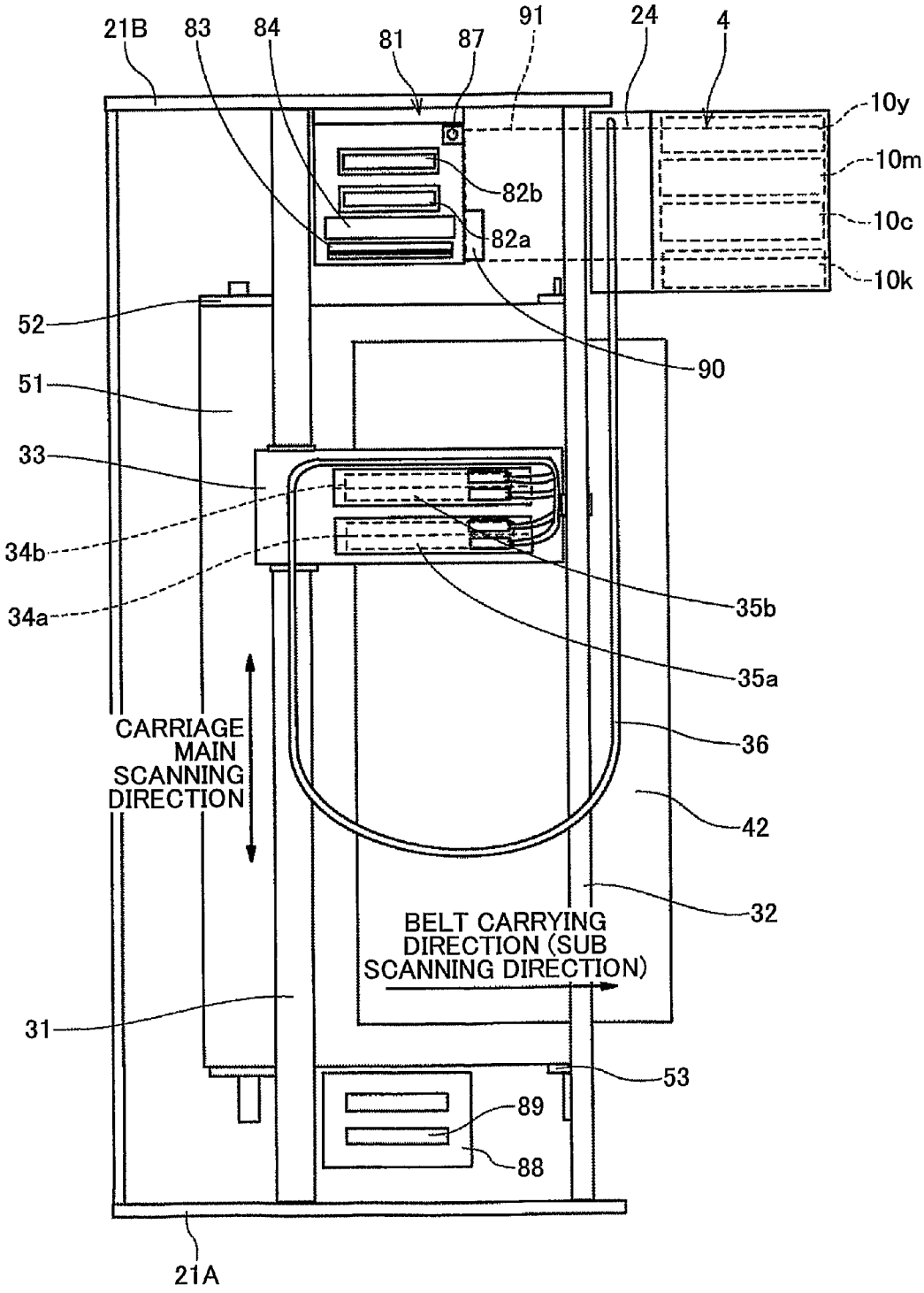
FIG. 3 is a plan view of important portions of the imaging apparatus.

A mechanical unit of the imaging apparatus will be described with reference to FIGS. 2 and 3. FIG. 2 is a side view of the imaging apparatus schematically showing the mechanical unit. FIG. 3 is a plan view of important portions of the imaging apparatus. A 21A and a 21B hold a guide rod 31 and a guide rod 32 between the 21A and the 21B. A carriage 33 is retained by the guide rod 31 and guide rod 32 so as to freely slide in a main scanning direction and driven in an arrow direction in FIG. 3 via a timing belt by a main scanning motor (not shown).

A recording head 34 (e.g. a recording head 34*a* and a recording head 34*b*) has a liquid discharge head discharging various color ink droplets such as yellow (Y), cyan (C), magenta (M) and black (K) from plural nozzles. A line of the nozzles is arranged in a sub scanning direction perpendicular to the main scanning direction, and discharges the ink droplets downward.

The recording head 34*a* and the recording head 34*b* each has two lines of nozzles. A first one of the lines of the recording head 34*a* discharges droplets of black, and the other of the lines discharges droplets of cyan (C). Another first one of the lines of the recording head 34*b* discharges droplets of magenta (M), and the other of the lines discharges droplets of yellow (Y).

Sub tanks 35 (e.g. 35*a* and 35*b*) are provided in the carriage 33 for supplying the various color inks to the lines of the nozzles of the recording head 34. The various color inks are supplied from an ink cartridge 10 (e.g. various color 10*y*, 10*m*, 10*c*, 10*k*), which can be attached to and detached from the cartridge mount portion 4, via various color supply tubes 36 by a supply pump unit 24.

A paper feed roller 43 feeds papers 42 loaded on a bottom plate 41 one by one. A separation pad 44 (friction pad) having a large friction coefficient is provided opposite to the paper feed roller 43 and biased toward the paper feed roller 43. The paper feed roller 43 and the separation pad 44 function as a paper feed unit.

A guide member 45 for guiding the paper 42, a counter roller 46, a feeding guide 47 and a holding member 48 including a pressurizing skid 49 further feed the paper 42 supplied from the paper feed tray 2. A feeding belt 51 electrostatically attracts and holds the paper 42 thus supplied and delivers it just beneath the recording head 34.

The feeding belt 51 has no end and moves in a sub scanning direction between a roller 52 and a roller 53. A charged roller 56 is provided to charge a surface of the feeding belt 51. The charged roller 56 is in contact with a surface layer of the feeding belt 51 and rotates along with the movement of the feeding belt 51. The feeding belt 51 moves in a transfer direction of the belt by rotation of the 52 at predetermined timing. The 52 is driven by a sub scanning motor (not shown).

A catch unit includes a separation claw 61, a paper ejection roller 62, a spur 63 and the paper ejection tray 3. The separation claw 61 peels off the paper 42 recorded by a recording head 34 from the feeding belt 51. The paper 42 is interposed between the paper ejection roller 62 and the spur 63 and fed out into the paper ejection tray 3 positioned below the paper ejection roller 62.

A double side unit 71 can be attached to or detached from a back surface of the main body 1. The paper 42 returned by a reverse rotation of the feeding belt 51 is taken in the double side unit 71, turned over, and supplied between the counter roller 46 and the feeding belt 51 again. A manual paper feed tray 72 is provided on an upper surface of the double side unit 71.

A maintaining and recovering unit 81 for maintaining and recovering an operable state of the nozzles of the recording head 34 is positioned in a non-printing area of the carriage 33. The non-printing area is provided on one side of the carriage 33 along the main scanning direction of the carriage 33. The maintaining and recovering unit 81 includes caps 82*a* and 82*b* (hereinafter, collectively referred to as a "cap 82") for capping nozzle surfaces of the recording head 34, a wiper (wiper blade) 83 for wiping the nozzle surfaces, an idle discharge receiver 84 for receiving droplets which do not contribute to recording and are discharged for ejecting a recording liquid, and a carriage lock 87 for locking the carriage 33.

A first waste tank 90 is provided on a lower side of the maintaining and recovering unit 81. The first waste tank 90 is not ordinarily exchanged and accommodates a waste liquid from the 84 when the idle discharge is carried out or the wiper 83 is cleaned. A second waste tank 91 is provided on a lower side of the cartridge mount portion 4 and a side of the maintaining and recovering unit 81. The second waste tank 91 can be exchanged from a front side of the main body 1. Because the ink cartridge 10 and the second waste tank 91 are exchanged from the front side of the main body 1 after opening a front cover, a cost of manufacturing the imaging apparatus can be reduced.

An idle discharge receiver 88 is provided for receiving a droplet which does not contribute recording and is discharged for ejecting a recording liquid thickened during recording by an idle discharge. The idle discharge receiver 88 is positioned in a non-printing area on another side along the main scanning direction of the carriage 33. The idle discharge receiver 88 has an opening 89 provided along a direction of a line of the nozzles of the recording head 34.

The imaging apparatus is configured such that the paper 42 is fed from the paper feed tray 2 one sheet by one sheet, vertically guided by the guide member 45, fed between the feeding belt 51 and the counter roller 46, guided by the feeding guide 47 at an end of the paper 42, pressured by the pressurizing skid 49 toward the feeding belt 51, and directed to change its feed direction by substantially ninety degrees.

An AC voltage is applied to the charged roller 56 so as to alternately generate a positive current and a negative current. Thus, the feeding belt 51 takes a positive charge and a negative charge alternately with a predetermined width in the sub scanning direction. Said differently, the feeding belt 51 has a pattern of positively and negatively charged stripes. When the paper 42 is fed on the feeding belt 51, the paper 42 is held by the feeding belt 51 by its electrostatic force and fed in the sub scanning direction along with movement of the feeding belt 51.

By driving the recording head 34 depending on an image signal, ink droplets are discharged onto the paper 42 to thereby record one row. By moving the carriage 33, the paper 42 is fed by a predetermined distance and a next row is ready for recording. Then, by driving the recording head 34 depending on an image signal, ink droplets are discharged onto the paper 42 to thereby record the next row. After receiving a record end signal or a signal indicating that an end of the paper 42 reaches a recording area, a recording operation is completed and the paper 42 is ejected into the paper ejection tray 3.

When the nozzles of the recording head 34 are maintained and recovered, the carriage 33 is moved to a position opposite to the maintaining and recovering unit 81. Then, the 35 is subject to capping by the cap 82 and a nozzle suction and an idle discharge of discharging droplets which do not contribute to image forming. By this maintaining and recovering action, it is possible to form an image along with a stabilized discharge of droplets.

Embodiment 1

Figure 4:
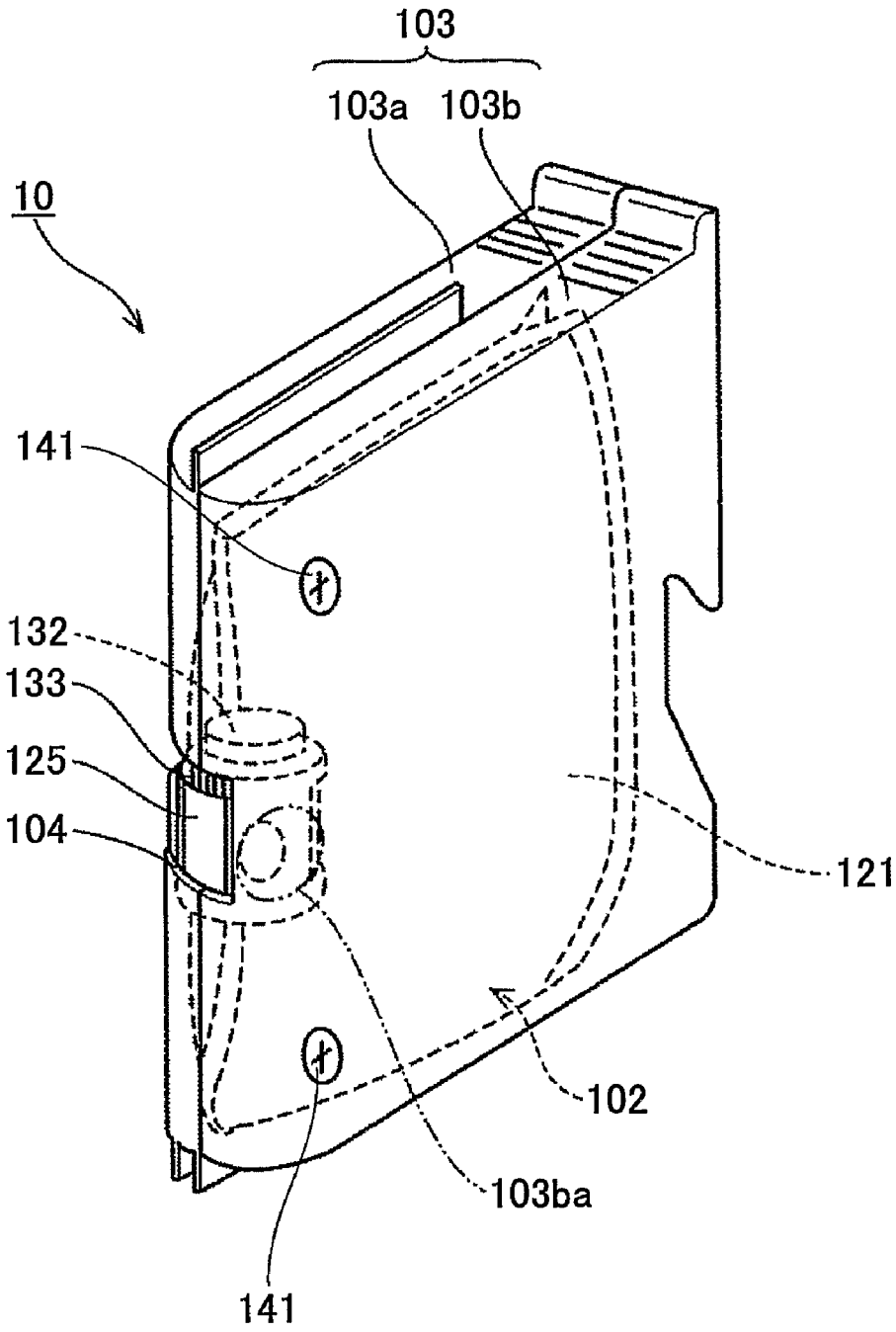
FIG. 4 is a perspective view of an ink cartridge of Embodiment 1.
Figure 5:
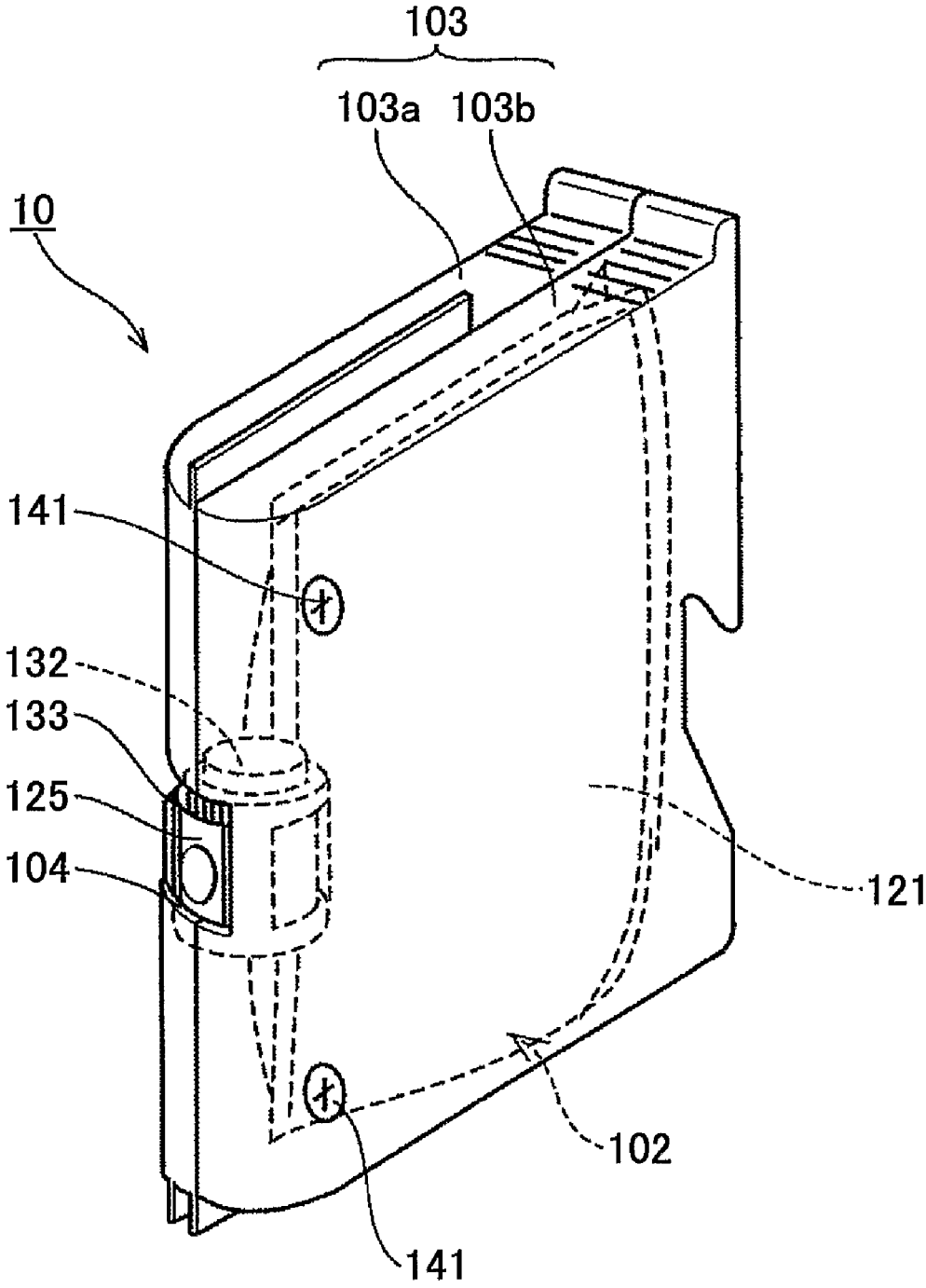
FIG. 5 is a perspective view of the ink cartridge in a state different from that in FIG. 4.
Figure 6:
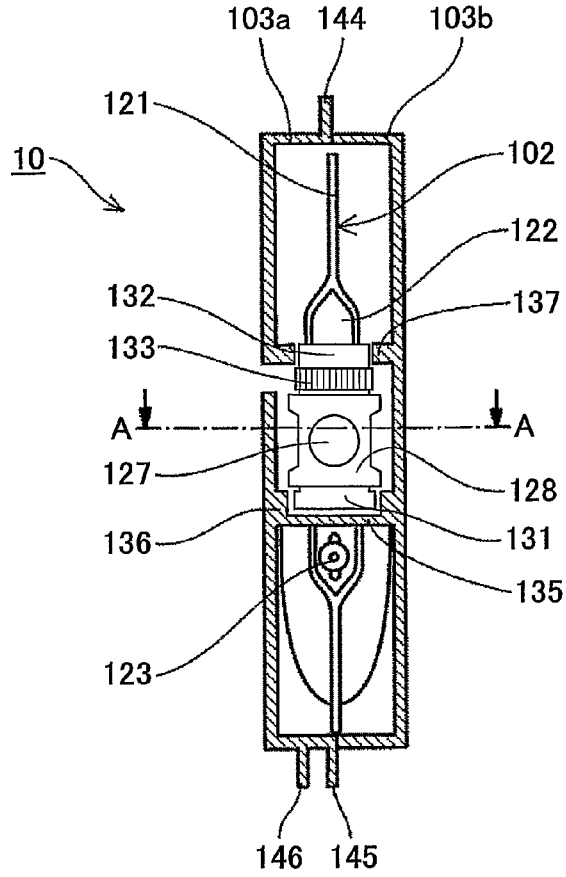
FIG. 6 is a cross-sectional front view of the ink cartridge in the state of FIG. 5.

An ink cartridge 10 of Embodiment 1 according to the present invention will be described with reference to FIGS. 4 through 6. FIG. 4 is a perspective view of the ink cartridge 10. FIG. 5 is a perspective view of the ink cartridge 10 in an operational state different from that in FIG. 4. FIG. 6 is a cross-sectional front view of the ink cartridge in the operational state of FIG. 5. This ink cartridge 10 includes an ink bag (ink accommodating unit) 102 for accommodating ink and a cartridge casing 103 accommodating the ink bag (ink accommodating unit) 102. The cartridge casing 103 includes a cartridge casing 103*a* and a cartridge casing 103*b* divided into two portions in a surface parallel to an ink supplying direction from the ink bag (ink accommodating unit) 102. An opening 104 is formed on a front side of the cartridge casing 103. The front side means a side facing the main body 1 when the cartridge casing 103 is inserted into the main body 1, and a back side is a side opposite to the front side of the cartridge casing 103. The opening 104 is formed when the cartridge casing 103*a* and the cartridge casing 103*b* are assembled. Hereinafter, when the opening 104 of the cartridge casing 103 is referred to in the specification, the cartridge casing 103 has been assembled.

Figure 7:
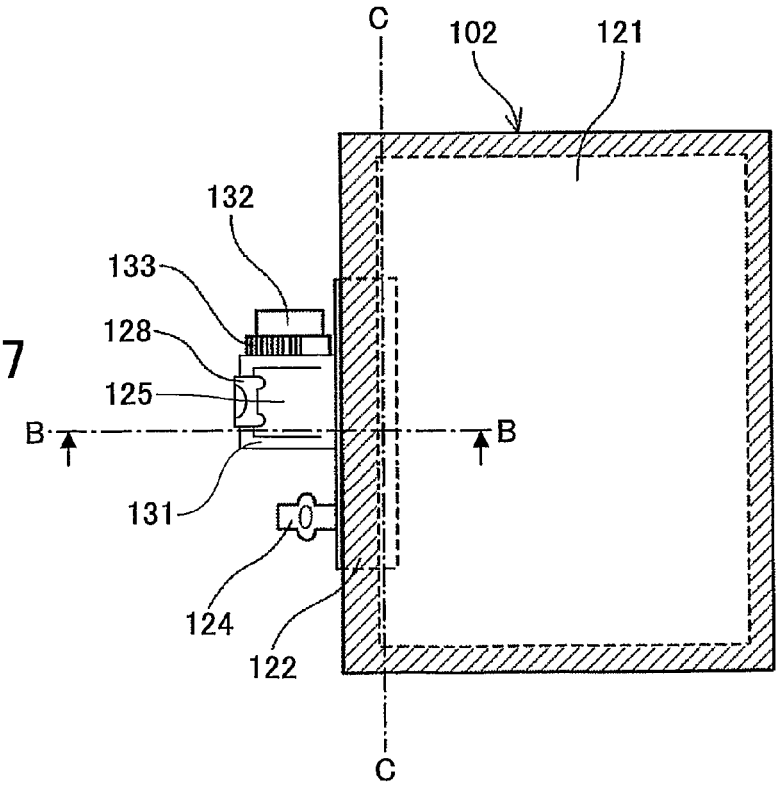
FIG. 7 is a side view of an ink bag (ink accommodating unit).
Figure 8:
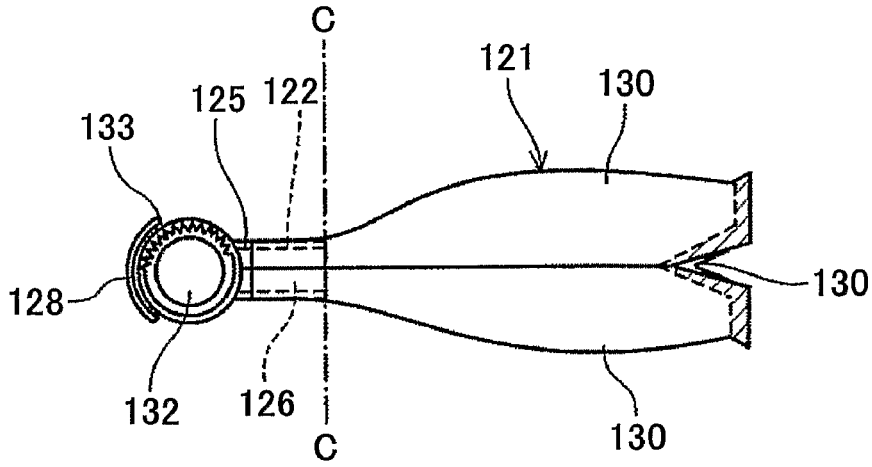
FIG. 8 is a plan view of the ink bag (ink accommodating unit) shown in FIG. 7.
Figure 9:
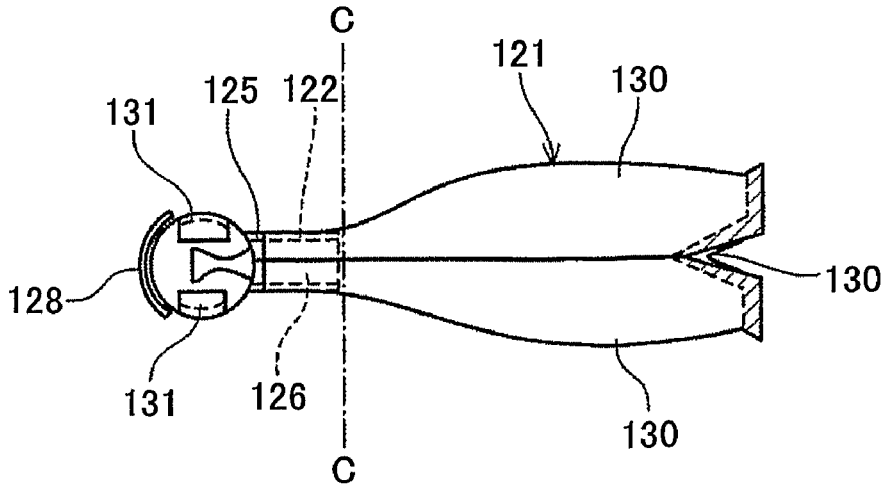
FIG. 9 is a bottom view of the ink bag (ink accommodating unit) shown in FIG. 7.
Figure 10:
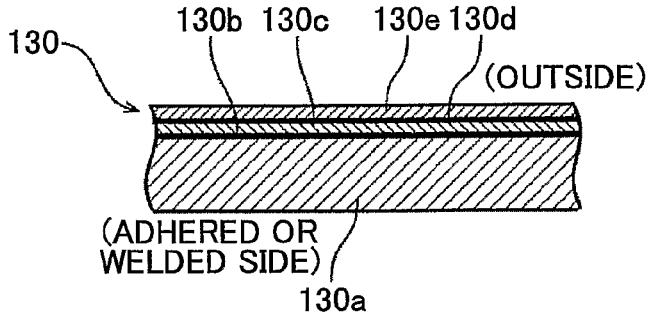
FIG. 10 is a partial enlarged cross-sectional view of an aluminum laminate film forming the ink bag (ink accommodating unit).
Figure 11:
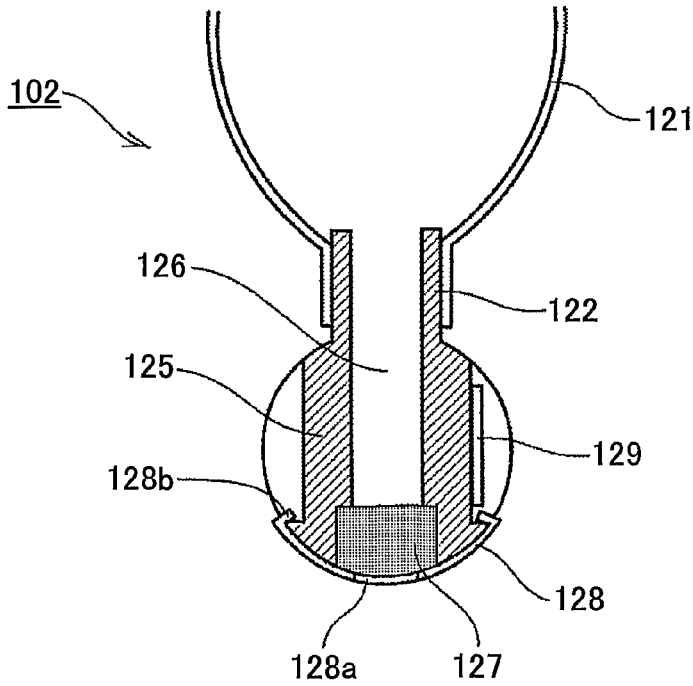
FIG. 11 is a cross-sectional view of an important portion of FIG. 6 taken along a line A-A of FIG. 6.

The ink bag (ink accommodating unit) 102 will be described with reference to FIGS. 7 through 11. FIG. 7 is a side view of the ink bag (ink accommodating unit) 102. FIG. 8 is a plan view of the ink bag (ink accommodating unit) 102 shown in FIG. 7. FIG. 9 is a bottom view of the ink bag (ink accommodating unit) 102 shown in FIG. 7. FIG. 10 shows a part of an aluminum laminate film forming the ink bag (ink accommodating unit) 102. FIG. 11 is a cross-sectional view of an important portion of FIG. 6 taken along a line A-A of FIG. 6.

The ink bag (ink accommodating unit) 102 includes a bag portion 121, which is made of an aluminum laminate film, has a substantially rectangular shape, is flexible, and can accommodate an ink, and a connecting member 122 made from a resin and attached to the bag portion 121 by adhesion, fusion bonding or welding, for example. A side shape of the bag portion 121 is not limited to the rectangular shape and may be, for example, a substantially circular shape or a substantially ellipsoidal shape. The bag portion 121 may not be in a specific shape.

For example, an 130 is formed by sequentially laminating a dry lamination 130*b*, a aluminum film 130*c*, a dry lamination 130*d* and a polyallomer (PA) 130*e* in this order on a low-density polyethylene (LDPE) 130*a* as shown in FIG. 10. The bag portion 121 is formed like a bag by adhering peripheries (shaded areas in FIGS. 7 through 9) of three sheets of the 130 thus formed and further adhering the outer two sheets to the connecting member 122 as shown in FIGS. 7 through 9.

Because the bag portion 121 has flexibility, unused ink is not left inside the bag portion 121. Although in the embodiment, the bag portion 121 is made of a plurality of the aluminum laminate films, a material is not so limited. Preferably, the bag portion 121 includes at least a part or a sheet of an aluminum laminate film.

The connecting member 122 is made of, for example, polyacetal. An ink charging port 123 through which ink is fed into the bag portion 121 is formed through and on an end of the connecting member 122. The ink charging port 123 may be sealed by melting a part of the ink charging port 123.

An ink supplying port 124 is formed through and on an end of the connecting member 122 to supply the ink inside the bag portion 121 to the 1.

As shown in FIG. 11, the ink supplying port 124 has a 126 through which a hollow needle 201 is inserted. The hollow needle 201 is a nozzle member for suctiontioning ink and supplying the ink to the main body 1. A sealing part 127 made of an elastic material such as butyl rubber is pressed into a front side of the 126 while being pressed in a radial direction and a longitudinal direction. When the hollow needle 201 pierces the sealing part 127, the nozzle insertion path 126 is sealed. When the hollow needle 201 pierces the sealing part 127 and passes through the 126, ink is readily supplied.

A retainer 128 for preventing the sealing part 127 from falling off is provided on a front side of the sealing part 127. The retainer 128 has an opening 128*a* through which the hollow needle 201 of the 1 is inserted. The retainer 128 is held on a front surface of the ink supplying portion (moving unit) ink supplying portion (moving unit) 125 by engaging four claws 128*b* with dents of the ink supplying portion (moving unit) ink supplying portion (moving unit) 125. The sealing part 127 may be formed by punching out a metal plate such as a stainless steel.

An information storing unit 129 is for example a radio frequency identification (RFID), a contactless IC or an IC tag. The information storing unit 129 is attached to a side of the ink supplying portion (moving unit) ink supplying portion (moving unit) 125 as shown in FIG. 11. The information storing unit 129 is configured to embed an antenna in an IC tag. The information storing unit 129 carries out radio communication with a transmission unit (a tag reader) on the main body 1 to read out previously saved information and be updated with information received from the main body 1. The information saved in the information storing unit 129 is ink information such as a manufacturing lot, a manufacturing date, a factory name, an expiration date, and a guarantee period; and information about the ink cartridge 10 such as a printed number of pages, a duration of use by each imaging apparatus, calculated remaining quantities of inks, an ink end history (a number of times when flags are on), and a number of refills in a factory.

In comparison with a case where the above-described information storage unit 129 is provided in an ink cartridge, management of inks becomes easier in a case where the above-described information storing unit 129 is provided in an ink accommodating unit such as an ink bag. In the case where the information storage unit is provided in the cartridge casing, when only the cartridge casing is exchanged, it is necessary to modify information in an information storing unit newly provided in the new cartridge casing in order to match histories of use of the ink and the ink accommodating unit including the ink supplying portion (moving unit) ink supplying portion (moving unit) 125 and a history of use of the new cartridge casing. By providing the information storing unit 129 in the ink accommodating unit, it is possible to integrally manage the ink accommodating unit such as the ink bag (ink accommodating unit) 102 and the information storing unit 129.

The ink supplying portion (moving unit) ink supplying portion (moving unit) 125 of the ink bag (ink accommodating unit) 102 is rotatable relative to the cartridge casing 103 and supported by the cartridge casing 103. By the rotation, the 126 is directed toward an inside of the cartridge casing 103 as shown in FIG. 4 or to the opening 104 as shown in FIG. 5. Said differently, the sealing part 127 faces an inside of the cartridge casing 103 as shown in FIG. 4 or faces the opening 104 as shown in FIG. 5. At this time, a shield 103*ba* of a cartridge casing 103*a*, which is a part of the cartridge casing 103, shields the ink supplying portion (moving unit) ink supplying portion (moving unit) 125 from an outside as shown in FIG. 4.

The ink bag (ink accommodating unit) 102 bends at a line C-C in FIGS. 7 through 9 between the bag portion 121 and the ink supplying portion (moving unit) ink supplying portion (moving unit) 125 under a state of FIG. 4. Thus, the bag portion 121 can follow the rotation of the ink supplying portion (moving unit) ink supplying portion (moving unit) 125. The line C-C of the bag portion 121 shows an adhered, bonded or welded portion between the bag portion 121 and the connecting member 122. Therefore, stiffness at the line C-C is low. Stress applied by the rotation of the ink supplying portion (moving unit) ink supplying portion (moving unit) 125 tends to bend the bag portion 121 at and around the position of line C-C.

Figure 12:
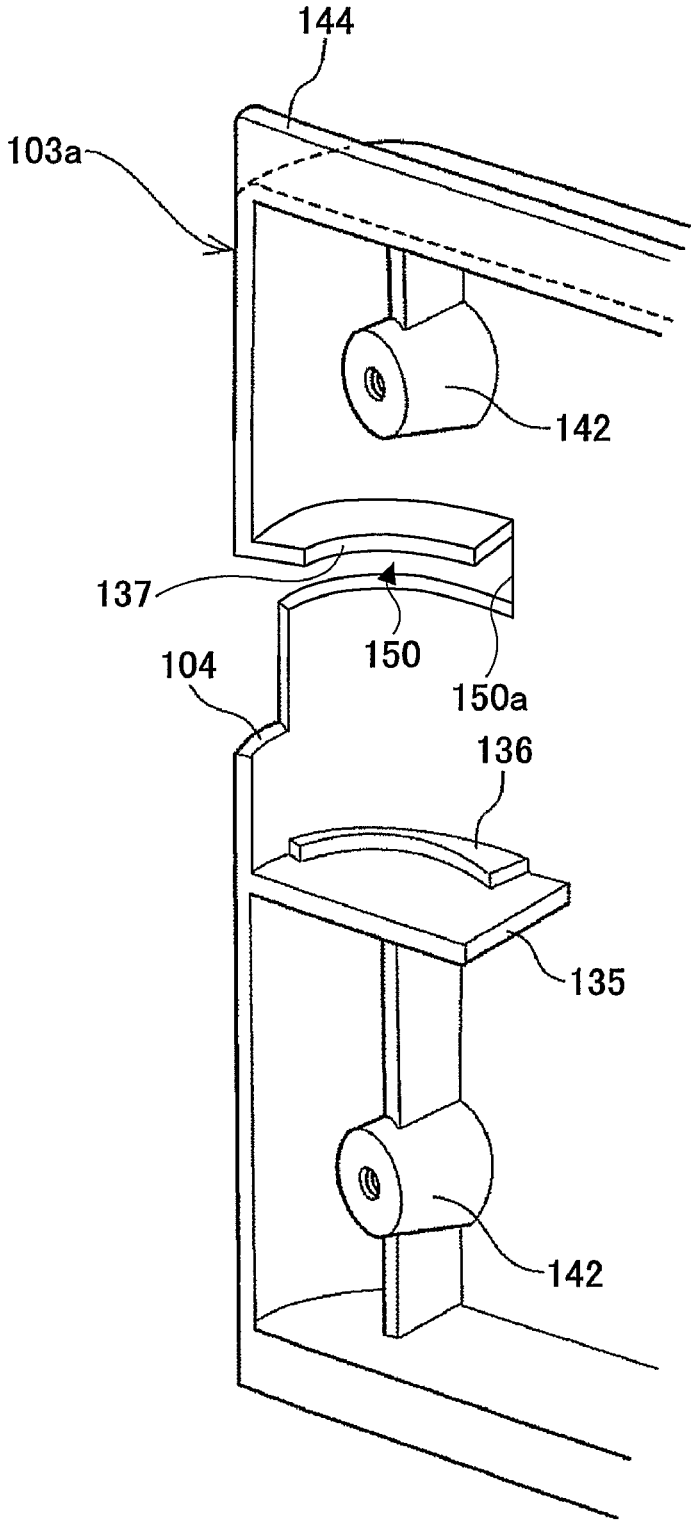
FIG. 12 is a perspective view of an important portion of a cartridge casing.
Figure 13:
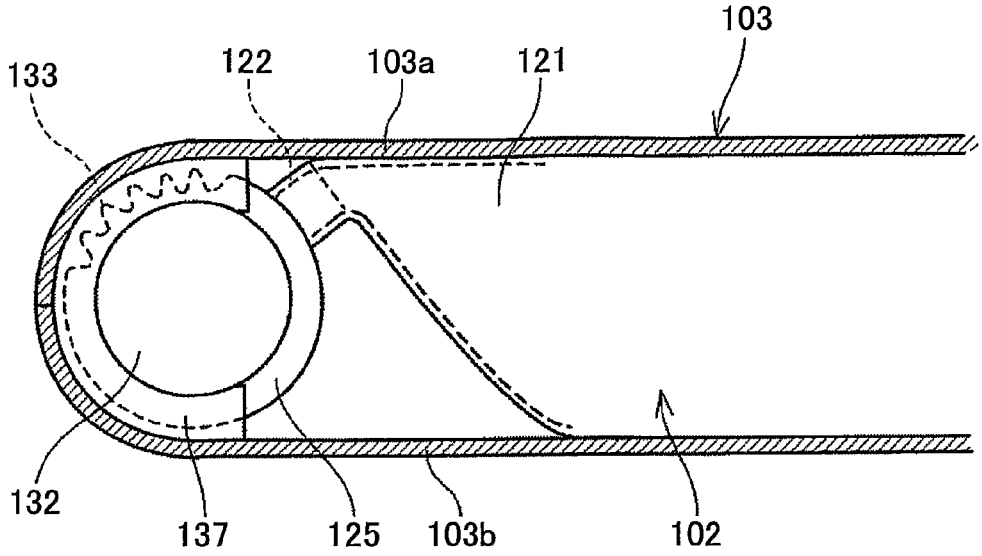
FIG. 13 is a cross-sectional plan view of an important portion of the cartridge casing.
Figure 14:
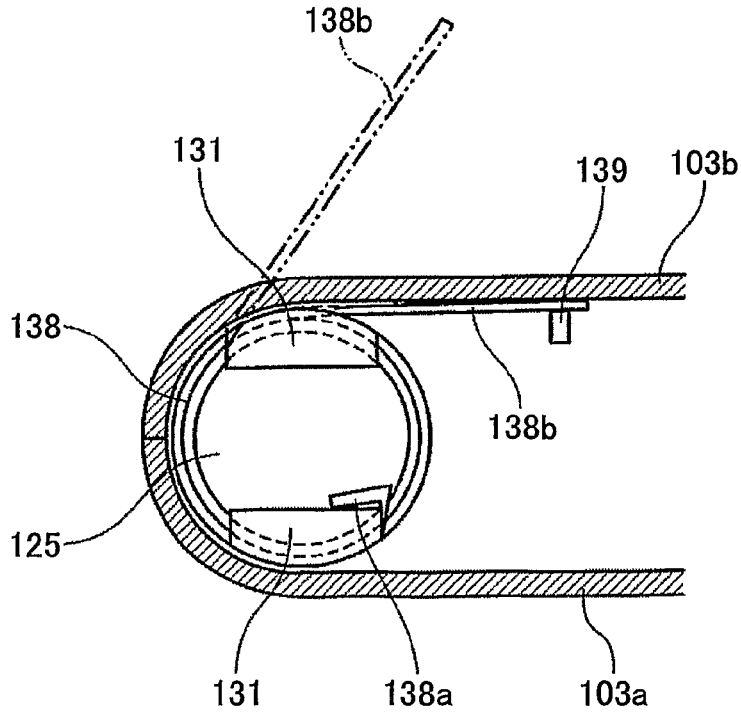
FIG. 14 is a cross-sectional plan view of an important portion of the cartridge casing taken along a line B-B of FIG. 7.

Next, a structure of holding the ink bag (ink accommodating unit) 102 by the cartridge casing 103 will be described with reference to FIGS. 12 through 15. FIG. 12 is a perspective view of an important portion of a cartridge casing 103*a*. FIG. 13 is a cross-sectional plan view of an important portion of the cartridge casing 103*a*. FIG. 14 is a cross-sectional plan view of an important portion of the cartridge casing 103*a* along a line B-B of FIG. 7.

Two flanges 131 are provided in a lower portion of the ink supplying portion (moving unit) ink supplying portion (moving unit) 125 of the ink bag (ink accommodating unit) 102. A spindle 132 is provided in an upper portion of the ink supplying portion (moving unit) ink supplying portion (moving unit) 125. A pinion 133 for rotating the ink supplying portion (moving unit) ink supplying portion (moving unit) 125 is formed in a part of a periphery of the spindle 132. The pinion 133 may be formed around an entire periphery of the spindle 132. However, it is sufficient to form the pinion 133 within a range necessary for rotating the ink supplying portion (moving unit) ink supplying portion (moving unit) 125 between a position of the sealing part 127 facing the opening 104 and a position of the sealing part 127 facing shield 103*ba* in FIGS. 4 and 11.

The flange 131 of the ink supplying portion (moving unit) ink supplying portion (moving unit) 125 is settled on a seat 135 formed in the cartridge casing 103 as shown in FIGS. 6 and 12. A periphery of the flange 131 is hedged by a hedging portion 136 so as to be rotatable. The seat 135 of the cartridge casing 103 determines a position of the ink supplying portion (moving unit) ink supplying portion (moving unit) 125 in a height direction. The spindle 132 of the ink supplying portion (moving unit) ink supplying portion (moving unit) 125 is held by an upper rib 137 formed in the cartridge casing 103 so as to be rotatable as shown in FIGS. 6, 12 and 13.

The ink supplying portion (moving unit) 125 of the ink bag (ink accommodating unit) 102 is held by the cartridge casing 103 and moves as shown in FIGS. 4 and 5.

Figure 15:
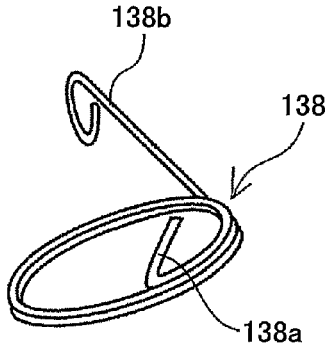
FIG. 15 is a perspective view of an biasing unit (spring) used in the cartridge casing.

Further, the ink supplying portion (moving unit) 125 is biased by a spring 138 so that the 126 is directed to an inner wall surface of the cartridge casing 103*b* (i.e. the shield 103*ba* shown in FIG. 4) as shown in FIG. 14. The spring 138 is a coil spring as shown in FIG. 15. One end is an engaging part 138*a* and the other end is an engaging part 138*b*. The engaging part 138*a* engages the flange 131 of the ink supplying portion (moving unit) 125 as shown in FIG. 14. The engaging part 138*b* engages a protrusion 139 formed in the cartridge casing 103*b* being twisted from an upper broken line to a lower solid line.

The cartridge casing 103*a* and the cartridge casing 103*b* are joined by screws 141 at an upper portion and a lower portion of the ink supplying portion (moving unit) 125 to bear a force generated by the spring 138.

Said differently, when the engaging part 138*b* engages the cartridge casing 103*b*, the cartridge casing 103*b* has applied with a restoring force deforming the cartridge casing 103*b* by the spring 138. Therefore, there is the likelihood that the cartridge casing 103*b* becomes deformed. It is possible to prevent the cartridge casing 103*b* from deforming by providing a boss 142 for screwing the screw 141 from the cartridge casing 103*b* to the cartridge casing 103*a* and fixing the cartridge casing 103*a* to the cartridge casing 103*b* around the ink supplying portion (moving unit) 125 by the screws 141.

The cartridge casing 103*a* and the cartridge casing 103*b* are fixed not only by the screws 141 but also by a plurality of snap-fit portions (not shown) along outer peripheries of matching surfaces of the cartridge casing 103*a* and the cartridge casing 103*b*. One of the snap-fit portion includes a snap-fit claw and a snap-fit hole. When the snap-fit claw is provided in the cartridge casing 103*a*, the snap-fit hole is provided in the cartridge casing 103*b* at a position corresponding to the snap-fit claw. Although the snap-fit portion is exemplified, the embodiment is not so limited, and other securing measures may be employed.

The cartridge casing 103 is integrally provided with guide portions 144, 145, and 146, used when the cartridge casing 103 is attached to and detached from the 1. The cartridge casing 103 may be any of the cartridge casing 103*a* and the cartridge casing 103*b*. By a positional relationship between the guide portion 145 and the guide portion 146, a color of the ink cartridge 10 is identified to prevent the ink cartridge 10 from being attached to a different color's position.

Further, the cartridge casing 103*a* has a cutout 150 into which a rack 202 of the 1 can enter so that the rack 202 is engaged with the pinion 133 of the ink supplying portion (moving unit) 125. An outer periphery of the pinion 133 does not protrude from an outer wall surface of the cartridge casing 103*a* around the cutout 150. Therefore, even if the outer wall surface of the cartridge casing 103*a* around the cutout 150 is in contact with extraneous matters such as a floor, the ink supplying portion (moving unit) 125 is not rotated to outward expose the sealing part 127. Further, a back end 150*a* of the cutout 150 is a positioning surface (hereinafter, referred to as the cutout 150) which is made to be in contact with the cutout 150 in order to determine a positional relationship between the rack 202 and the ink supplying portion (moving unit) 125 irrespective of movement of the ink cartridge 10.

Figure 16:
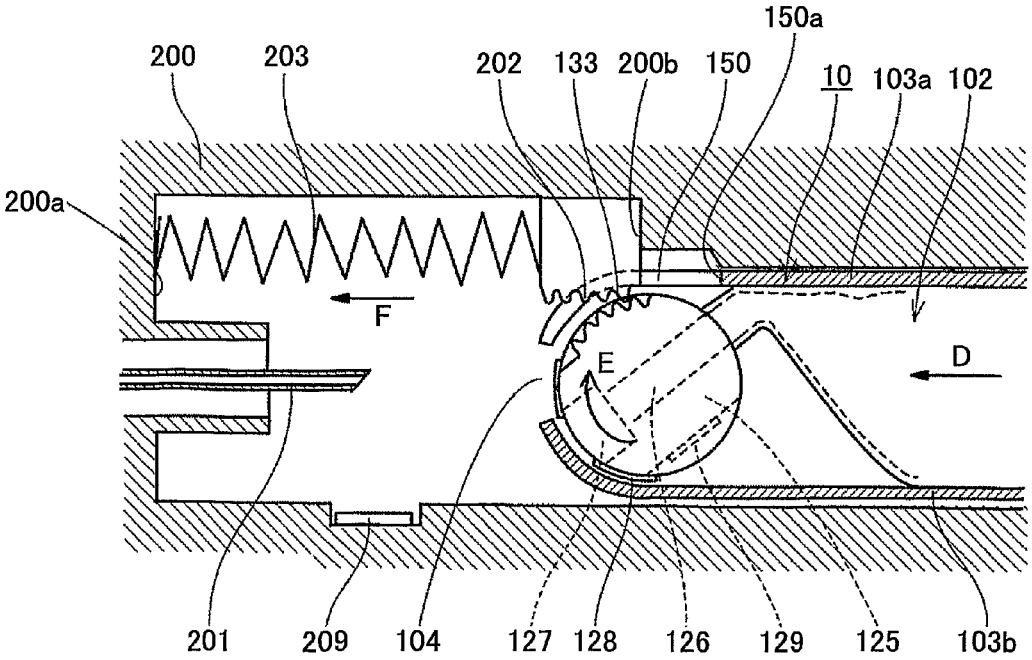
FIG. 16 is a cross-sectional plan view of a part of the ink cartridge when the ink cartridge 10 is half inserted into an insertion slot of a cartridge mount portion.
Figure 17:
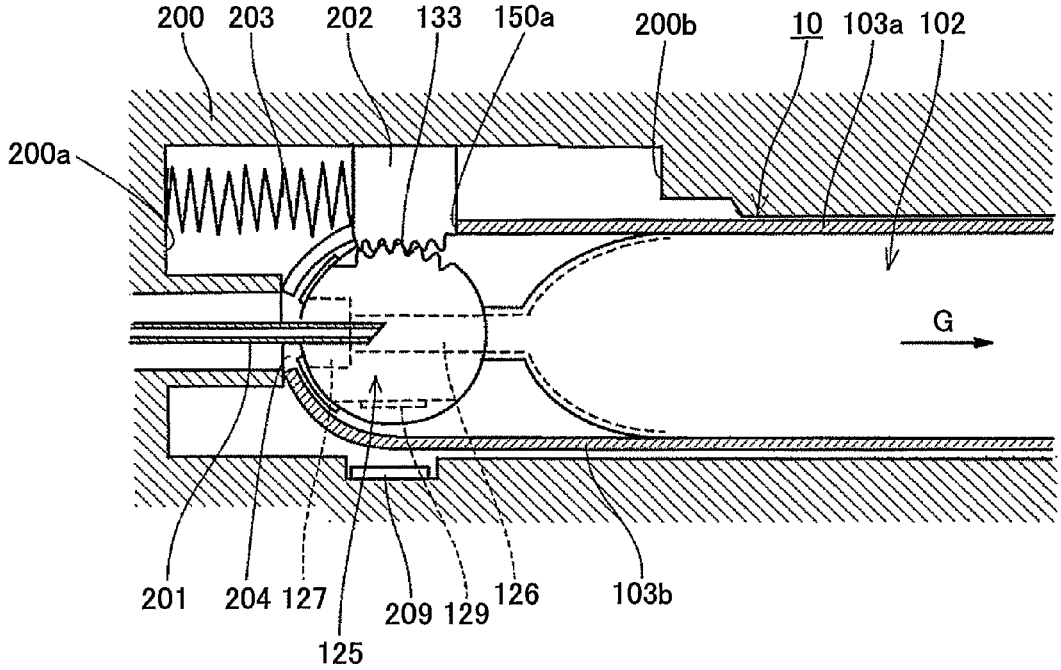
FIG. 17 is a cross-sectional plan view of a part of the ink cartridge when the ink cartridge is completely inserted into the insertion slot of the cartridge mount portion.

Next a structure of the 4 of the main body 1 will be described with reference to FIGS. 16 and 17. FIG. 16 is a cross-sectional plan view of a part of the ink cartridge 10 when the ink cartridge 10 is half inserted into an insertion slot 200 of the cartridge mount portion 4. FIG. 17 is a cross-sectional plan view of a part of the ink cartridge 10 when the ink cartridge 10 is completely inserted into the insertion slot 200 of the cartridge mount portion 4.

A hollow needle 201 penetrating through the sealing part 127 of the ink supplying portion (moving unit) 125 and reaching the 126 for suctioning ink is provided on an inner end of an insertion slot 200 which one ink cartridge 10 is attached to or detached from. The hollow needle 201 is connected to the supply pump of the supply pump unit 24 described above. By operating the supply pump, the ink inside the ink bag (ink accommodating unit) 102 is suctioned and supplied to the main body 1 via the hollow needle 201.

The rack 202 to be engaged with the pinion 133 is held on an inner side wall surface so as to be moved in attaching and detaching directions of the ink cartridge 10. The rack 202 is biased in a direction of pushing by a compression spring 203, i.e. a direction of extracting the ink cartridge 10, by the compression spring 203 interposed between the 200*a* and the rack 202. Initially, the rack 202 is pushed against the stopper 200*b* of the insertion slot 200.

A biasing force of the compression spring 203 is set larger than a resultant force obtained by adding a sliding resistance in rotating the ink supplying portion (moving unit) 125 to a retroactive force of the spring 138. When the pinion 133 and the rack 202 are engaged, the ink supplying portion (moving unit) 125 can start to rotate earlier than a movement of the rack 202 caused by inserting the ink cartridge 10.

A tag reader 209 for communicating with the information storing unit 129 provided in the ink supplying portion (moving unit) 125 of the ink cartridge 10 is provided in an inner wall surface of the insertion slot 200.

Attachment and detachment of the ink cartridge 10 to and from the cartridge mount portion 4 will be described with reference to FIGS. 16 and 17. Before attaching the ink cartridge 10 to the main body 1, the ink supplying portion (moving unit) 125 is drawn inside the cartridge casing 103 as shown in FIGS. 16 and 17. The 126 and the sealing part 127 are shielded by the shield 103*ba* from outside.

Accordingly, it is possible to prevent a user from touching a front surface of the sealing part 127 where the hollow needle 201 pierces and prevent extraneous matter, oil and so on from being attached to the front surface. Therefore, intrusion of extraneous matter, oil and so on can be prevented, and the likelihood of an erroneous discharge of a droplet can be lowered.

As shown in FIG. 16, when the ink cartridge 10 is inserted into the insertion slot 200 of the cartridge mount portion 4 in a direction of an arrow D (a setting direction), the pinion 133 of the ink supplying portion (moving unit) 125 is engaged with the rack 202.

Since the rack 202 does not move by the biasing force of the compression spring 203, the ink cartridge 10 starts to rotate in a direction of an arrow E along with insertion of the ink cartridge 10 in a direction of an arrow D. When the rack 202 is contact with the back end 150*a* of the ink cartridge 10, the ink supplying portion (moving unit) 125 stops to rotate. As a result, the 126 of the ink supplying portion (moving unit) 125 and the sealing part 127 are opposite to the opening 104 and the hollow needle 201 of the main body 1.

Further, as the ink cartridge 10 is inserted into the direction of the arrow D for setting the ink cartridge 10, the rack 202 moves along with the ink cartridge 10 in a direction of arrow F against the biasing force of the compression spring 203 because the rack 202 is in contact with the back end 150*a* of the ink cartridge 10. While maintaining a positional relationship between the 126 of the ink supplying portion (moving unit) 125 and the hollow needle 201 of the ink cartridge 10, the ink cartridge 10 is inserted into the insertion slot 200.

As shown in FIG. 17, the hollow needle 201 of the 1 penetrates the sealing part 127 to reach the 126 filled with the ink and connecting to the bag portion 121. Thus, it becomes possible to supply the ink from the ink cartridge 10 to the main body 1.

Since the rack 202 engaged with the pinion 133 of the ink cartridge 10 is movable relative to the insertion slot 200, it is possible to properly set a positional relationship between the hollow needle 201 and the ink supplying portion (moving unit) 125 of the ink cartridge 10. Therefore, it is possible to prevent the hollow needle 201 from obliquely piercing or piercing a part other than the sealing part 127.

When the ink cartridge 10 is taken out of the main body 1, by ejecting the ink cartridge 10 in a direction of an arrow G shown in FIG. 17, the hollow needle 201 is withdrawn from the sealing part 127, and the rack 202 maintains contact with the back end 150*a* of the ink cartridge 10 by the biasing force of the compression spring 203 and moves along with the ejection of the ink cartridge 10. Then the rack 202 is in contact with the stopper 200*b*.

By ejecting the ink cartridge 10 in the direction of the arrow G while the rack 202 and the pinion 133 are engaged, the ink supplying portion (moving unit) 125 of the ink cartridge 10 is rotated in a direction reverse to the direction of attaching the ink supplying portion (moving unit) 125. Therefore, the ink supplying portion (moving unit) 125 is maintained to be drawn inside the cartridge casing 103 and to be shielded from the outside by a shield 103*ba*. Thereafter, the ink cartridge 10 is ejected from the cartridge mount portion 4.

When the ink cartridge 10 is used up or the ink cartridge 10 during use are ejected from the cartridge mount portion 4, the ink supplying portion (moving unit) 125 of the ink cartridge 10 is drawn inside the cartridge casing 103 and shielded from the outside, so that even though an ink is attached to the front surface of the sealing part 127 of the ink supplying portion (moving unit) 125, it is possible to prevent the ink from further splattering to hands of the user and the other parts.

When the ink cartridge 10 is attached to the insertion slot 200, the ink supplying portion (moving unit) 125 rotates and the information storing unit 129 is positioned opposite to the tag reader 209, thereby enabling transmission between the ink supplying portion (moving unit) 125 and the information storing unit 129. An information storage unit integrating an IC antenna is restricted to a transmission distance within several centimeters.

The tag reader 209 is arranged in the vicinity of a side surface of the cartridge casing 103, and the ID tag (the information storing unit 129) approaches the tag reader 209 at the time of setting the ink cartridge 10, so that communications within a close distance becomes possible and radio communication becomes good. Further, when the ink cartridge 10 is not attached, the information storing unit 129 faces a back side of the cartridge casing 103 in a longitudinal direction. Because there is a relatively large clearance in this direction, an impact does not propagate even if the ink cartridge 10 is dropped and yields, whereby impact durability of the cartridge casing 103 is improved.

Although the rotational angle of the ink supplying portion (moving unit) 125 is set up about 40 degrees in FIGS. 16 and 17, when the rotational angle is set about 90 degrees by increasing the number of indents of the rack 202 and pinion 133, the information storing unit 129 faces the back side of the cartridge casing 103 in an longitudinal direction, whereby impact durability can be further improved.

Figure 18:
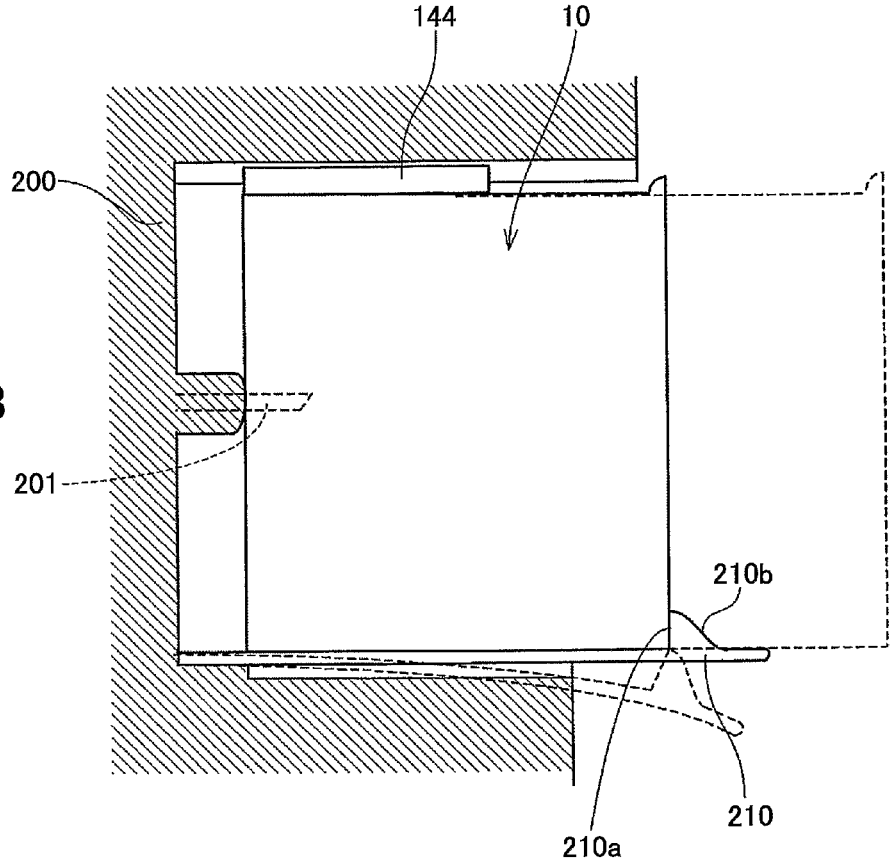
FIG. 18 is a side view of the insertion slot and an ink cartridge in a state where the ink cartridge is to be fixed to the insertion slot.

Next, a structure of fixing the ink cartridge 10 to the insertion slot 200 of the main body 1 will be described with reference to FIG. 18. FIG. 18 is a side view of the insertion slot 200. As described, since the rack 202 is biased in an outward direction (a direction extracting the ink cartridge 10) by the compression spring 203, when the ink cartridge 10 is inserted into the insertion slot 200, the biasing force of the compression spring 203 affects the ink cartridge 10 and the ink cartridge 10 is pushed outward.

As described in FIG. 18, a locking member 210 is provided to engage the ink cartridge 10 in a bottom portion of the insertion slot 200. The locking member 210 may be made of a resin. The locking member 210 has an engagement portion 210*a* engaged with the ink cartridge 10 and a slope portion 210*b* protruding toward a front surface of the main body 1.

When the ink cartridge 10 is inserted into the insertion slot 200, the slope portion 210*b* of the locking member 210 functions as a cam. The slope portion 210*b* and the locking member 210 are pushed down by the ink cartridge 10. After attaching the ink cartridge 10 to the insertion slot 200, the engagement portion 210*a* engages a back surface of the ink cartridge 10 to prevent the ink cartridge 10 from jumping out.

Further, when the ink cartridge 10 is taken out of the insertion slot 200, the locking member 210 is pushed down as shown by a broken line in FIG. 18. Then, the ink cartridge 10 automatically jumps out by a predetermined distance due to the compression spring 203. Therefore, the ink cartridge 10 can be easily taken out.

The 126 is directed toward the opening 104 of the cartridge casing 103 when the ink cartridge 10 is inserted into the main body 1 and faces the inner wall surface of the cartridge casing 103 when the ink cartridge 10 is extracted from the 1. Thus, the ink supplying portion (moving unit) 125 is drawn inside the cartridge casing 103 when the ink cartridge 10 is not attached to the main body 1. Therefore, the ink cartridge 10 can be easily handled and the likelihood of causing an erroneous discharge of a droplet is lowered.

When a nozzle insertion member such as the hollow needle 201 is inserted into the ink supplying portion (moving unit) 125, the 126 faces the nozzle insertion member. When the nozzle insertion member is withdrawn, the 126 is moved to face the shield 103*ba*. Therefore, the ink supplying portion (moving unit) 125 is drawn inside the cartridge casing 103 when the ink cartridge 10 is not attached to the main body 1. Therefore, the ink cartridge 10 can be easily handled and the likelihood of causing an erroneous discharge of a droplet is lowered.

By configuring to attach and detach the ink cartridge 10 to and from the main body 1, handling during exchange work of the ink cartridge is improved and the likelihood of causing an erroneous discharge of a droplet by intrusion of extraneous mattes from the ink supplying portion to an inside of the main body 1 is lowered.

Embodiment 2

Figure 19:
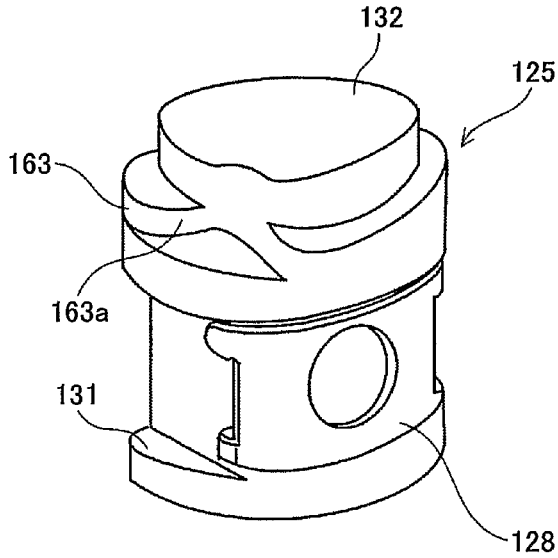
FIG. 19 is a perspective view of an ink supplying portion of an ink cartridge.
Figure 20:
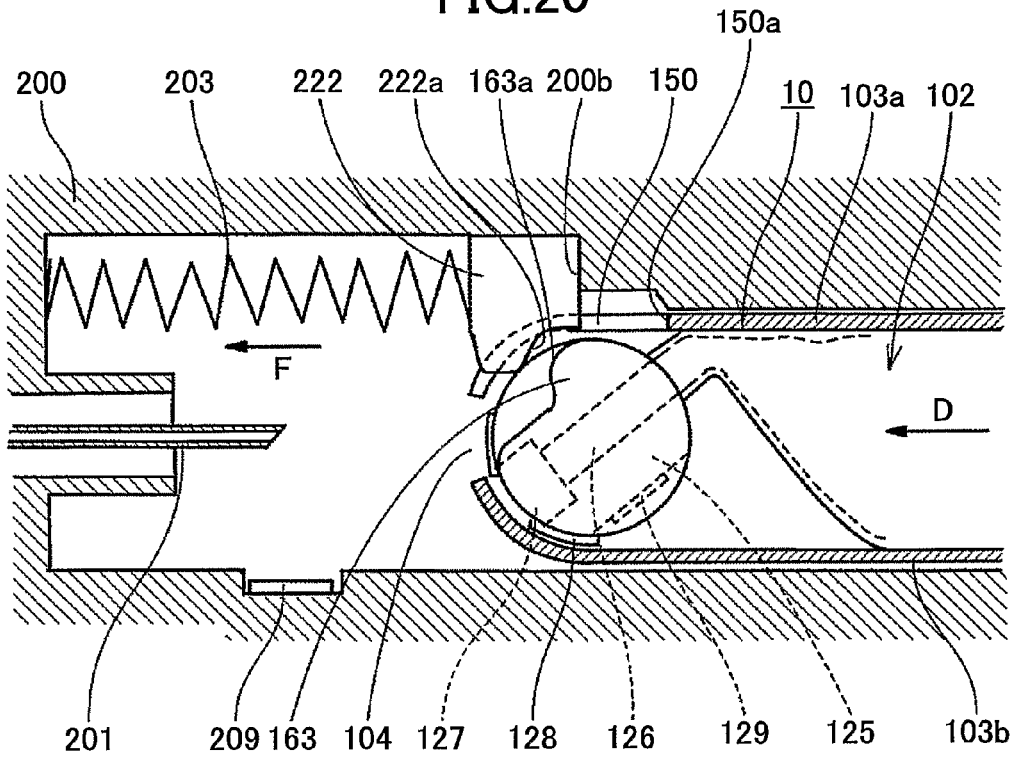
FIG. 20 is a cross-sectional plan view of an ink cartridge and an insertion slot immediately before a state where a cam member and a slider cam are in contact.
Figure 21:
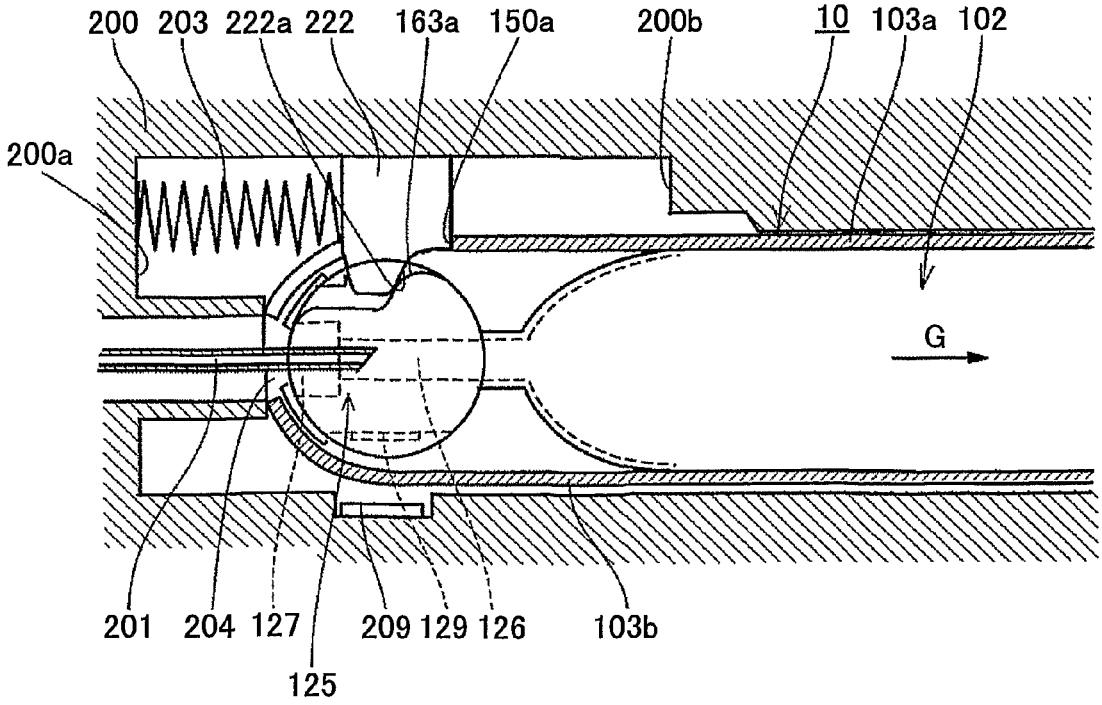
FIG. 21 is a cross-sectional plan view of the ink cartridge and the insertion slot when the ink cartridge is completely attached to the insertion slot.

An ink cartridge and an imaging apparatus of Embodiment 2 according to the present invention will be described with reference to FIGS. 19 through 21. FIG. 19 is a perspective view of an ink supplying portion of an ink cartridge. FIG. 20 is a cross-sectional plan view of an ink cartridge and an insertion slot immediately before a cam member and a slider cam are in contact. FIG. 21 is a cross-sectional plan view of the ink cartridge and the insertion slot when the ink cartridge is completely attached to the insertion slot.

Instead of the pinion 133 as a rotating or moving unit in Embodiment 1, a cam (moving unit) 163 having a cam lobe 163*a* is integrally formed with an ink supplying portion (moving unit) 125 as shown in FIG. 19. The other structures are similar to Embodiment 1.

As in an insertion slot 200 of a main body 1 shown in FIGS. 20 and 21, a slider cam 222 having a counter cam face 222*a* in contact with the 163*a* of the cam (moving unit) 163 is provided so as to be biased by a compression spring 203 in a direction of extracting an ink cartridge 10 and movable in a manner similar to the rack 202 of Embodiment 1. The other structures are similar to Embodiment 1.

When the ink cartridge 10 is inserted into the insertion slot 200 in a direction of an arrow D for attaching the ink cartridge 10 as shown in FIG. 20, the 163*a* of the cam (moving unit) 163 is in contact with the counter cam face 222*a* of the slider cam 222.

As described in Embodiment 1, the slider cam 222 does not move by a biasing force of a compression spring 203, an ink supplying portion (moving unit) 125 starts to rotate in a direction of an arrow E along the ink cartridge 10 is inserted in the direction of the arrow D, and when the slider cam 222 is in contact with a back end 150*a*, the ink supplying portion (moving unit) 125 stops rotating. Then, a sealing part 127 of an ink supplying portion (moving unit) 125 faces an opening 104 of the cartridge casing 103 and a hollow needle 201 of a main body 1.

Further, the ink cartridge 10 is inserted into the direction of the arrow D for setting the ink cartridge 10, the slider cam 222 moves along with the ink cartridge 10 in a direction of arrow F against the biasing force of the compression spring 203 because the rack 202 is in contact with the back end 150*a* of the ink cartridge 10. While maintaining a positional relationship between the 126 of the ink supplying portion (moving unit) 125 and the hollow needle 201 of the ink cartridge 10, the ink cartridge 10 is inserted into the insertion slot 200.

As shown in FIG. 20, a hollow needle 201 of the main body 1 penetrates the sealing part 127 to reach the 126 filled with ink and connected to a bag portion 121. Thus, it becomes possible to supply the ink from the ink cartridge 10 to the main body 1.

When the ink cartridge 10 is taken out of the main body 1, by ejecting the ink cartridge 10 in a direction of an arrow G shown in FIG. 21, the hollow needle 201 is withdrawn from the sealing part 127, and the slider cam 222 maintains contact with the back end 150*a* of the ink cartridge 10 by the biasing force of the compression spring 203 and moves along with the ejection of the ink cartridge 10. Then the slider cam 222 is in contact with a stopper 200*b*.

By ejecting the ink cartridge 10 in the direction of the arrow G while the counter cam face 222*a* and the cam (moving unit) 163 are engaged, the ink supplying portion (moving unit) 125 of the ink cartridge 10 is rotated in a direction reverse to the direction of attaching the ink supplying portion (moving unit) 125. Therefore, the ink supplying portion (moving unit) 125 is maintained to be drawn inside the cartridge casing 103 and to be shielded from the outside by a shield 103*ba*. Thereafter, the ink cartridge 10 is ejected from the cartridge mount portion 4.

As such, functions and effects similar to those in Embodiment 1 are obtainable.

Embodiment 3

Figure 22:
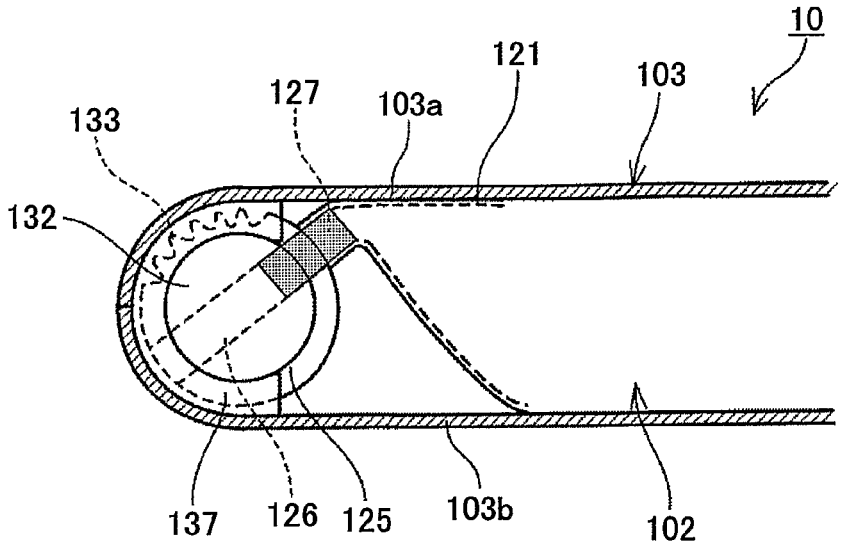
FIG. 22 is a cross-sectional plan view of a part of an ink cartridge of Embodiment 3.

An ink cartridge of Embodiment 3 according to the present invention will be described with reference to FIG. 22. FIG. 22 is a cross-sectional plan view of a part of an ink cartridge 10. A sealing part 127 pierced by a hollow needle 201 is pressed into a 126 at around a position connecting the 126 to a bag portion 121. The 126 does not constitute a part of an ink supplying path since the hollow needle 201 directly suctions an ink.

It is possible to surely prevent extraneous matter from adhering to the sealing part 127 and ink adhered to the sealing part 127 when the hollow needle 201 is withdrawn from splattering onto the other parts.

Embodiment 4

Figure 23:
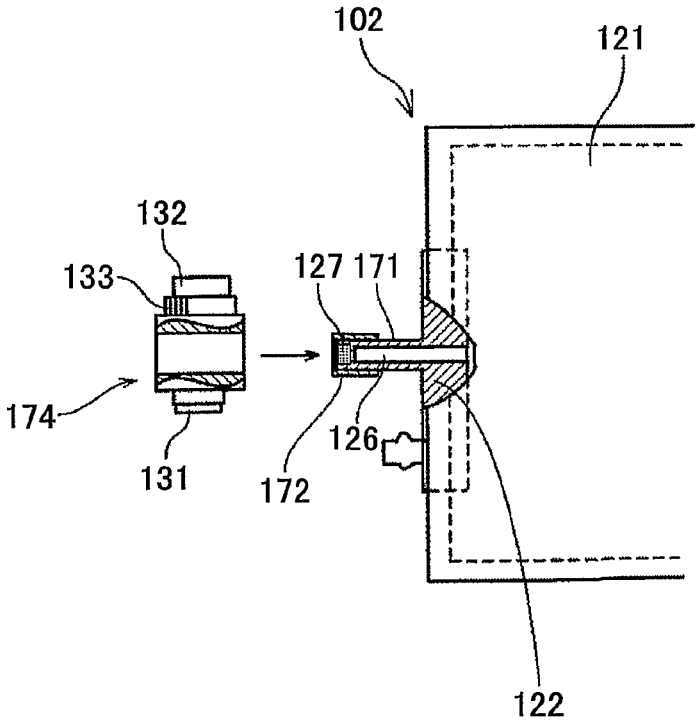
FIG. 23 is an exploded view of a part of an ink bag of an ink cartridge of Embodiment 4.
Figure 24:
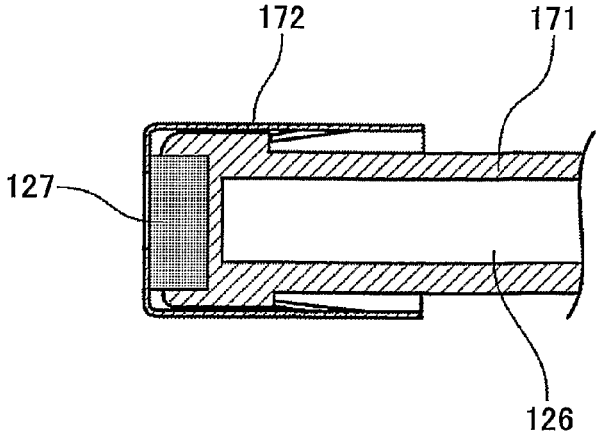
FIG. 24 is an enlarged view of a boss portion of the ink bag shown in FIG. 23.

An ink cartridge of Embodiment 4 according to the present invention will be described with reference to FIGS. 23 and 24. FIG. 23 is an exploded view of a part of an ink bag of an ink cartridge. FIG. 24 is an enlarged view of a boss portion of the ink bag. A boss section 171 having a 126 is formed in a connecting member 122 of an ink bag (ink accommodating unit) 102. A sealing part 127 is pressed into the boss section 171 and held by a cap 172 engaged with an outer periphery of the boss section 171. An ink supplying portion is configured by the boss section 171 and a rotating member 174 which includes a flange 131, a spindle 132 and a pinion 133 like the moving unit in Embodiment 1 fixed to the outer peripheral surface of the boss section 171.

Embodiment 5

Figure 25:
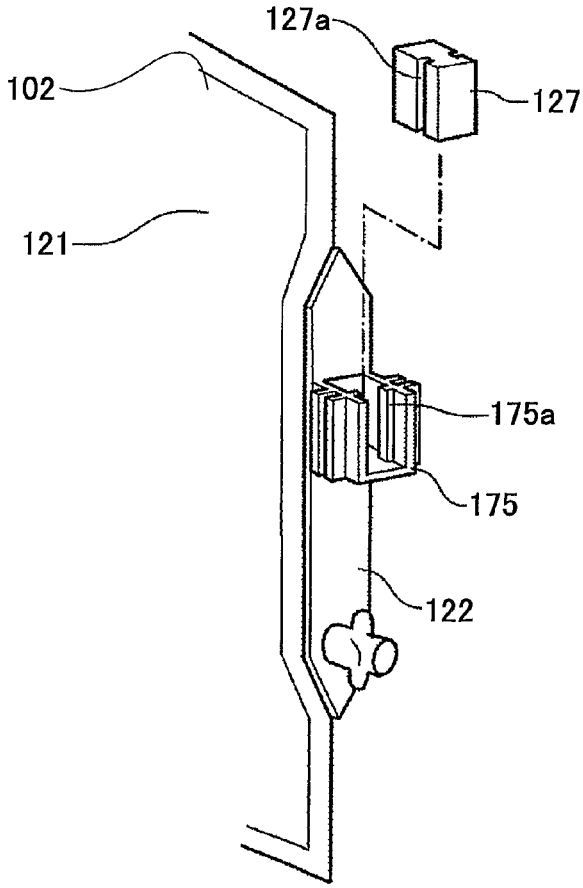
FIG. 25 is a cross-sectional view of an ink bag of an ink cartridge of Embodiment 5.

An ink cartridge of Embodiment 5 according to the present invention will be described with reference to FIG. 25. FIG. 25 is a cross-sectional view of an ink bag of an ink cartridge. A sealing member receiving part 175 for embedding a sealing part 127 in a connecting member 122 of an ink bag (ink accommodating unit) 102 along a direction perpendicular to an ink supplying direction is formed. An ink supplying portion is configured to engage a rotating member as a moving unit (not shown) with the sealing member receiving part 175.

The sealing part 127 is formed substantially like a rectangular solid and has grooves 127*a* on respective side surfaces. A sealing member receiving part 175 has limbs respectively engaged with the grooves 127*a*.

By this engagement, it is possible to surely prevent the sealing member receiving part 175 from dropping off during piercing and withdrawing a hollow needle 201. Further, a member holding the sealing part 127 around an opening 104 of a 126 is unnecessary not like Embodiments 1, 2 and 4. Therefore, a structure becomes easy. By attaching the sealing part 127 adjacent to a sealing member receiving part 175 as in Embodiment 3, it is possible to more surely prevent extraneous matters and so on from attaching to the sealing part 127 and an ink from adhering to the sealing part 127.

Embodiment 6

Figure 26:
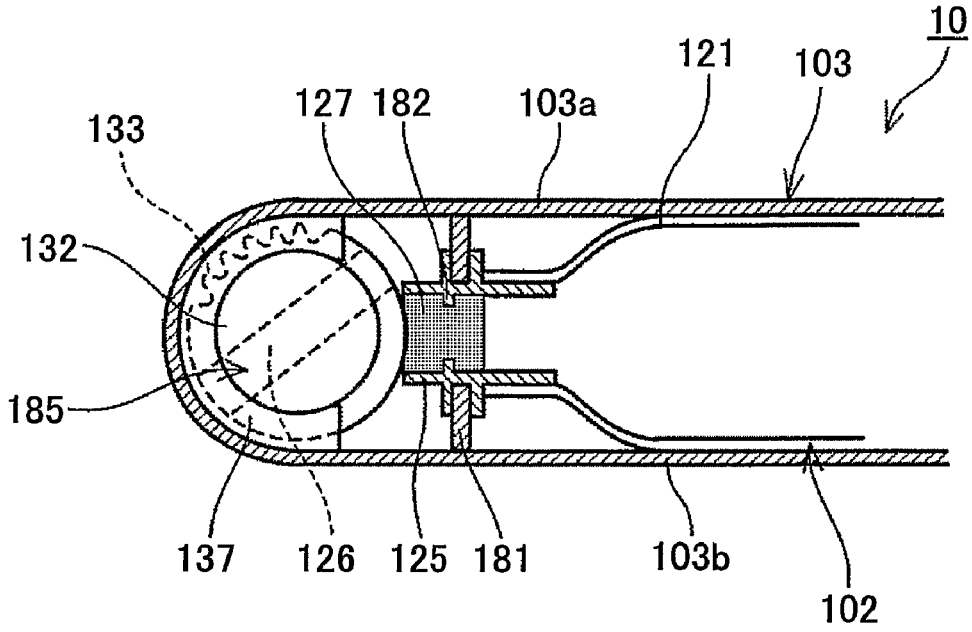
FIG. 26 is a cross-sectional plan view of a part of an ink cartridge of Embodiment 6.

An ink cartridge of Embodiment 6 according to the present invention will be described with reference to FIG. 26. FIG. 26 is a cross-sectional plan view of a part of an ink cartridge 10. An ink supplying portion (moving unit) 125 of an ink bag (ink accommodating unit) 102 is engaged with an engaging rib 181 *s* formed in respective cartridge casings 103*a* and 103*b*. A sealing part 127 is secured by engaging ribs 182 inside the ink supplying portion (moving unit) 125.

A rotating member 185 as a moving unit having a 126 penetrated by a hollow needle 201 is held by a cartridge casing 103 so that the rotating member 185 is rotatable. The rotating member 185 is an independent member integrally forming a flange 131, a spindle 132 and a pinion 133 in a manner similar to Embodiment 4 and similar to an ink supplying portion (moving unit) 125 of Embodiment 1. The 126 rotates between a position opposite to an opening 104 of a cartridge casing 103 and a position opposite to a shield 103*ba* of the cartridge casing 103.

The sealing part 127 of the ink supplying portion (moving unit) 125 is pressed by an outer peripheral surface of the rotating member 185. When the ink cartridge 10 is attached to the main body 1, the rotating member 185 is rotated, the sealing part 127 slides on the outer peripheral surface of the rotating member 185, and the 126 of the rotating member 185 is directed toward the sealing part 127. Therefore, the hollow needle 201 on a side of the main body 1 can pierce the sealing part 127 via the 126.

When the ink cartridge 10 is detached from the main body 1, the rotating member 185 returns to the position shown in FIGS. 26 and 126 of the rotating member 185 does not face the sealing part 127. As such, functions and effects similar to Embodiment 1 are obtainable.

In Embodiment 6, because the ink supplying portion (moving unit) 125 does not rotate nor move, an ink can be packed not only in a bag like an ink bag (ink accommodating unit) 102 but also a nonflexible material such as a resin and a metal.

Embodiment 7

Figure 27:
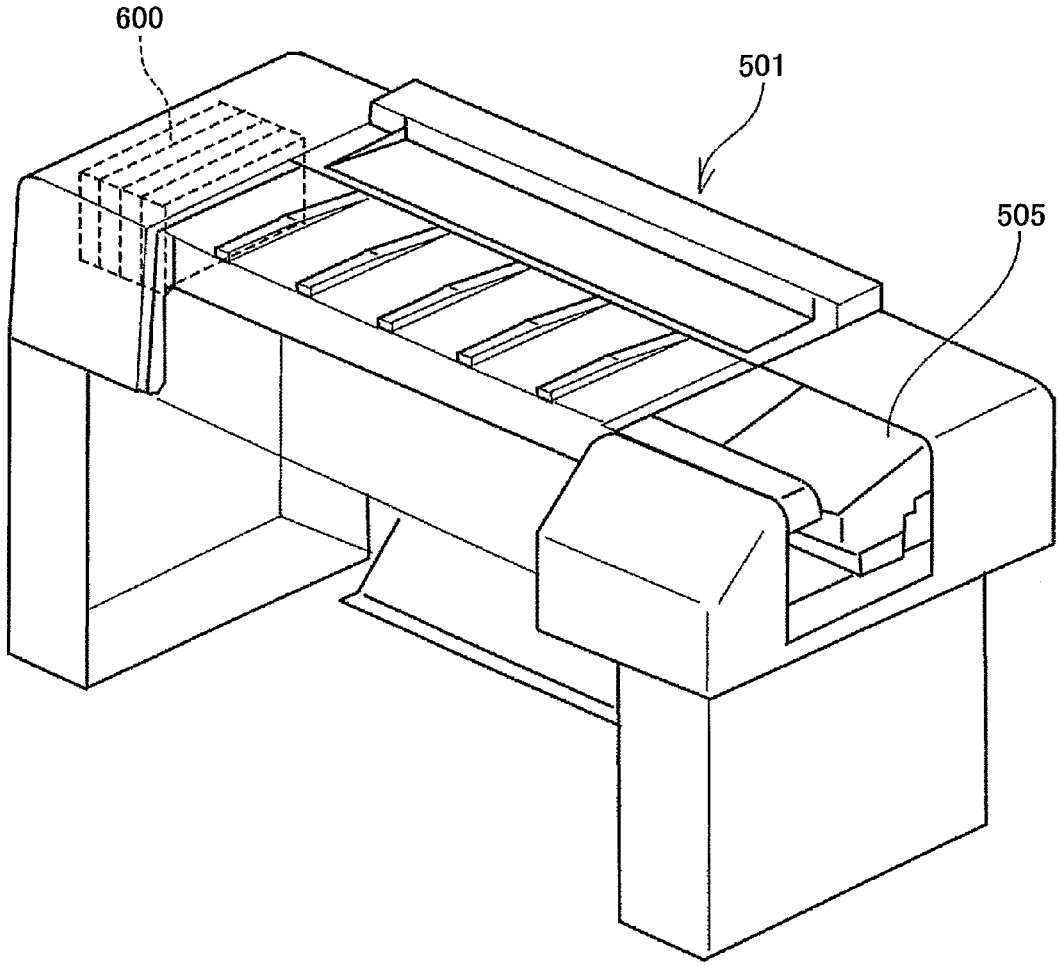
FIG. 27 is a perspective view of an inkjet recording apparatus of Embodiment 7 according to the present invention.
Figure 28:
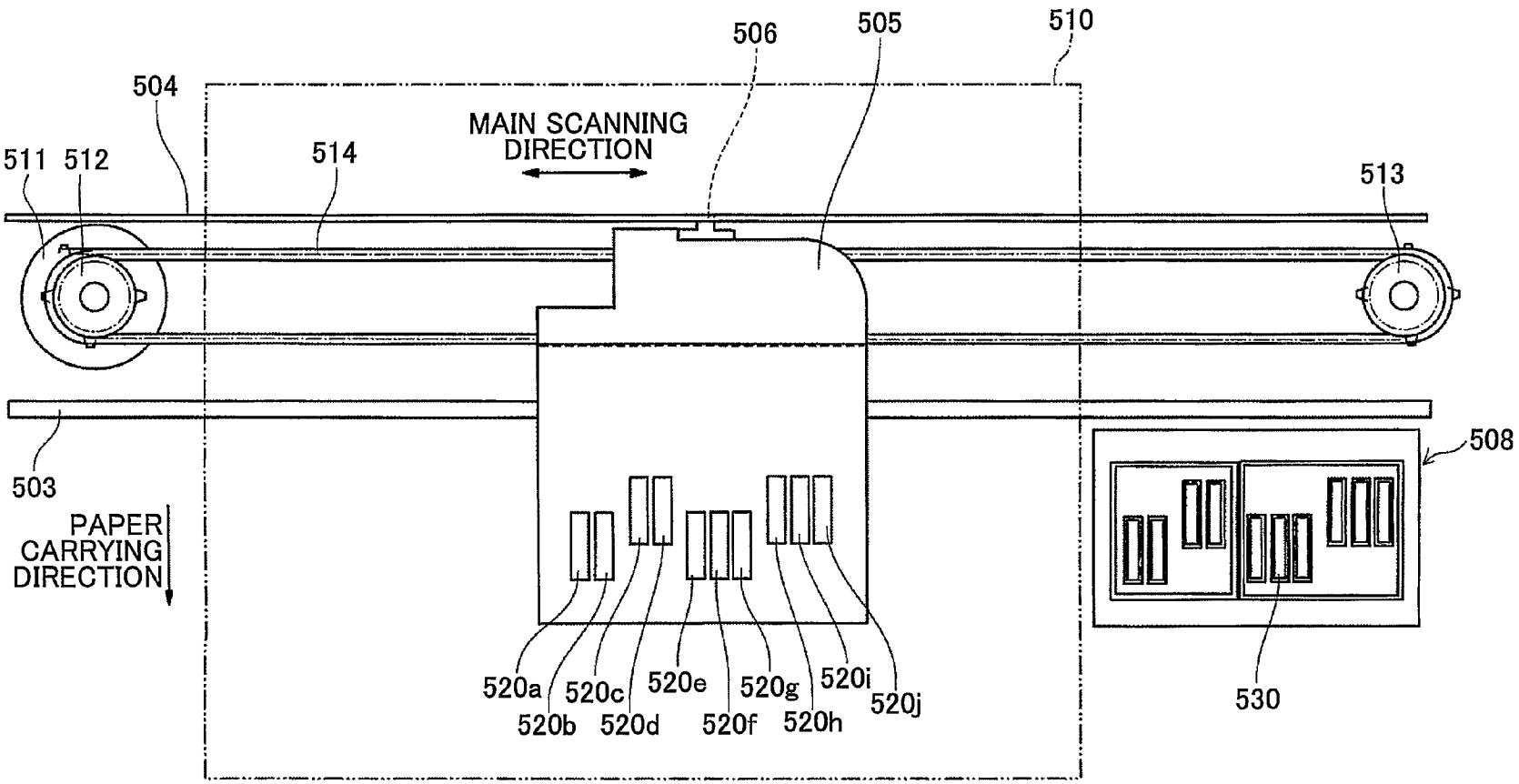
FIG. 28 is a schematic plan view of a printing mechanism of the inkjet recording apparatus.
Figure 29:
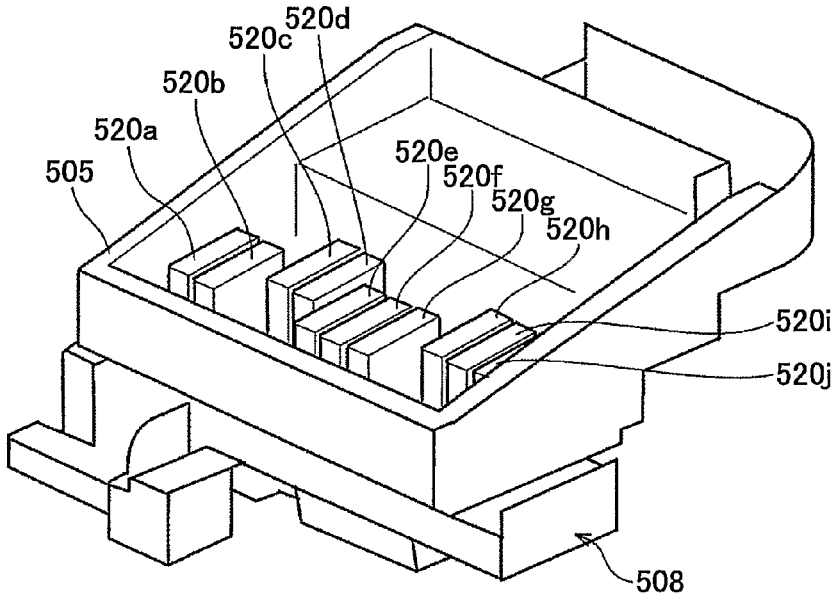
FIG. 29 is a perspective view of a carriage and a maintaining and recovering unit of the inkjet recording apparatus.

A description will now be given, with reference to FIGS. 27 through 43 of embodiments of an ink cartridge and an imaging apparatus of the present invention. An example of an inkjet recording apparatus of Embodiment 7 will be described in reference of FIGS. 27 through 29. FIG. 27 is a perspective view of the inkjet recording apparatus. FIG. 28 is a schematic plan view of a printing mechanism of the inkjet recording apparatus. FIG. 29 is a perspective view of a carriage and a maintaining and recovering unit of the inkjet recording apparatus.

The inkjet recording apparatus is a serial type inkjet recording apparatus. Referring to FIG. 28, a guide rod 503 and a guide rail 504 respectively bridge side plates (not shown), and a carriage 505 is held by the guide rod 503 and the guide rail 504 so as to slide in a main scanning direction. A sub guide roller 506 rotatably supported by an end portion of the carriage 505 is in contact with the guide rail 504.

A main scanning mechanism includes a driving motor 511, a driving pulley 512 driven by the driving motor 511, a driven pulley 513 arranged on a side opposite to the main scanning direction, and a timing belt (a belt) 514 transmitting a driving force from the driving motor 511 to the driving pulley 512. The driven pulley 513 is applied with a tension in a direction away from the driving pulley 512.

Axes of the driving pulley 512 and the driven pulley 513 are directed along an ink droplet discharging direction. A part of the belt 514 bridged between the driving pulley 512 and the driven pulley 513 is fixed by a belt fixing part provided on a back side of the carriage 505. Therefore, the carriage 505 is enabled to move in the main scanning direction. A paper carrying (sub scanning) direction in FIG. 28 along the ink droplet discharging direction is perpendicular to the main scanning direction.

The carriage 505 includes ten recording heads 520*a* to 520*j* with buffer tanks (sub tanks), hereinafter collectively referred to as a recording head 520. The recording heads 520*a* through 520*j* respectively have liquid discharge nozzles for discharging an ink droplet of black (K), yellow (Y), magenta (M), or cyan (C), and arranged in a head space of the carriage 505 (not shown). Positions of the recording heads 520*a*, 520*b* and the recording heads 520*c*, 520*d* are deviated in the paper carrying direction to form a zigzag alignment. For example, the recording heads 520*a*, 520*b*, 520*c*, 520*d* can be used as heads discharging black ink droplets. Positions of the recording heads 520*e* through 520*g* and the recording heads 520*h* through 520*j* are deviated in the paper carrying direction to form a zigzag alignment. For example, the recording heads 520*e*, 520*h* can be used as a head discharging cyan ink droplets, the recording heads 520*f*, 520*i* can be used as a head discharging magenta ink droplets, the recording heads 520*g* and 520*j* can be used as a head discharging yellow ink droplets.

In a recording area along the main scanning direction of the carriage 505, a paper 510 is guided by a platen and intermittently fed in the paper carrying direction by a paper feeding mechanism (not shown). The platen faces the recording head 520 in at least the recording area along the main scanning direction of the carriage 505.

Referring to FIG. 29, a maintaining and recovering unit 508 for maintaining and recovering functions of the recording head 520 is arranged in an end part of the main scanning direction. The maintaining and recovering unit 508 has a cap 530 sealing (capping) nozzle surfaces of the recording heads 520*a* to 520*j*, a wiper member wiping the nozzle surfaces (not shown), and so on.

As shown in FIG. 27, an ink cartridge 600 accommodating various color inks to be supplied to the recording head 520 can be attached to and detached from the main body 501.

While the inkjet recording apparatus moves the carriage 505 in the main scanning direction and intermittently feeds the paper 510 in the paper carrying direction, the recording head 520 is driven to discharge droplets depending on image information to thereby form a predetermined image on the paper 510.

Figure 30:
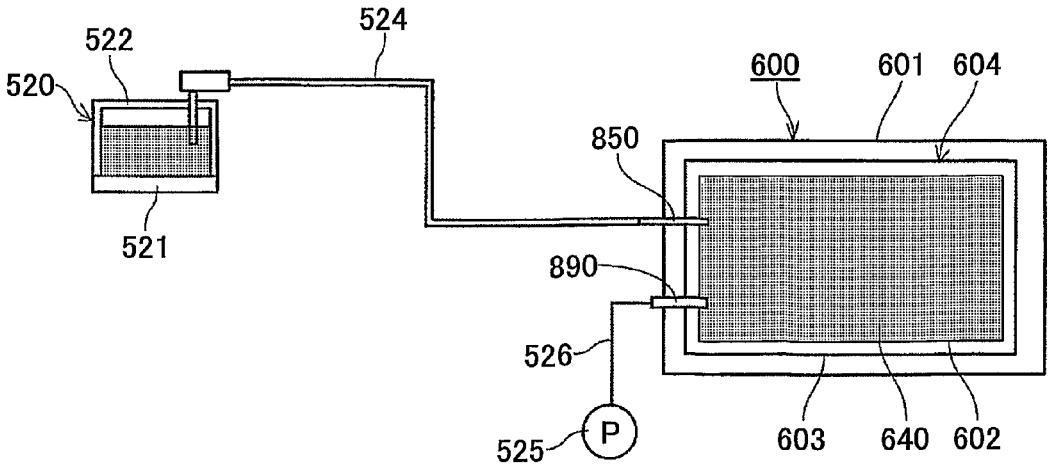
FIG. 30 is an ink supplying mechanism of the inkjet recording apparatus.

An ink supplying mechanism of the inkjet recording apparatus will be described with reference to FIG. 30. The recording head 520 includes a head portion 521, a buffer tank 522 (sub tank) supplying the ink to the head portion 521. An ink cartridge 600 is an exchangeable main tank. Ink is supplied to the buffer tank 522 via a tube 524 depending on ink consumption.

The ink cartridge 600 includes a cartridge casing 601, an ink bag 602, and an 603. The ink bag 602 accommodates an ink 640 as an inner bag. The 603 is configured to hermetically pack the ink bag 602 and introduces a gas (e.g. air) in a space between an inner wall of the 603 and an outer wall of the ink bag 602 to pressurize the ink bag 602. The ink bag 602 and the 603 form a dual bag 604. When an air is introduced between the 603 and the ink bag 602 by a 525, the ink 640 in the ink bag 602 pressurized by the air is supplied to the recording head 520. A tube 524 is connected to the ink bag 602 by a hollow needle 850 (see FIG. 37). The 525 is attachable to or detachable from the 603 via an air nozzle member 890.

Figure 31:
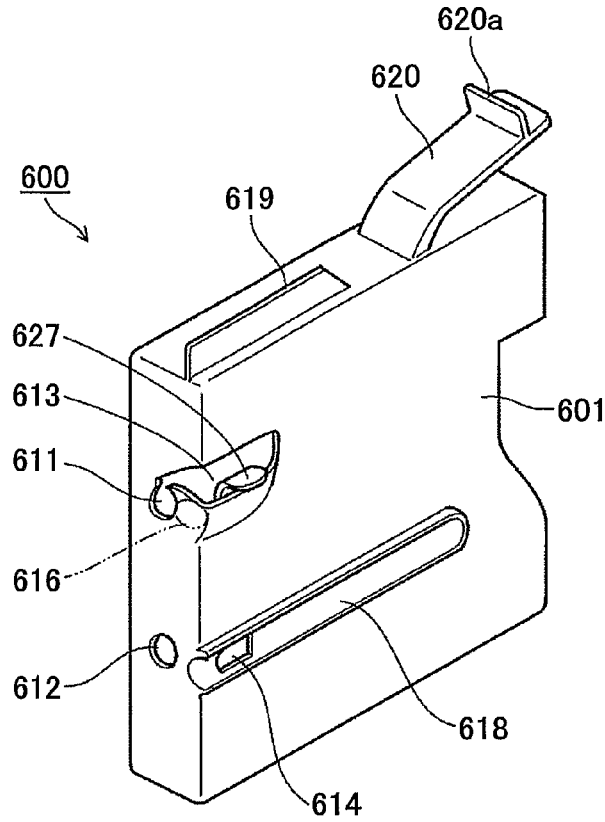
FIG. 31 is a perspective view of an ink cartridge of Embodiment 7.
Figure 32:
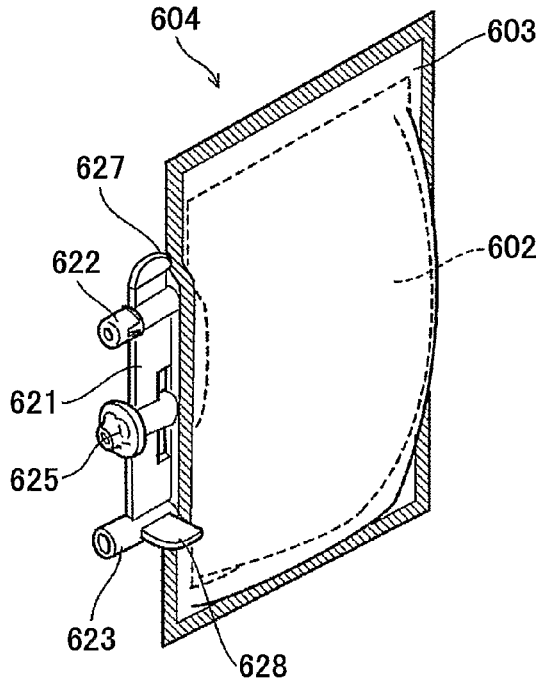
FIG. 32 is a perspective view of an ink tank of the ink cartridge.
Figure 33:
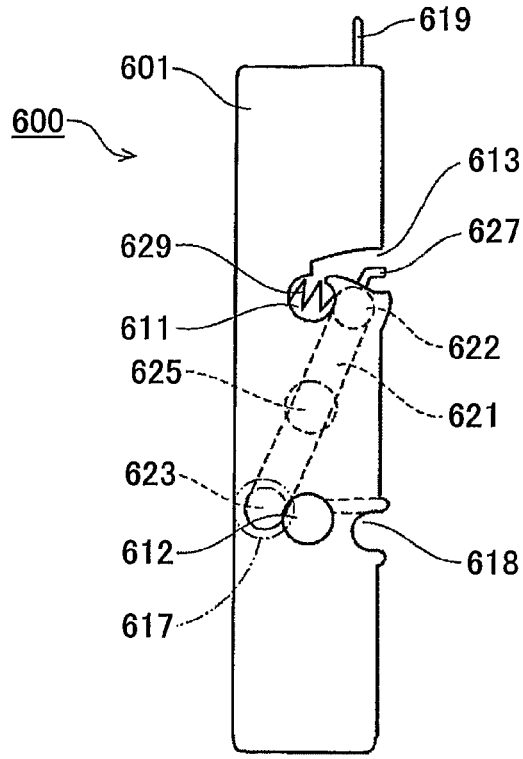
FIG. 33 is a front view of the ink cartridge.
Figure 34:
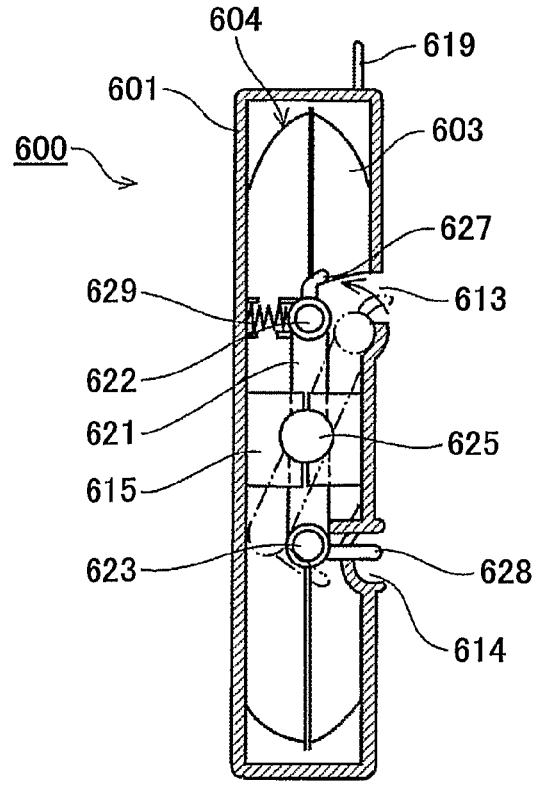
FIG. 34 is a cross-sectional front view of the ink cartridge.
Figure 35:
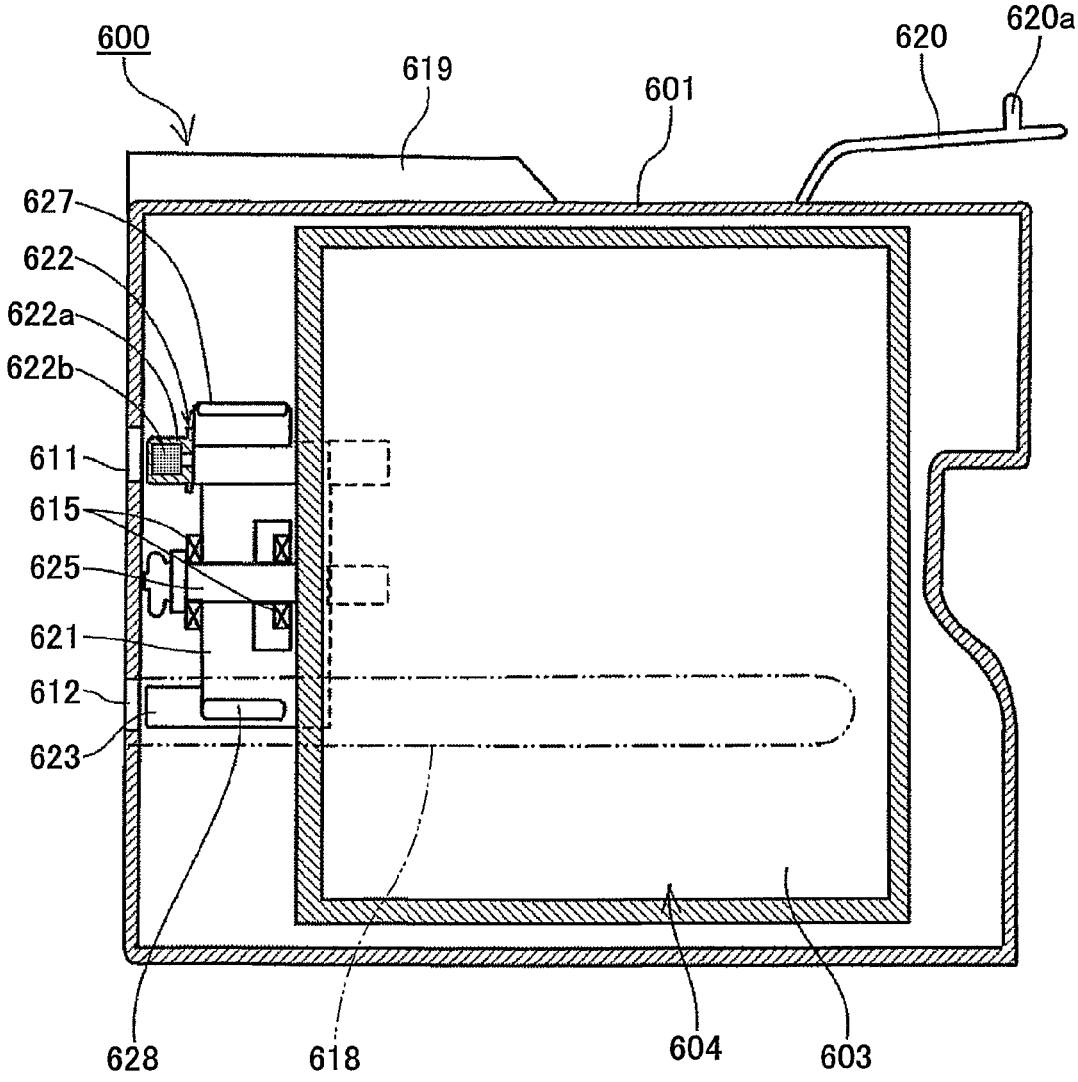
FIG. 35 is a cross-sectional side view of the ink cartridge.

An ink cartridge 600 will be described in detail with reference to FIGS. 31 through 35. FIG. 31 is a perspective view of the ink cartridge. FIG. 32 is a perspective view of an ink tank. FIG. 33 is a front view of the ink cartridge. FIG. 34 is a cross-sectional front view of the ink cartridge. FIG. 35 is a cross-sectional side view of the ink cartridge.

A front surface of the cartridge casing 601 faces the main body 501 when the ink cartridge 600 is inserted into the main body 501. A back surface is an opposite side of the front surface. An 611 penetrated by a hollow needle 850 and an opening 612 penetrated by an air nozzle member 890 are formed on the front surface of the cartridge casing 601.

The ink bag 602 is hermetically closed, and shaped like a bag. A material of the ink bag 602 is preferably a film material having flexibility. The material is any one of a film material made from a resin or a layer structure composed of a plurality of resins. A surface of the material may have a metal thin layer or an intermediate layer of the material may have a metal thin layer. A resin composition of the material is preferably an olefin system, particularly a polyethylene film is preferable because of its wetted characteristics. The metal thin layer preferably suppresses humidity of the film and maintain rigidity of the film. For example, an aluminum thin film is particularly preferable.

A rotating member (moving unit) 621 as a moving unit is attached to a front surface side of the dual bag 604 by, for a example, adhesion, bonding or welding. An ink supplying port 622 through which the hollow needle 850 is inserted is connected to the ink bag 602 on an end portion of the rotating member (moving unit) 621, and the ink inside the ink bag 602 is supplied to the main body 501 via the ink supplying port 622 and the hollow needle 850. The ink supplying port 622 has a supply path 622*a* and an elastic member 622*b* pierced by the hollow needle 850. A nozzle connector 623 is provided to inject air to an area between the ink bag 602 and the 603 at an position opposite to the ink supplying port 622 in the rotating member (moving unit) 621. The nozzle connector 623 is connected to the air nozzle member 890. A shaded part of the dual bag 604 in FIG. 35 is adhered, bonded or welded.

The bag portion 121 further includes an ink supplying portion 625 used at a time of filling the ink inside the ink bag 602 and adhered, bonded or welded after the filling. The rotating member (moving unit) 621 is supported by bearings 615, 615 provided in the cartridge casing 601 so as to be rotatably supported. A direction along this rotational axis of the rotating member (moving unit) 621 is substantially the same as an inserting direction of the hollow needle 850. Therefore, when the hollow needle 850 is inserted to some extent, there is no dimensional change viewed from an inserting direction. Therefore, it is possible to suppress a dimensional variation. Therefore, even if the elastic member 622*b* of the ink supplying port 622 is repeatedly pierced by the hollow needle 850, it is possible to diminish the pierced hole from deforming.

The rotating member (moving unit) 621 includes a pushed portion 627 on a side of the ink supplying port 622 and a protrusion (starting unit) 628 on a side of a nozzle connector 623. The pushed portion (starting unit) 627 and the protrusion (starting unit) 628 are integrally formed with the rotating member (moving unit) 621. The elastic part 629 is interposed between a side of the ink supplying port 622 and an inner wall surface of the cartridge casing 601. The pushed portion (starting unit) 627 protrudes from an opening 613 of the cartridge casing 601 by the elastic part 629. The protrusion (starting unit) 628 is biased by the elastic part 629 so as to be drawn inside the cartridge casing 601.

The pushed portion (starting unit) 627 of the rotating member (moving unit) 621 is pushed by a pushing part of the main body 501 when the ink cartridge 600 is attached to the main body 501 as described later. Referring to FIG. 34, the pushed portion (starting unit) 627 is pushed from a position of a broken line in a direction of an arrow to a position of a solid line and moved in the direction of the arrow. Further, the pushed portion (starting unit) 627 is not pushed by the pushing part of the main body 501, the rotating member (moving unit) 621 is maintained at the position of the broken line shown in FIG. 34 by the biasing force of the elastic part 629.

As such when the rotating member (moving unit) 621 rotates, the ink supplying port 622 is movable between an ink supplying position opposite to the 611 of the cartridge casing 601 for the hollow needle 850 and a shielding position opposite to the 616 shown in FIG. 31 and shielded from an outside. Meanwhile, the ink supplying portion 625 is movable between an ink injecting position (a connecting position) opposite to the 612 for the injecting nozzle of the cartridge casing 601 and a shielding position (a non-connecting position) opposite to the shielding part 617 formed by a part of the cartridge casing 601 as shown in FIG. 33.

Accordingly, when the cartridge casing 601 is not attached to the main body 501, the ink supplying port 622 is in the shielding position, the ink cartridge 600 which has been completely used or is on use is taken out of the main body 501, so that the ink cartridge 600 is prevented from being in contact with the ink supplying port 622. Therefore, handling of the cartridge casing 601 becomes improved and the likelihood of an erroneous discharge of a droplet caused by oil of the ink supplying port 622 is lowered.

Along with a movement of the ink supplying port 622 from the shielding position to the supplying position, the protrusion (starting unit) 628 moves to an operating position where the protrusion (starting unit) 628 protrudes from the cartridge casing 601. Then, the main body 501 is ready for supplying the ink by operating units contributing to the ink supply. Therefore, it is possible to prevent air from intruding into an ink supply route while the ink cartridge 600 is not attached. Thus, an erroneous discharge of ink droplets can be prevented.

The ink supplying port 622 and the protrusion (starting unit) 628 are positioned on opposite sides relative to the rotating axis of the rotating member (moving unit) 621. Therefore, the ink supplying port 622 and the protrusion (starting unit) 628 can be moved to predetermined positions with a relatively small rotating angle in comparison with a case where the ink supplying port 622 and the protrusion (starting unit) 628 are positioned on the same sides. Therefore, a stress of twisting the ink bag 602 by the rotating member (moving unit) 621 can be diminished, durability of connecting parts (adhered, bonded or welded parts) of the ink bag 602, the 603 and the rotating member (moving unit) 621 can be improved, and the width of the ink cartridge can be reduced.

A position detecting member to be described below detects that the protrusion (starting unit) 628 is attached where the protrusion (starting unit) 628 protrudes from the opening 614 by a malfunction of the moving unit (the rotating member (moving unit) 621). An escape hole 618 for enabling the position detecting member to escape is formed on an outer surface of the cartridge casing 601 along a direction of attaching the ink cartridge 600.

A color identification rib 619 corresponding to a color of an ink drawn inside the cartridge casing 601 and a handle 620 elastically deformable and having a locking tab 620*a* are provided in an upper portion of the cartridge casing 601.

Figure 36:
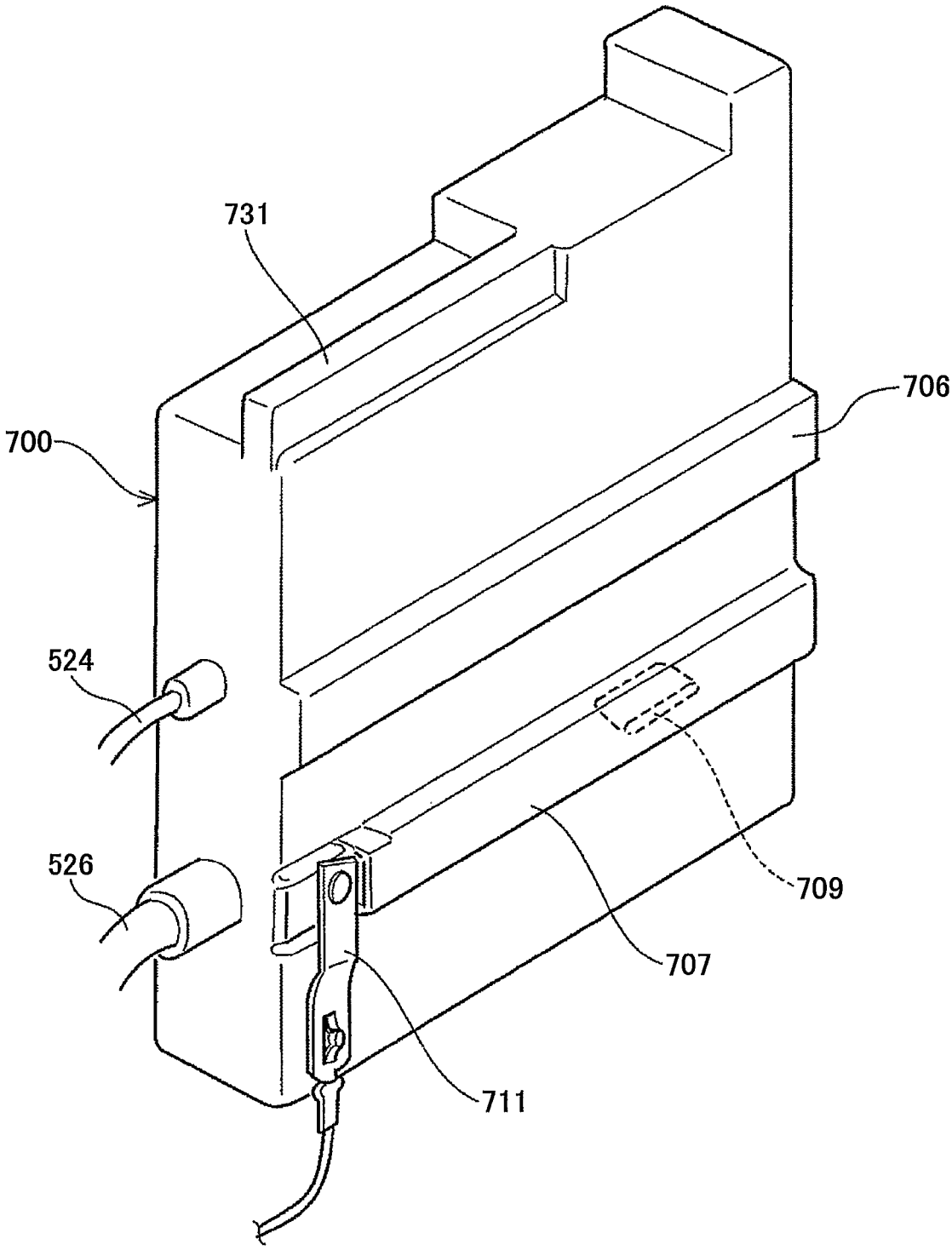
FIG. 36 is a perspective view of the insertion slot provided on a main body of the inkjet recording apparatus.
Figure 37:
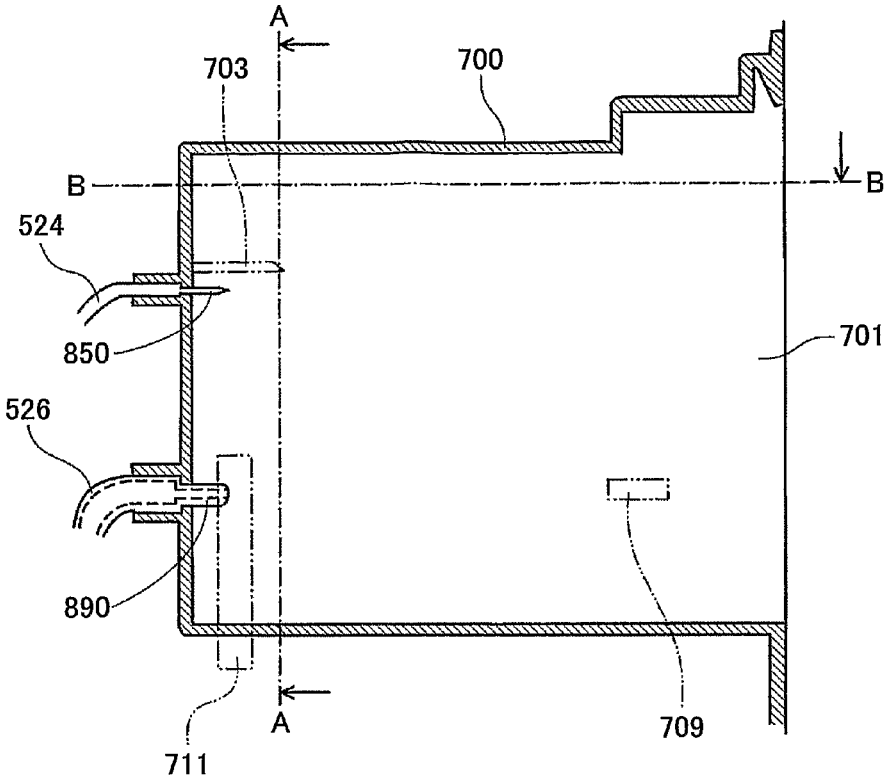
FIG. 37 is a cross-sectional side view of the insertion slot.
Figure 38:
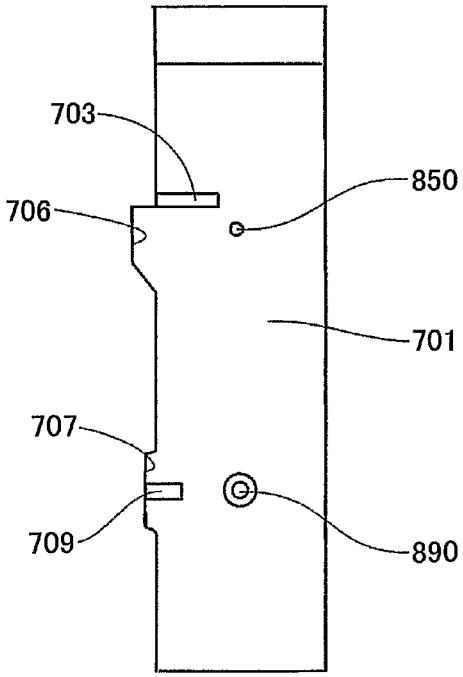
FIG. 38 is a front view of the insertion slot.
Figure 39:
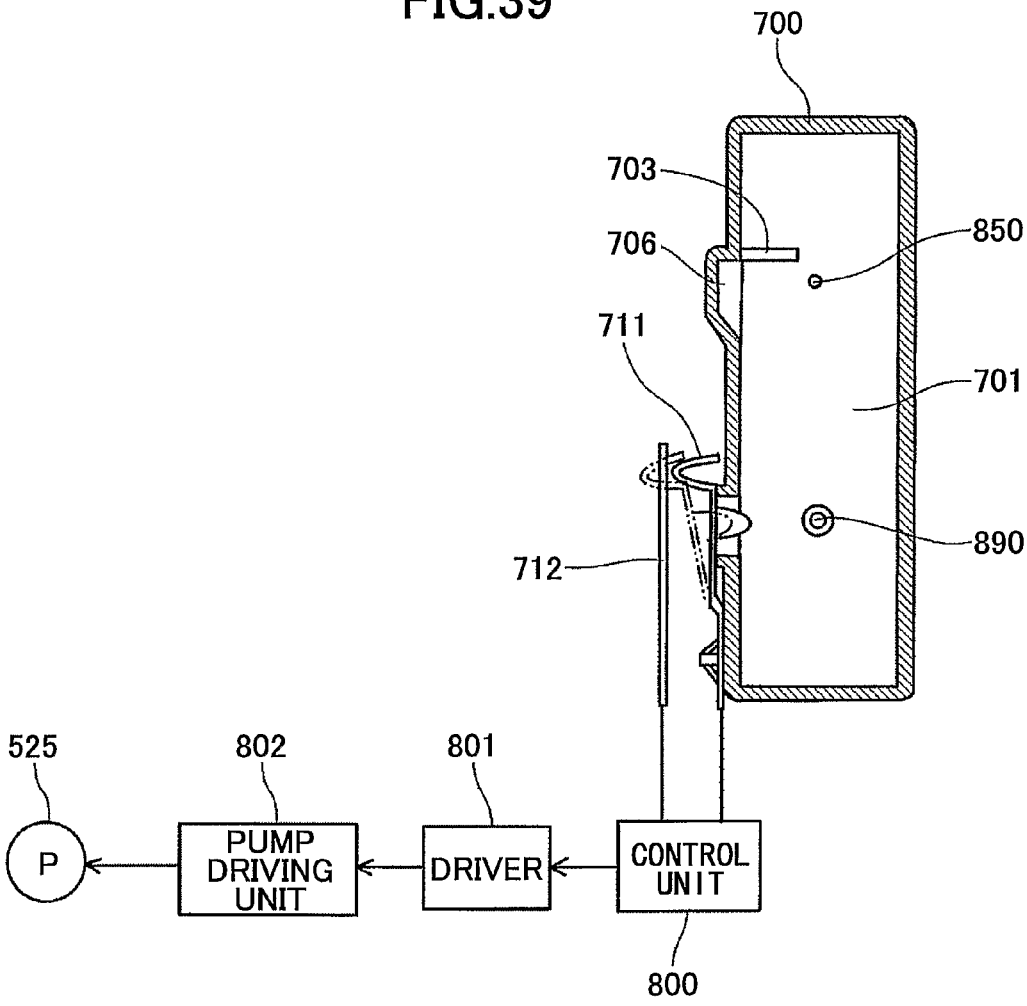
FIG. 39 is a cross-sectional front view taken along a line A-A of FIG. 37.
Figure 40:
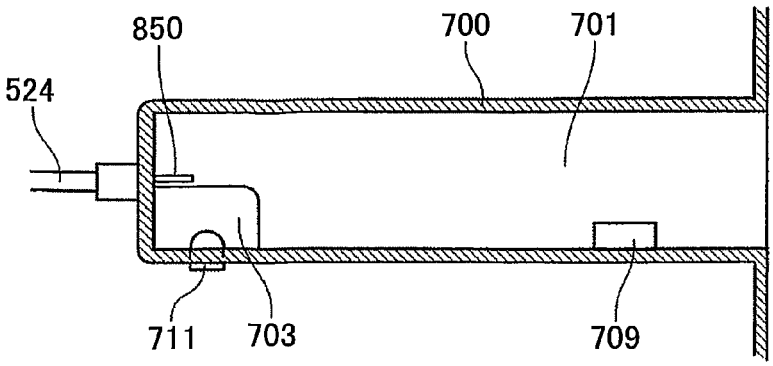
FIG. 40 is a cross-sectional plan view taken along a line B-B of FIG. 37.

Referring to FIGS. 36 through 40, an insertion slot 700 will be described. FIG. 36 is a perspective view of the insertion slot. FIG. 37 is a cross-sectional side view of the insertion slot. FIG. 38 is a front view of the insertion slot. FIG. 39 is a cross-sectional front view taken along a line A-A of FIG. 37. FIG. 40 is a cross-sectional plan view taken along a line B-B of FIG. 37. The insertion slot 200 on a side of the main body 501 has an opening 701 receiving the ink cartridge 600. The hollow needle 850 to which a tube 524 is connected and the air nozzle member 890 to which a tube 526 connected to a 525 is connected are embedded on a wall opposite to the opening 701.

A trigger 703 is formed on the inner wall opposite to the opening 701 to push the pushed portion (starting unit) 627 in a direction toward the cartridge casing 601 by an insertion operation of the ink cartridge 600 in contact with the pushed portion (starting unit) 627 when the ink cartridge 600 is attached On an inner wall of the opening 701, an escape groove 706 clearing the pushed portion (starting unit) 627 of the ink cartridge 600 and an escape groove 707 clearing an outer peripheral rib of an escape hole 618 are formed along a direction of inserting the ink cartridge 600 into the opening 701. In a middle of the escape groove 707, there in provided a position detecting part 709 in contact with the protrusion (starting unit) 628 when the ink cartridge 600 is inserted into the opening 701 while the protrusion (starting unit) 628 protrudes from the cartridge casing 601.

Referring to FIGS. 36 and 39, an interlocking contact 711 pushed by the protrusion (starting unit) 628 is provided in the vicinity of an end part of the escape groove 707. The interlocking contact 711 is pushed by the protrusion (starting unit) 628 toward an outside of the insertion slot 700 and in contact with a contact 712 to thereby enable the ink cartridge 600.

A control of the 525 will be described with reference to FIG. 39. When the interlocking contact 711 and the contact 712 do not make contact, a control unit 800 does not drive the 525. Therefore, air is not injected into the ink cartridge 600, and the ink is not supplied from the ink cartridge 600. When the interlocking contact 711 contacts the contact 712, the control unit 800 drives the 525 at a predetermined timing via a driver 801 and a pump driving unit 802. Therefore, air is injected into the ink cartridge 600 and the ink is supplied to the main body 501 from the ink cartridge 600.

Thus, the interlocking contact 711 starts an ink supplying operation. When the interlocking contact 711 is operated by the pushed portion (starting unit) 627, an ink supplying device or a 525 is released from a drive stopping state by an electrical signal and an ink supplying operation is enabled. For example, a magnet as an ink supplying unit is provided in the ink cartridge 600, and an ink supply operation is enabled when a magnetic force of the magnet is detected by, for example, a hole device.

A recess 731 corresponds to the handle 620. The position of the handle 620 in a direction perpendicular to the direction of inserting the ink cartridge 600 differs depending on colors of the ink cartridge 600.

Figure 41A:
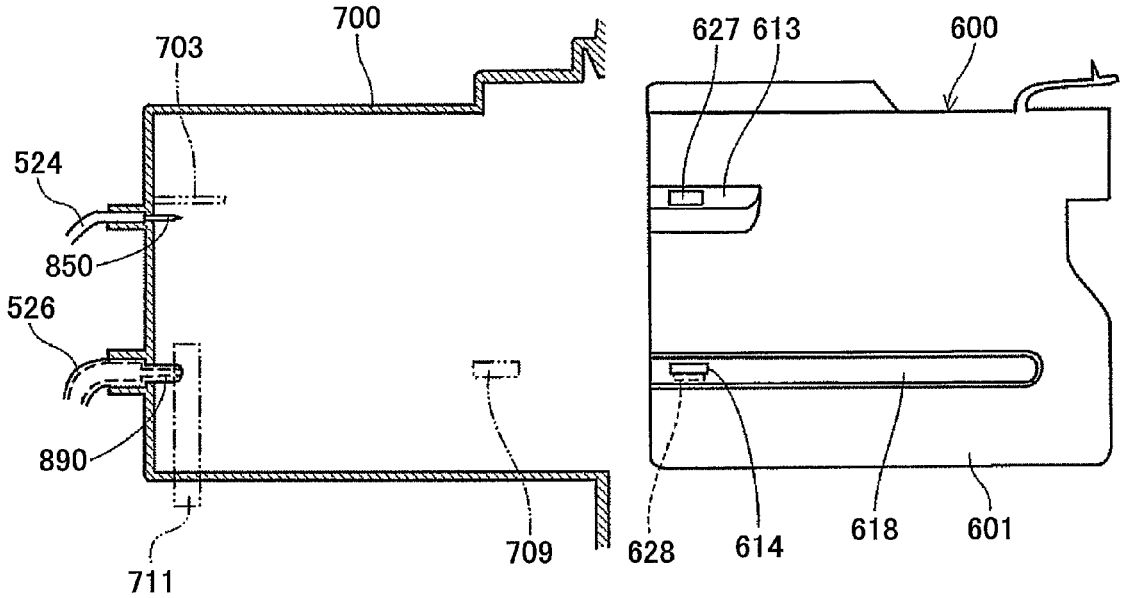
FIG. 41A is a schematic view of the ink cartridge and the insertion slot for explaining how the ink cartridge is inserted into the insertion slot.

An operation of attaching the ink cartridge 600 to the insertion slot 700 of the main body 501 will be described with reference to FIGS. 41A through 43. Referring to FIG. 41A, the interlocking contact 711 does not contact the contact 712 before attaching the ink cartridge 600 to the insertion slot 700, so the 525 is not driven by the control unit 800.

Figure 41B:
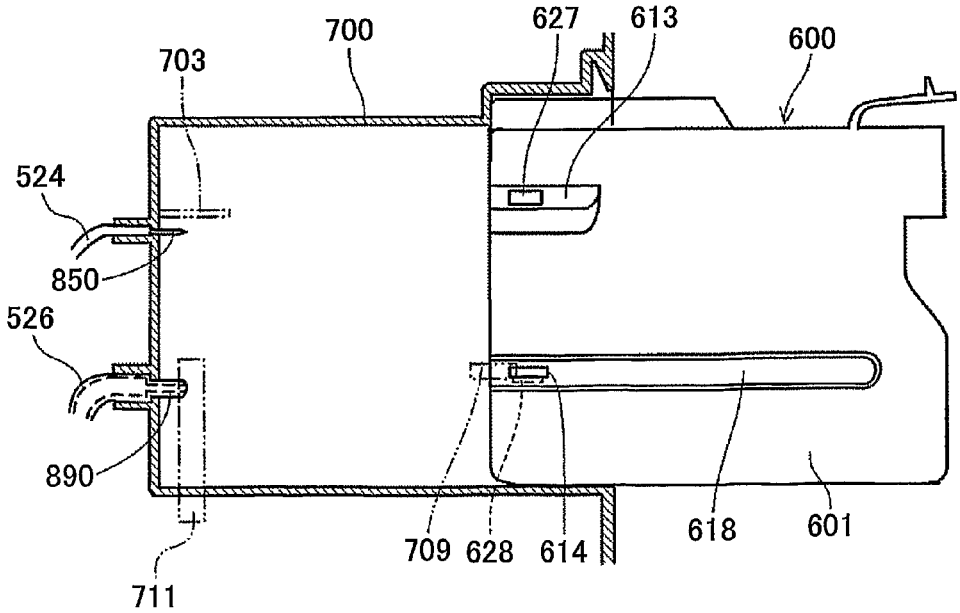
FIG. 41B is a schematic view of the ink cartridge and the insertion slot for explaining how the ink cartridge is inserted into the insertion slot.

Referring to FIG. 41B, when the ink cartridge 600 is inserted into the insertion slot 700 and the protrusion (starting unit) 628 passes through the position detecting part 709 of the insertion slot 700, if the ink cartridge 600 functions normally, the protrusion (starting unit) 628 is drawn inside the cartridge casing 601. Therefore, the protrusion (starting unit) 628 does not contact the position detecting part 709 and the ink cartridge 600 is directly inserted toward a back wall 700*a* of the insertion slot 700. On the contrary thereto, when the rotating member (moving unit) 621 does not normally function and the protrusion (starting unit) 628 protrudes from the cartridge casing 601, the protrusion (starting unit) 628 interferes with the position detecting part 709 and the ink cartridge 600 cannot be further inserted.

Said differently, when the rotating member (moving unit) 621 normally functions and the ink supplying port 622 is in a shielding position, the ink cartridge 600 is completely attached without the interference between the protrusion (starting unit) 628 and the position detecting part 709 on a side of the main body 501, and when the ink supplying port 622 is not in the shielding position due to, for example, a malfunction of the rotating member (moving unit) 621, the position detecting part 709 interferes with the protrusion (starting unit) 628 and the attachment is prevented.

As such, when a stoppage of ink supply operation is released or a unit contributing to the ink supply operation is functioning, the ink cartridge 600 possibly exposing the ink supplying port 622 outside is prevented and malfunctions such as an erroneous discharge of ink droplets caused by extraneous matter attached to the ink supplying port 622 can be prevented.

Figure 42A:
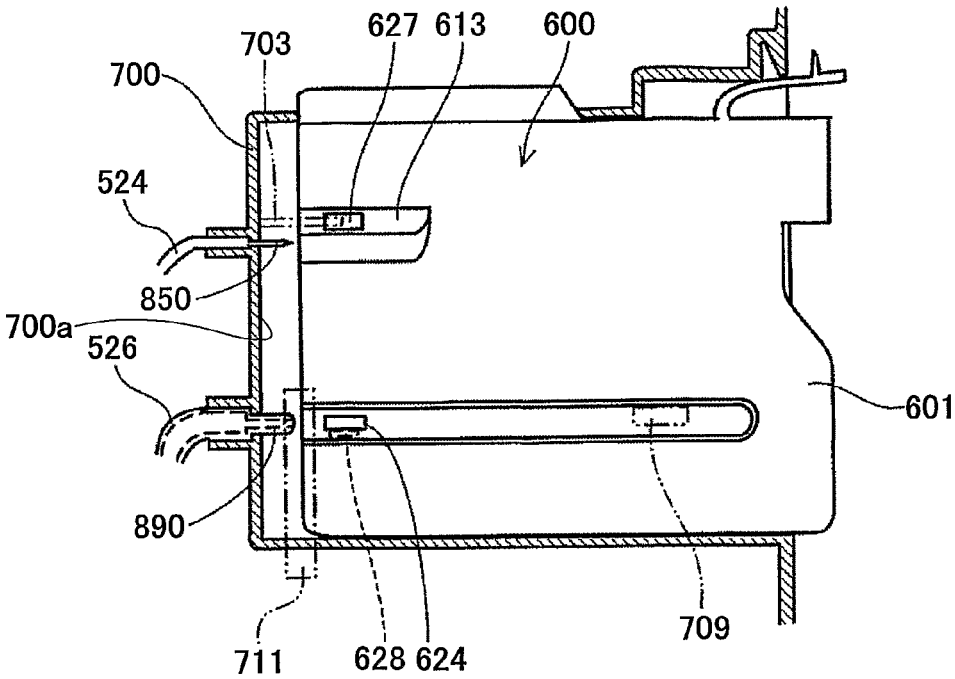
FIG. 42A is a schematic view of the ink cartridge and the insertion slot for explaining how the ink cartridge is inserted into the insertion slot.

As shown in FIG. 42A, when the ink cartridge 600 is inserted to the vicinity of the back wall 700*a* of the insertion slot 700, the trigger 703 contacts the pushed portion (starting unit) 627 to thereby push the pushed portion (starting unit) 627 toward an inside of the cartridge casing 601 along with the insertion of the ink cartridge 600. Then, the rotating member (moving unit) 621 rotates to thereby move the ink supplying port 622 of the ink cartridge 600 from the shielding position to the ink supplying position facing the 611, and the nozzle connector 623 moves from the shielding position to the connecting position facing the 612. Further, the protrusion (starting unit) 628 protrudes from the opening 614 toward an outside of the cartridge casing 601.

At this stage, neither the hollow needle 850 nor the air nozzle member 890 is inserted into the ink cartridge 600. This is because if the hollow needle 850 and the air nozzle member 890 are inserted into the ink cartridge 600 before the ink supplying port 622 and the nozzle connector 623 completely move respectively to the ink supplying position and the connecting position, the hollow needle 850 and the air nozzle member 890 may be destroyed. A length of the trigger 703 in the direction of inserting the ink cartridge 600 is set so that the ink supplying port 622 and the nozzle connector 623 are completely moved to the ink supplying position and the connecting position before the hollow needle 850 and the air nozzle member 890 are inserted into the ink cartridge 600 and the ink cartridge 600 is further inserted.

At this stage, the protrusion (starting unit) 628 does not contact the interlocking contact 711 even though the protrusion (starting unit) 628 protrudes outside the cartridge casing 601. When the interlocking contact 711 contacts the contact 712 after this stage, the 525 is enabled to be driven without insertion of the hollow needle 850, thereby possibly causing an air intrusion. Therefore, as described, an interlock is not released until the movements of the ink supplying port 622 and the nozzle connector 623 are completed and the hollow needle 850 and the air nozzle member 890 are connected respectively to the ink supplying port 622 and the nozzle connector 623.

Figure 42B:
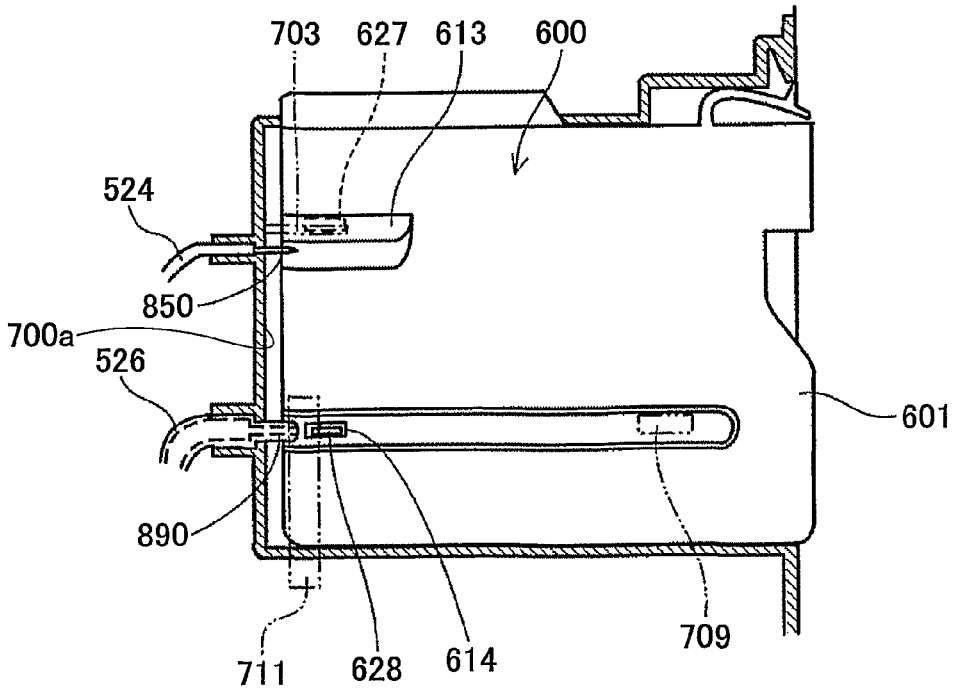
FIG. 42B is a schematic view of the ink cartridge and the insertion slot for explaining how the ink cartridge is inserted into the insertion slot.
Figure 43:
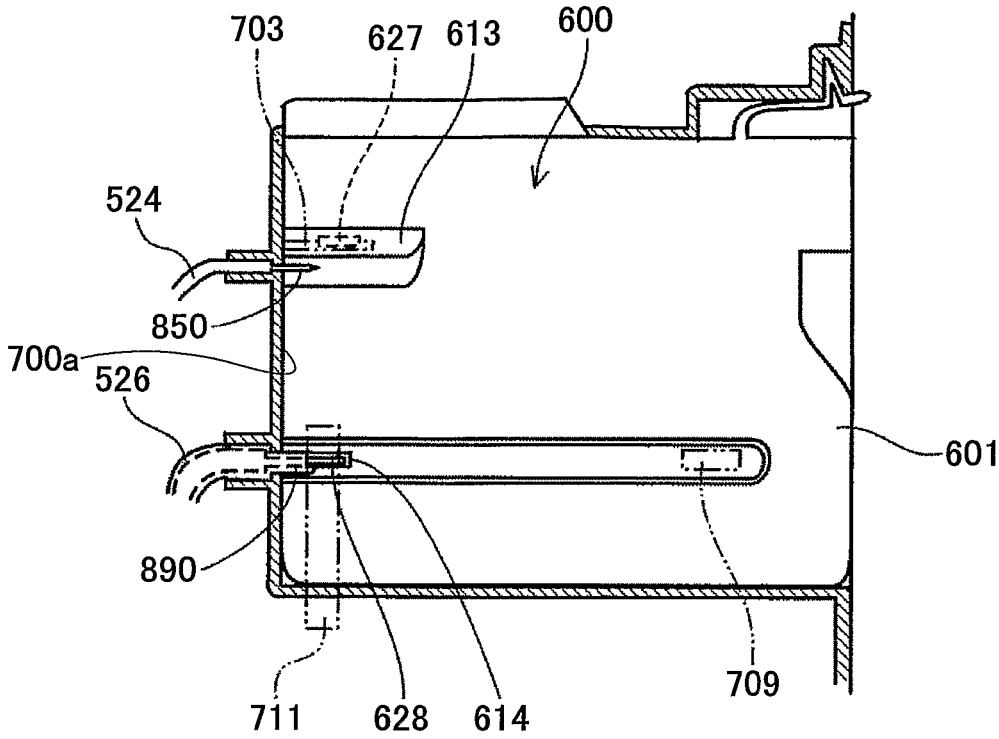
FIG. 43 is a schematic view of the ink cartridge and the insertion slot in a state where the ink cartridge is completely inserted into the insertion slot.

As shown in FIG. 42B, when the ink cartridge 600 is further inserted, the hollow needle 850 and the air nozzle member 890 are connected respectively to the ink supplying port 622 and the nozzle connector 623. At this stage, the protrusion (starting unit) 628 halfway pushes the interlocking contact 711 but the interlocking contact 711 does not make contact yet.

Thereafter, as shown in FIG. 42B, the 500 is completely inserted toward the back wall 700*a* of the insertion slot 700, the protrusion (starting unit) 628 moves the interlocking contact 711 until the interlocking contact 711 contacts the contact 712, thereby enabling to drive the 525 for starting an ink supply.

As such, because the ink cartridge 600 includes the rotating member (moving unit) 621 for moving the ink supplying port 622 between the ink supply position and the shielding position and the protrusion (starting unit) 628 for activating the unit contributing to the ink supply on the side of the main body 501 when the ink cartridge 600 is attached to the main body 501, the handling of the ink cartridge 600 is improved, the likelihood of causing an erroneous discharge of ink droplets can be lowered, and the ink supply can be stopped when the ink cartridge 600 is not attached to the main body 1 with a simple structure.

Embodiment 8

Embodiment 8 will be described with reference to FIGS. 44 through 46. The present invention is applicable to a structure in which an ink supplying portion (moving unit) 125 that moves between an ink supplying position enabling a hollow needle to pierce the ink supplying portion (moving unit) 125 and a shielding position is rotated around a direction perpendicular to attaching and detaching directions.

Figure 44:
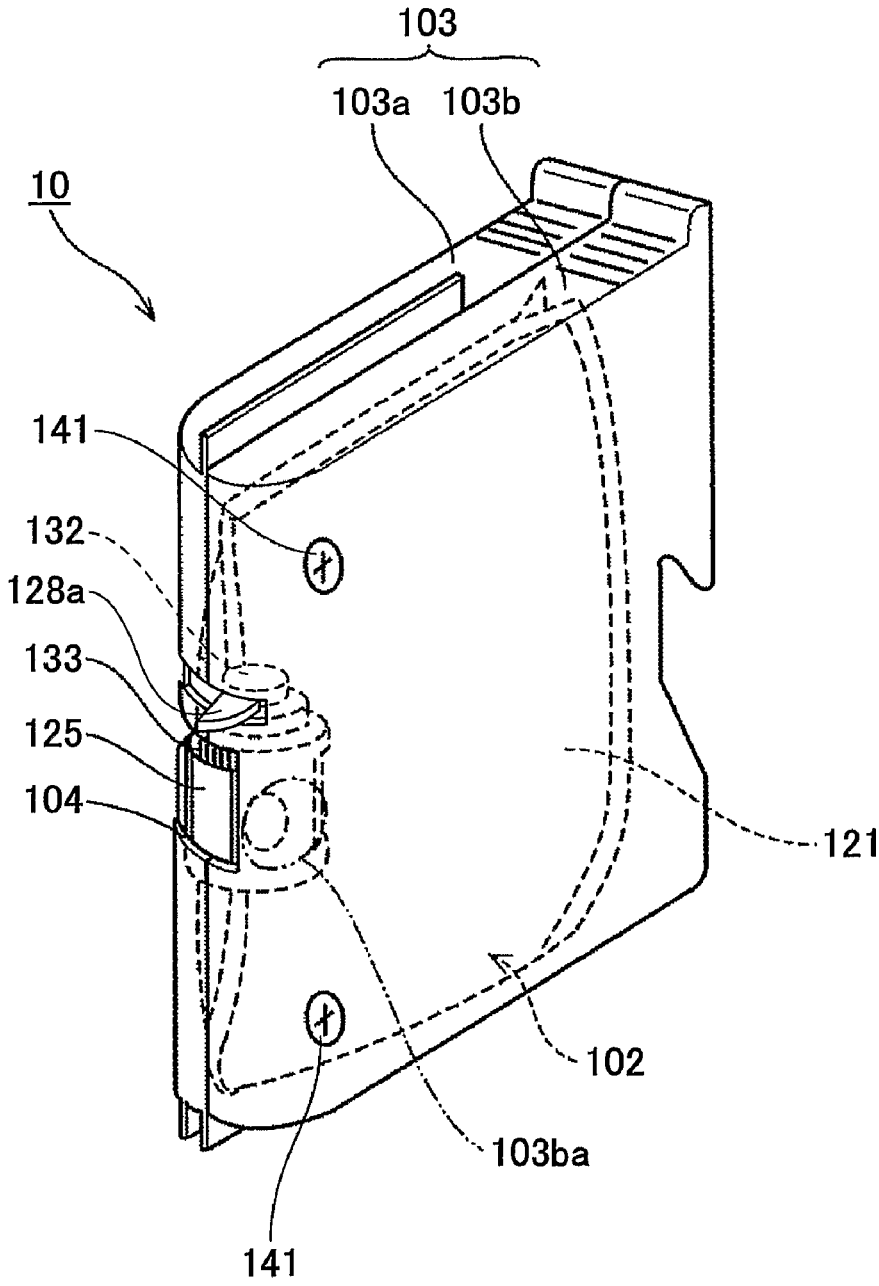
FIG. 44 is a perspective view of an ink cartridge of Embodiment 8 as a modification of Embodiment 1.

FIG. 44 is a perspective view of an ink cartridge 10 as a modification of Embodiment 1. FIG. 45 is a cross-sectional plan view of a part of the ink cartridge 10 and a part of an insertion slot 200 when the ink cartridge 10 is half inserted into the insertion slot 200. FIG. 46 is a cross-sectional plan view of a part of the ink cartridge 10 and a part of the insertion slot 200 when the ink cartridge 10 is completely inserted into the insertion slot 200.

The same numerical references are used for components having functions or shapes same as those in Embodiment 1.

Figure 45:
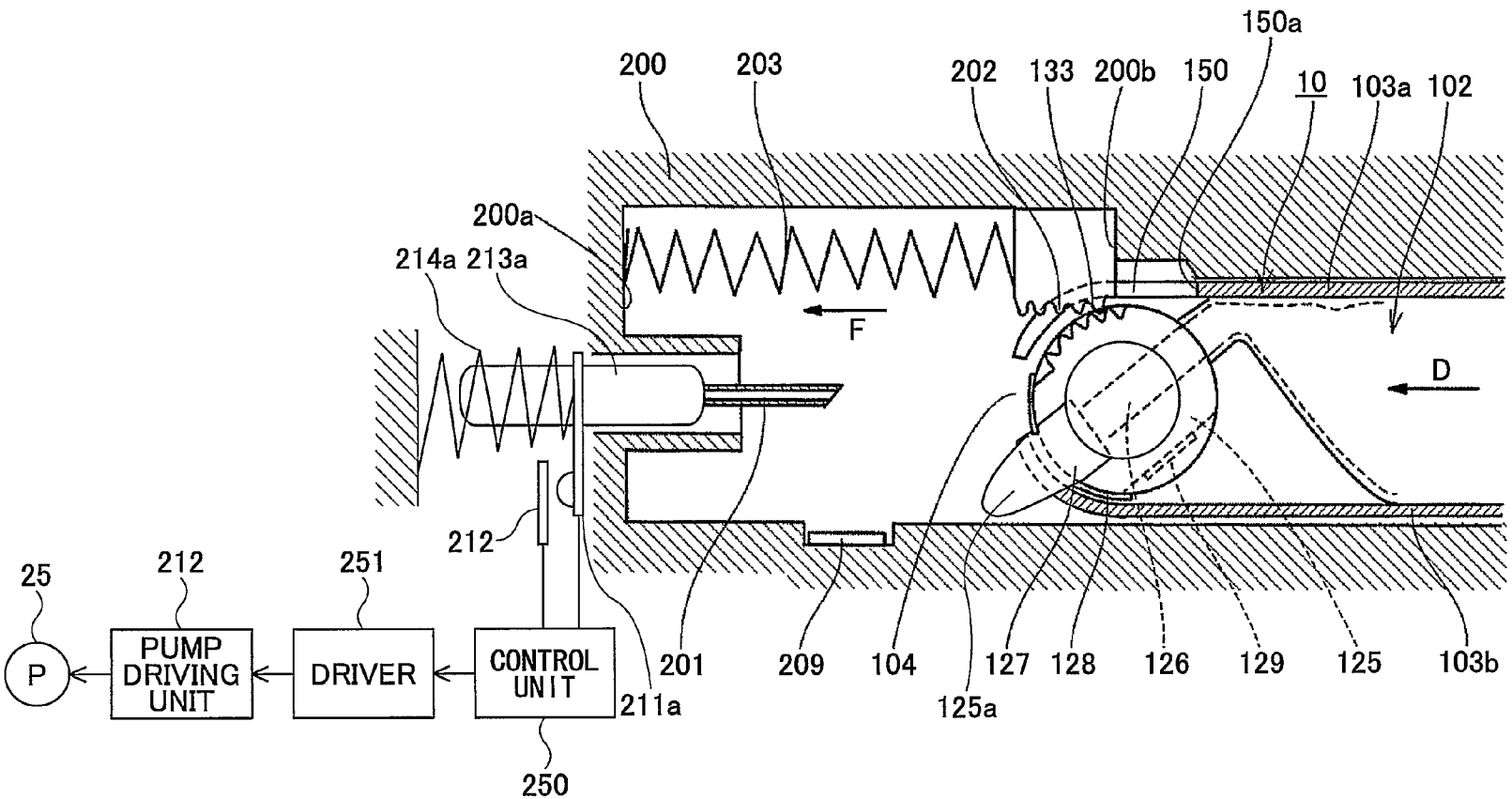
FIG. 45 is a cross-sectional plan view of a part of the ink cartridge and a part of an insertion slot when the ink cartridge is half inserted into the insertion slot.
Figure 46:
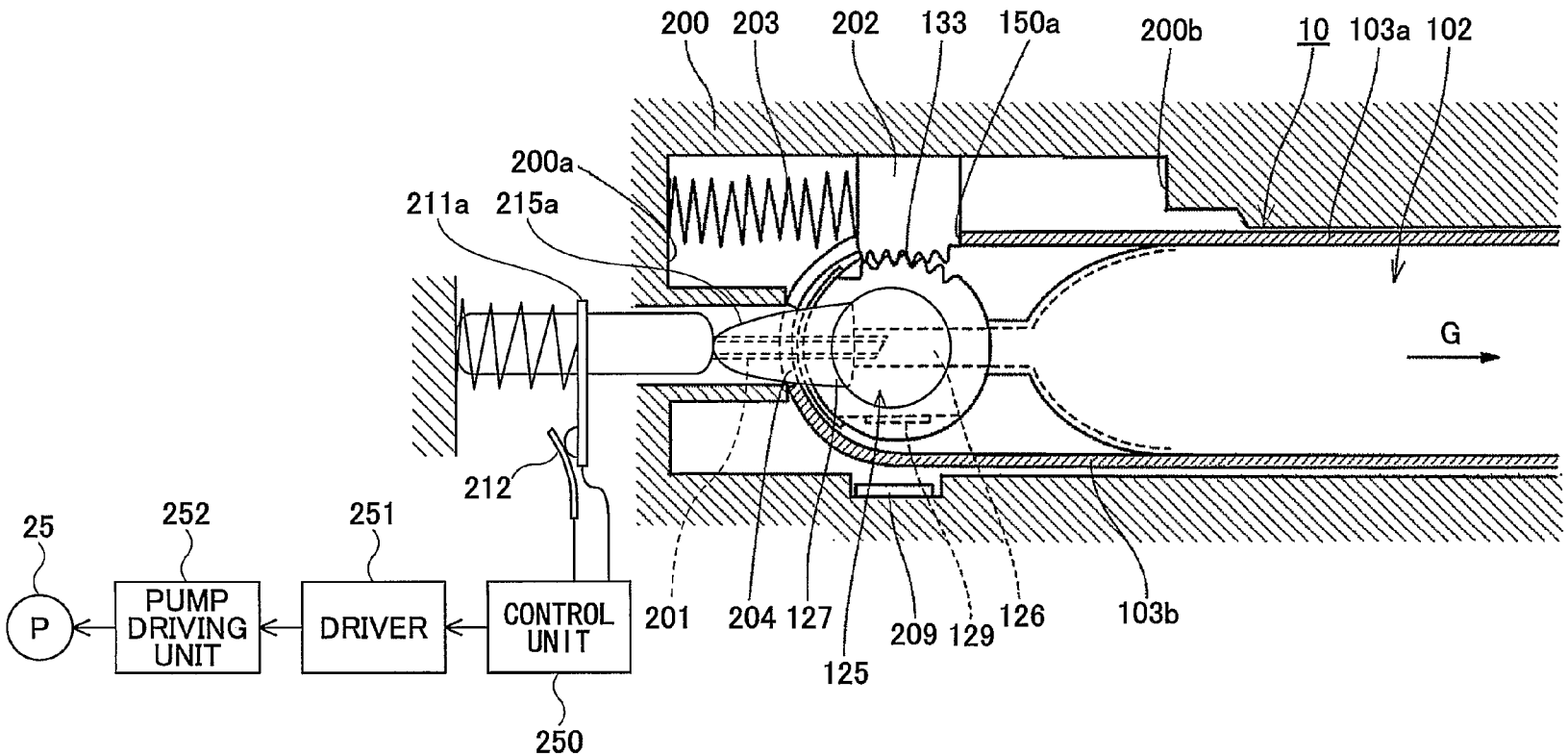
FIG. 46 is a cross-sectional plan view of the part of the ink cartridge and a part of the insertion slot 200 when the ink cartridge is completely inserted into the insertion slot.

A control unit 250 and so on which are components of a main body of an inkjet printer main body shown in FIGS. 45 and 46 are the same as corresponding components of Embodiment 7.

Referring to FIG. 45, a lever (starting unit) 125*a* is formed integrally with the ink supplying portion (moving unit) 125 on a top of the ink supplying portion (moving unit) 125. The lever (starting unit) 125*a* is to be operated from an outside. The lever (starting unit) 125*a* horizontally changes its angle relative to the ink cartridge 10 along with a rotation of the ink supplying portion (moving unit) 125.

Referring to FIG. 45, when the ink cartridge 10 is inserted into the insertion slot 200, the lever (starting unit) 125*a* is positioned so as not to interfere with a side wall of the insertion slot 200.

A rod pin 213*a* having an interlocking contact 211*a* is provided in a back wall 200*a* of the insertion slot 200 so as to move in an inserting direction of the ink cartridge 10. The rod pin 213*a* is constantly biased in a direction of pushing out the lever (starting unit) 125*a* by a 214*a*. Because the interlocking contact 211*a* does not contact a contact 212, a 25 is prevented from being driven by a control unit 250 for supplying ink.

Next, when the ink supplying portion (moving unit) 125 reaches the back wall 200*a* of the insertion slot 200 as shown in FIG. 45, the lever (starting unit) 125*a* moves the rod pin 213*a* against a spring force of the spring 214*a* and the hollow needle 201 pierces a 126. As a result, the interlocking contact 211*a* contacts the contact 212. The 25 can be driven by an electric signal and the ink can be supplied.

Although a mechanical contact is used for interlocking, it is also possible to use a non-contact configuration for interlocking.

For example, a magnet as an ink supplying unit is provided in the ink cartridge 10, and an ink supply operation is enabled when a magnetic force of the magnet is detected by, for example, a hole device.

Embodiment 9

An imaging apparatus of Embodiment 9 according to the present invention will be described with reference to FIGS. 47 through 50.

Figure 47:
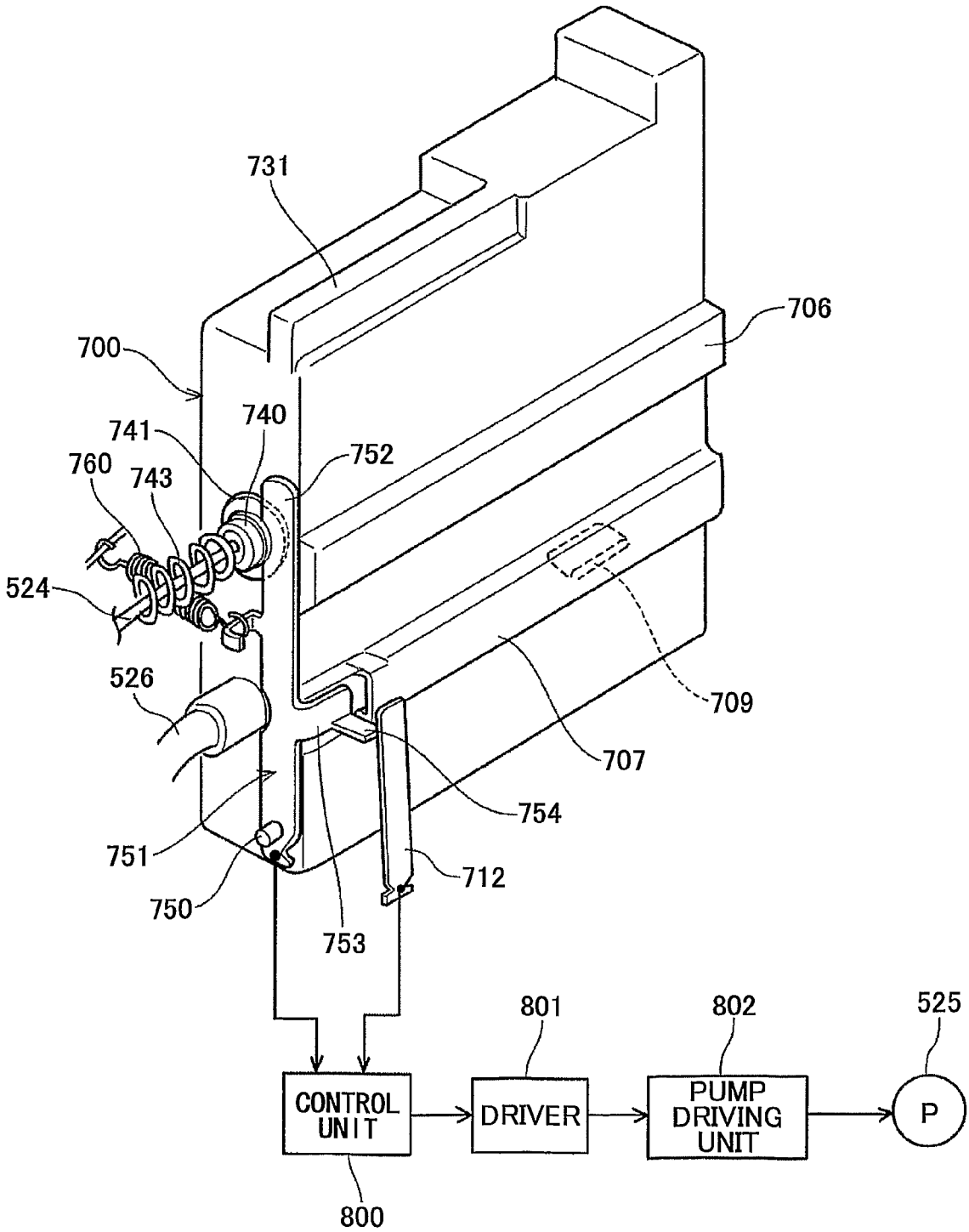
FIG. 47 is a perspective view of an insertion slot of Embodiment 9 provided in a main body and not attaching an ink cartridge.
Figure 48:
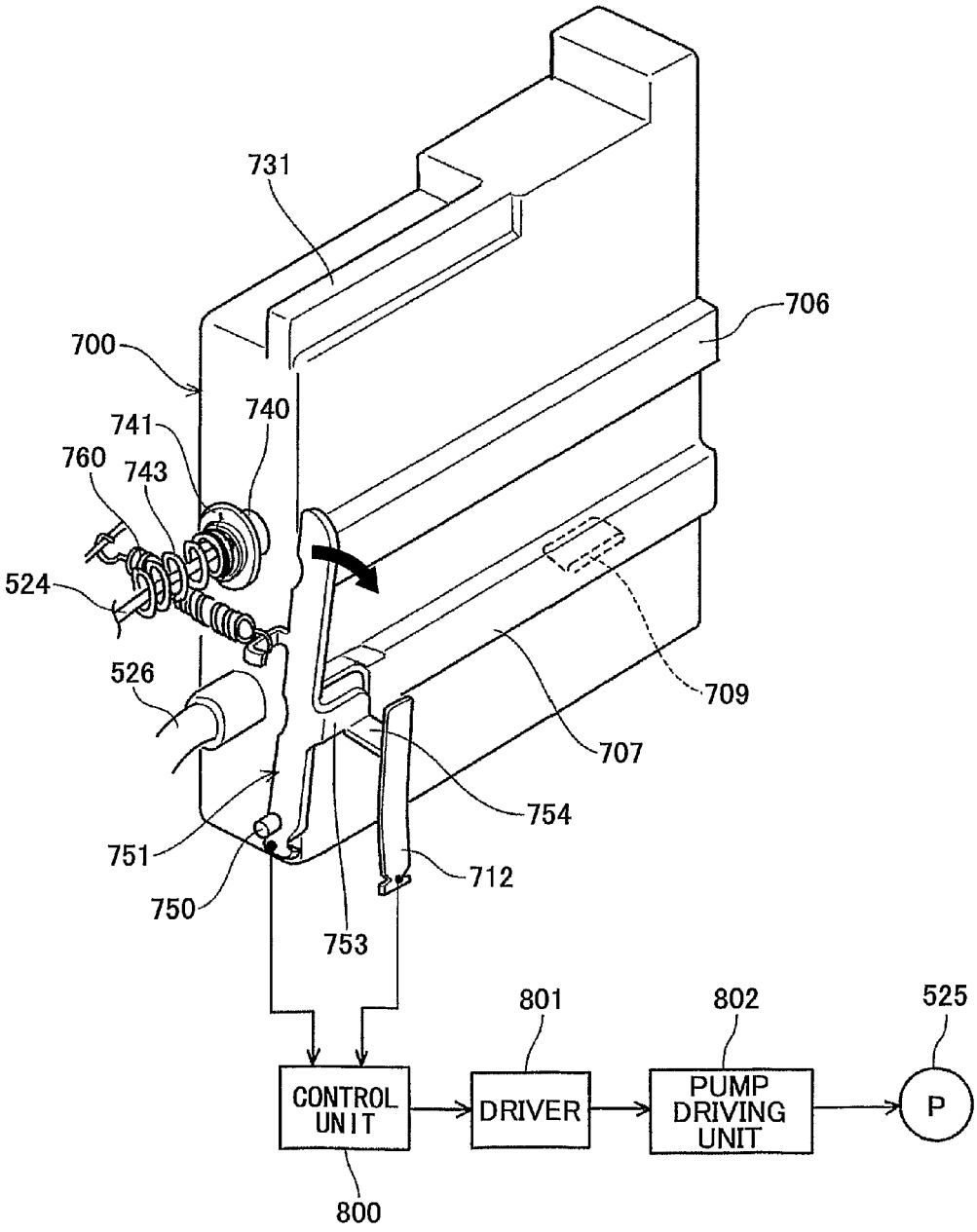
FIG. 48 is a perspective view of the insertion slot provided in the main body and attaching the ink cartridge.
Figure 49:
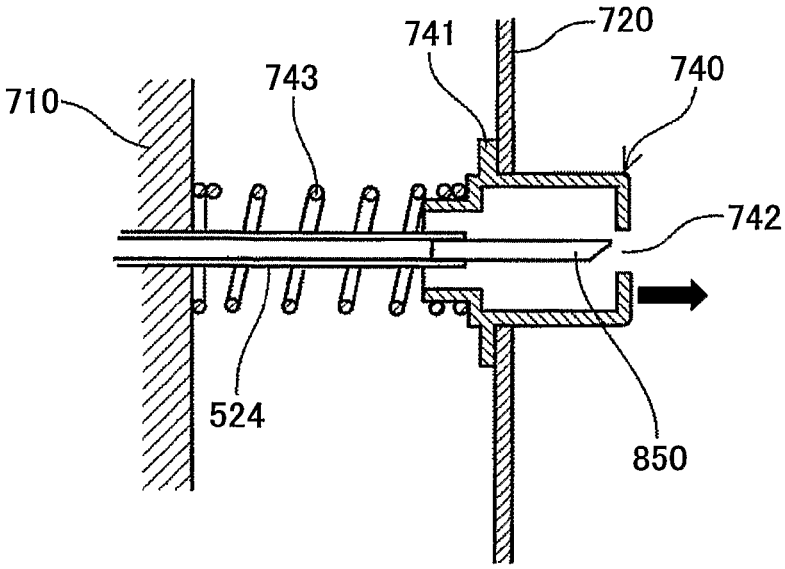
FIG. 49 is a cross-sectional plan view of an important part of the insertion slot in a state where the ink cartridge is not attached yet.
Figure 50:
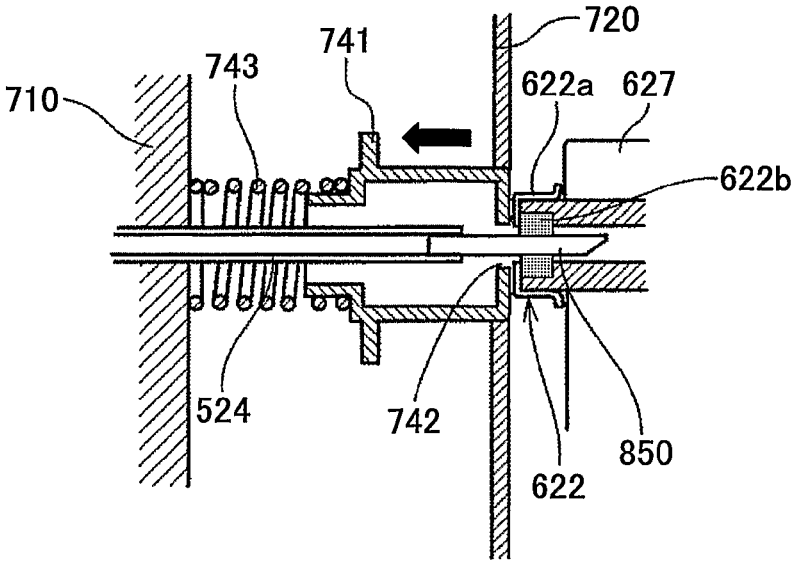
FIG. 50 is a cross-sectional plan view of the important part of the insertion slot in a state where the ink cartridge is attached.

FIG. 47 is a perspective view of an insertion slot provided in a main body and not attaching an ink cartridge. FIG. 48 is a perspective view of an insertion slot provided in a main body and attaching the ink cartridge. FIG. 49 is a cross-sectional plan view of an important part of an insertion slot where an ink cartridge is not yet attached. FIG. 50 is a cross-sectional plan view of the important part of the insertion slot where the ink cartridge is attached.

Referring to FIG. 47, an insertion slot 700 holds a shield 740 which is shaped like a cylinder and covers a tip end and outer periphery of a hollow needle 850. The shield 740 includes a flange 741 in contact with an outer surface of the insertion slot 700 and an opening 742 through which the hollow needle 850 passes. The flange 741 is biased and held at a position in contact with an outer surface of the insertion slot 700 by a spring 743 interposed between a fixing part 710 of a main body 501 and the flange 741. Thus, the flange 741 is biased at a position (a shielding position) of shielding the hollow needle 850. Because a tube 524 connected to the hollow needle 850 is fixed to a fixing part 710, the hollow needle 850 does not move relative to the fixing part 710.

A lever 751 is rotatably supported by a pivot 750 which is provided on an outer surface of the insertion slot 700.

An upper part of the lever 751 is an engaging part 752 as shown in FIG. 47. The engaging part 752 engages the flange 741 of the shield 740 to prevent the shield 740 from moving in an inward direction (a direction along an arrow in FIG. 49). The lever 751 is biased and held where the engaging part 752 engages the flange 741 of the shield 740 by a 760 which is interposed between the pivot 750 and the fixing part 710. Therefore, it is possible to prevent a user from touching the hollow needle 850 where the ink cartridge 600 is not attached to the insertion slot 700. For example, when the user carelessly puts his or her finger in the insertion slot 700, such the event may occur.

The lever 751 includes a receiver 753 and a contact 754 as shown in FIGS. 47 and 48. The receiver 753 is pushed by a protrusion (starting unit) 628 of the ink cartridge 600. The contact 754 is provided in the receiver 753. In a manner similar to the previous embodiments, a contact 712 is provided to be in contact with the contact 754 when the contact 754 is rotated outward. A control unit 800 receives a connection and a disconnection between the contact 754 and the contact 712. The control unit 800 does not rotate the 525 when the contact 754 does not contact the contact 712. Therefore, air is not injected into the ink cartridge 600 and ink is not supplied from the ink cartridge 600. When the contact 754 contacts the contact 712, the control unit 800 drives the 525 at a predetermined timing via a driver 801 and a pump driving unit 802. Therefore, air is injected into the ink cartridge 600 and ink is supplied to the main body 501 from the ink cartridge 600.

When the ink cartridge 600 is attached to the insertion slot 700 of the main body 501, the protrusion (starting unit) 628 pushes the receiver 753 of the lever 751. Therefore, the lever 751 is rotated in a direction of an arrow in FIG. 48 against a spring force of a spring 760. Until the lever 751 is rotated, the flange 741 is engaged by the engaging part 752 and the shield 740 shields the hollow needle 850 as shown in FIG. 50.

After the lever 751 rotates, the engagement by the flange 741 is released and immediately thereafter a tip end of the shield 740 is pushed by a cartridge casing 601 of the ink cartridge 600. Then the shield 740 is pushed in a direction of an arrow in FIG. 50, and the hollow needle 850 protrudes from an opening 742 of the shield 740. Thus, the hollow needle 850 pierces an ink supplying port 622 of the ink cartridge 600 and is inserted into the ink supplying port 622.

Then, the contact 754 contacts the contact 712 to enable supplying an ink. The 800 drives the 525 to supply ink to the main body 501 from the ink cartridge 600.

When the ink cartridge 600 is removed from the insertion slot 700, the shield 740 moves in the direction of the arrow in FIG. 49. After starting to pull the ink cartridge 600 outward, the shield 740 follows the ink cartridge 600 by a force of the spring 743 in the direction. The flange 741 contacts the insertion slot 700 at a predetermined position where the hollow needle 850 is shielded. During the operation, the hollow needle 850 is pulled out of the ink supplying port 622 of the ink cartridge 600. After the hollow needle 850 is pulled out of the ink supplying port 622, a pushed portion (starting unit) 627 as in FIG. 32 is also apart from a trigger 703 as in FIGS. 37 and 38, and rotating member (moving unit) 621 rotates back. Simultaneously, the protrusion (starting unit) 628 as in FIG. 32 is drawn inside the cartridge casing 601 to thereby release the lever from being pushed by the protrusion (starting unit) 628. Thus, the lever 751 returns to where the flange 741 of the shield 740 is engaged by a force of the 760.

When the ink cartridge 600 is not attached, the tip end of the hollow needle 850 is constantly shielded by the shield 740 inside the insertion slot 700. Since the shield 740 is engaged by the 551, even if a user carelessly put his or her hand into the insertion slot 700 and pushes the shield 740, the hollow needle 850 cannot be exposed. Thus, it is possible to prevent the user from touching the hollow needle 850.

In the above embodiments, the ink cartridge is a pressurized type in which ink is supplied by pressuring an ink bag from the outside. However, the above embodiments can be similarly applied to an ink cartridge of a suction type in which ink is suctioned via a hollow needle from an ink bag.

Next, Embodiments 10 to 13 of the present invention will be described. Embodiments 10 to 13 relate to an ink charging jig, an ink charging device, an ink charging method, and an ink charging kit for charging the ink into an ink cartridge of the Embodiments 1 through 6 and 8. When the ink cartridges described in Embodiments 1 through 6 and 8 are used, since the ink supply port is in the shielded position shielded from the outside, it becomes difficult to charge the ink. An ink charging jig, an ink charging device, an ink charging method, and an ink charging kit described below can improve workability in charging an ink into an ink cartridge of which ink supplying port is shielded from the outside.

Embodiment 10

Figure 51:
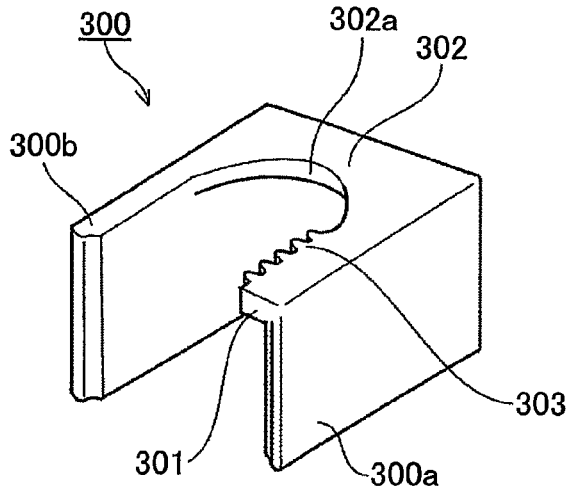
FIG. 51 is a perspective view of an ink charging jig of the Embodiment 10.
Figure 52:
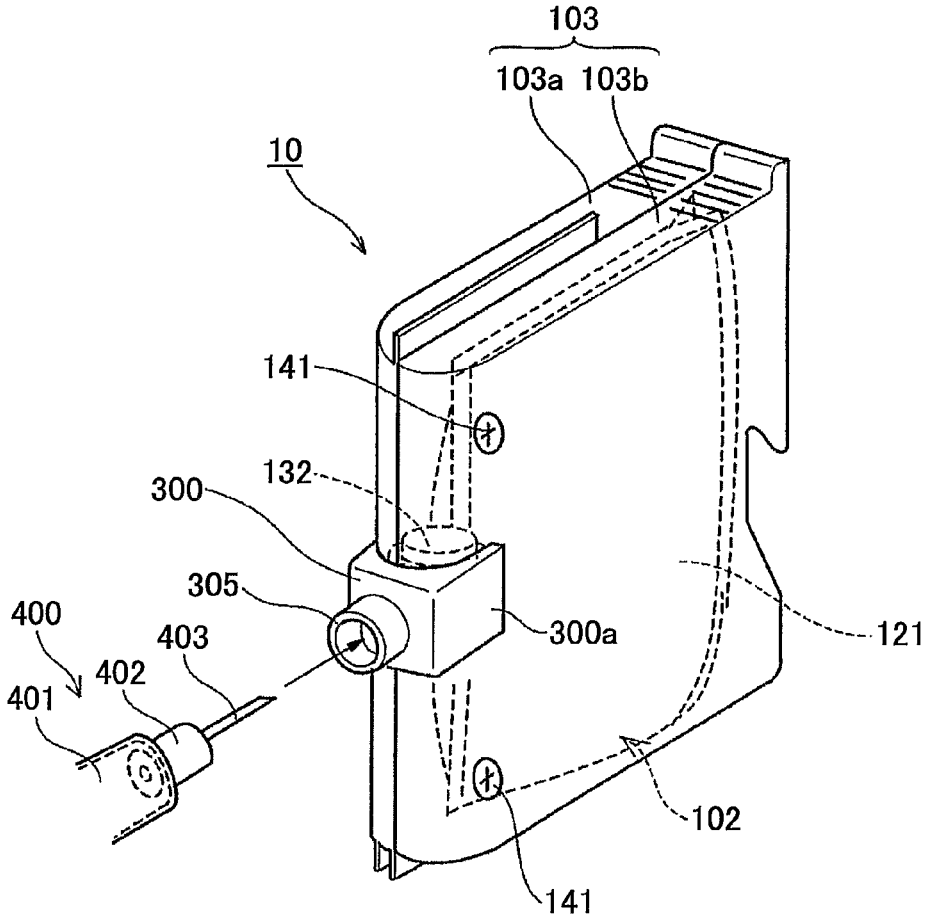
FIG. 52 is a perspective view of an ink cartridge to which the ink charging jig is attached to charge an ink into the ink cartridge.

An ink charging jig of Embodiment 10 according to the present invention will be described with reference to FIGS. 51 through 58. FIG. 51 is a perspective view of the ink charging jig of the Embodiment 10. FIG. 52 is a perspective view of an ink cartridge to which the ink charging jig is attached to charge an ink into the ink cartridge.

An ink charging jig 300 is a jig for an ink cartridge 10 which has an ink supplying portion (moving unit) 125 as in for example Embodiment 1. An ink charging device 320 includes the ink charging jig 300 engaging a cartridge casing 103 of an ink cartridge 10 and a charger 400 which has a 403 of a hollow needle, is shaped like an injector, charges an ink into the ink cartridge 10. The ink charging jig 300 includes a first positioning part 301 and a second positioning part 302 for determining relative positions between the charger 400 and a 126, and a rack 303 for engaging a pinion 133 of the ink cartridge 10 when the relative positions are determined by the first positioning part 301 and the second positioning part 302 and moving the ink supplying portion (moving unit) 125, a rotating member 174 and a rotating member 185 to a supplying position facing an opening 104 of the ink cartridge 10.

The ink charging jig 300 is made of, for example, a resin such as polystyrene, is shaped like U. The ink charging jig 300 has clips 300*a* and 300*b* having elasticity in opening directions. A space between the clips 300*a* and the 300*b* is smaller than a thickness of the ink cartridge 10. The ink cartridge 10 can be fixed to the ink charging jig 300 by being clipped between the clips 300*a* and the 300*b*. An elastic force when the ink cartridge 10 is clipped by the ink charging jig 300 is set stronger than a force applied to the ink supplying portion (moving unit) 125 by a spring 138 for returning back. Therefore, the ink charging jig 300 is not easily dropped off.

The first positioning part 301 is formed to engage a cutout 150 of the ink cartridge 10 as in FIG. 12. When the first positioning part 301 engages the cutout 150, the vertical position of the ink charging jig 300 of an upright state of the ink cartridge 10 is determined. The ink charging jig 300 clips the ink cartridge 10 by the clips 300*a* and the 300*b*, so that the horizontal position of the ink charging jig 300 of the upright ink cartridge 10 is also determined.

Figure 55:
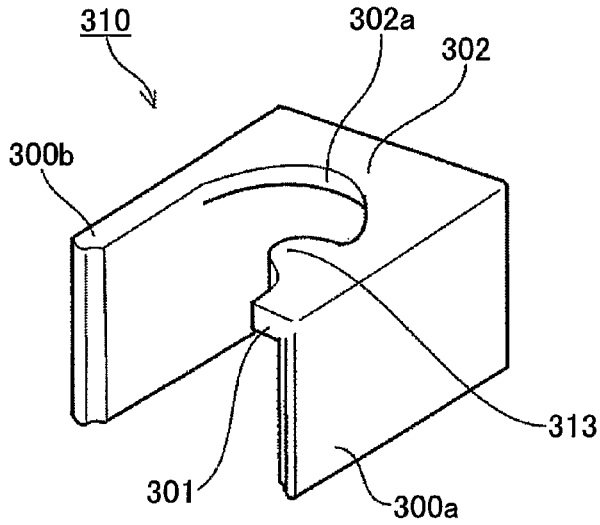
FIG. 55 is a perspective view of an ink charging jig of Embodiment 11.

The second positioning part 302 has a 302*a* shaped like an "R" as shown in FIG. 55. A position of the ink charging jig 300 relative to the ink cartridge 10 is also determined by the second positioning part 302.

The ink charging jig 300 includes a holding part 305 which is shaped like a cylinder, integrally formed with the ink charging jig 300, holds the 403 of the charger 400 by inserting a cylindrical part 402 of the charger 400 into the holding part 305, and determines a distance of inserting the 403 by contact between the 401 and the cylindrical part 402, as shown in FIG. 52. When the cylindrical part 402 is inserted into the holding part 305 of the ink supplying ink charging jig 300, a bottom of the holding part 305 contacts the cylindrical part 402 or the holding part 305 contacts the 401, and the 403 is stopped inside a nozzle insertion path 126. Therefore, the 403 does not reach an ink bag (ink accommodating unit) 102 and the ink bag (ink accommodating unit) 102 is prevented from being damaged.

The charger 400 includes the 401, the cylindrical part 402 integrally formed with the 401, and the 403, and has a structure similar to a so-called syringe.

The ink charging device 320 of Embodiment 10 is made up of the ink charging jig ink charging jig 300 and the charger 400. Although the syringe-like charger has been exemplified, a device (not shown) of charging an ink from an ink tank via a tube or the like to the 403 with an ink sending pump may be used.

Figure 53:
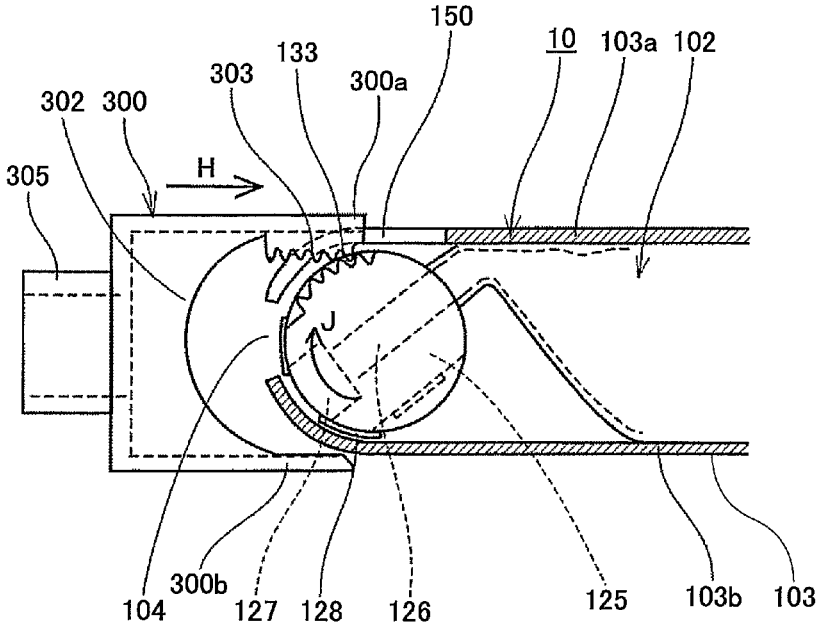
FIG. 53 is a cross-sectional plan view of a part of an ink cartridge and the ink charging jig of Embodiment 10.

An ink charging method of charging an ink into an ink bag or the like using the ink charging jig 300 and the charger 400 of Embodiment 10 will be described. Referring to FIG. 53, the ink charging jig 300 is engaged with the ink cartridge 10 by aligning the ink charging jig 300 to the opening 104 and inserting the first positioning part 301 into the cutout 150 in a direction of an arrow H in FIG. 53 to engage the rack 303 with the pinion 133. The ink supplying portion (moving unit) 125 rotates in a direction of an arrow J in FIG. 53, and the ink supplying portion (moving unit) 125 moves from a shielding position not facing the opening 104 to an ink supplying position facing the opening 104.

Figure 54:
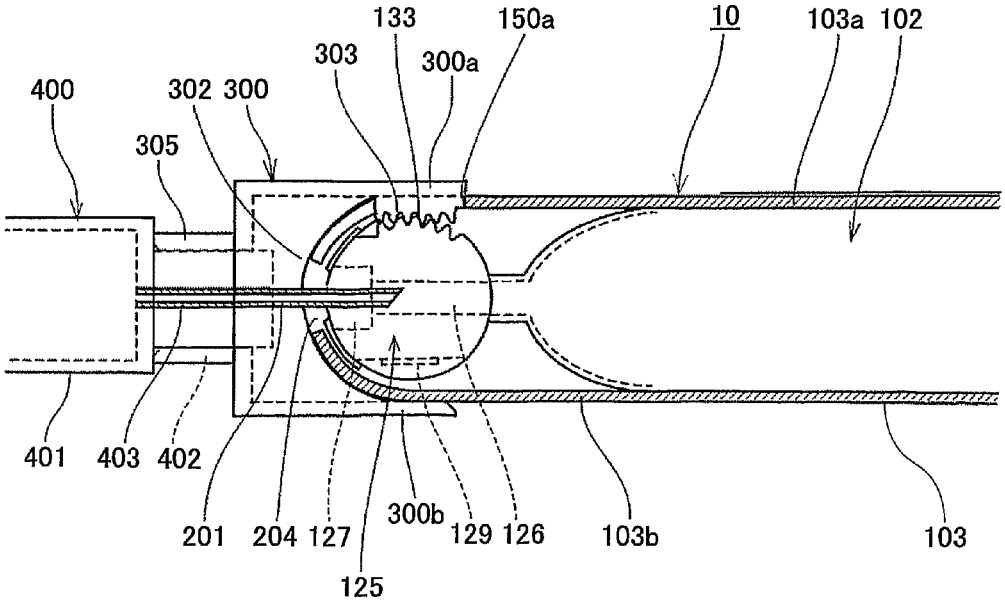
FIG. 54 is a cross-sectional plan view of the part of an ink cartridge and the ink charging jig of Embodiment 10.

As shown in FIG. 54, when the cylindrical part 402 of the charger 400 is inserted into the holding part 305 of the ink charging jig 300, the 403 is inserted into the 126 and stopped at the predetermined position. Then, ink is charged by operating the charger 400, and the ink is charged into the ink bag (ink accommodating unit) 102 of the ink cartridge 10.

As such, since the ink charging jig 300 engages the cartridge casing 103, and the rack 303 engages the pinion 133 after being arranged by the first positioning part 301 to move the ink supplying portion (moving unit) 125 to the ink supplying position opposite to the opening 104, the ink supplying portion (moving unit) 125 moves to face the opening 104 when the ink charging jig 300 is attached to the ink cartridge 10, and the 403 is inserted into the ink supplying portion (moving unit) 125 to charge the ink. Therefore, workability of charging the ink into the ink cartridge 10 can be improved even though the ink supplying portion (moving unit) 125 of the ink cartridge 10 is shielded from an outside.

As for the ink charging device 320, the ink supplying portion (moving unit) 125 faces the opening 104 by attaching the ink charging jig 300 to the cartridge casing 103, and the 403 is inserted into the ink supplying portion (moving unit) 125 to charge the ink. Therefore, it is possible to improve workability of charging the ink into the cartridge casing 103 even though the ink supplying port is shielded from the outside.

As for the ink charging method, since the ink supplying portion (moving unit) 125 faces the opening 104 by attaching the ink charging jig 300 to the cartridge casing 103, and the 403 is inserted into the ink supplying portion (moving unit) 125 to charge the ink, it is possible to improve workability of charging the ink into the cartridge casing 103 even though the ink supplying port is shielded from the outside.

Embodiment 11

Ink Charging Jig

An ink charging jig of Embodiment 11 according to the present invention will be described with reference to FIG. 55. FIG. 55 is a perspective view of an ink charging jig of Embodiment 11. An ink charging jig 310 is used to charge an ink into an ink cartridge 10 of Embodiment 2. A cam (moving unit) 163 of an ink supplying portion (moving unit) 125 contacts a cam 313 to rotate the ink supplying portion (moving unit) 125 between a shielding position and an ink supplying position.

The other components are similar to those of Embodiment 10, and description of these is omitted. An ink charging device of Embodiment 11 is made up of the ink charging jig 310 and the charger 400. A method of charging the ink into an ink cartridge 10 using the ink charging jig 310 is similar to that in Embodiment 10 except that the cam 313 is used instead of the pinion 133. Therefore, a description of the method is omitted.

Embodiment 12

Ink Charging Device

Figure 56:
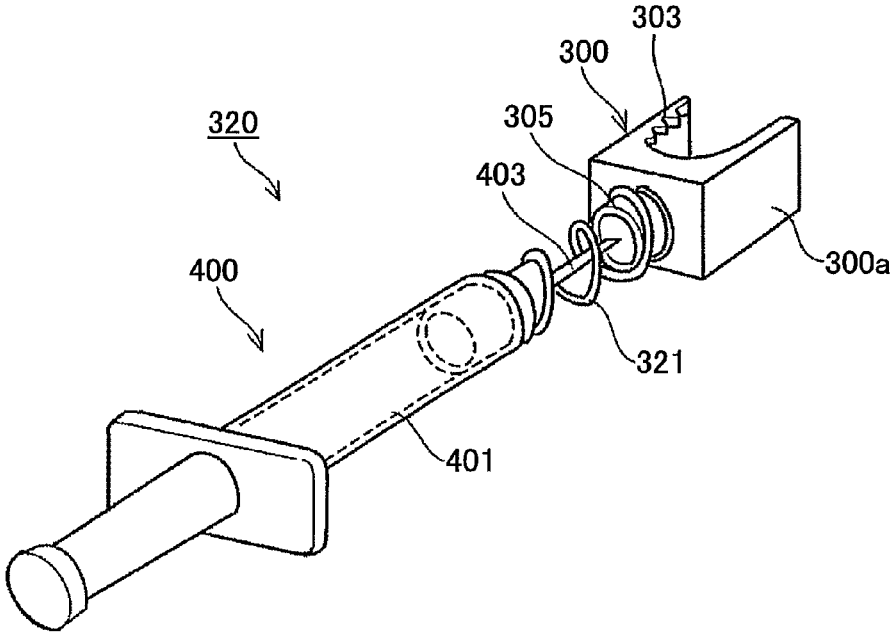
FIG. 56 is a perspective view of an ink charging device of Embodiment 12.

An ink charging device of Embodiment 12 according to the present invention will be described with reference to FIG. 56. FIG. 56 is a perspective view of an ink charging device of Embodiment 12. An example of an ink charging device 320 is formed by connecting the ink charging jig 300 or ink charging jig 310 and the charger 400 of Embodiment 10 with an elastic member 321 such as a spring.

The charger 400 is prevented from approaching the ink charging jig 300 or ink charging jig 310 until an ink supplying portion (moving unit) 125 of an ink cartridge 10 is moved in an ink supplying position with the elastic member 321. The ink charging jig 300 or ink charging jig 310 rotates the ink supplying portion (moving unit) 125 against a force of a spring 138 when the ink charging jig 300 or ink charging jig 310 is pushed toward the ink cartridge 10. A position of the ink charging jig 300 or ink charging jig 310 relative to the cartridge casing 103 is determined. A resistance force, i.e. a compressing force of the elastic member 321, is set larger than a force necessary for compressing a spring 138.

By this, the 403 can be inserted after the ink supplying portion (moving unit) 125 is completely rotated by pushing the ink charging jig 300 or ink charging jig 310. Therefore, it is possible to prevent the 403 from being inserted into the ink supplying portion (moving unit) 125 while the ink supplying portion (moving unit) 125 rotates.

Embodiment 13

Ink Charging Kit

Figure 57:
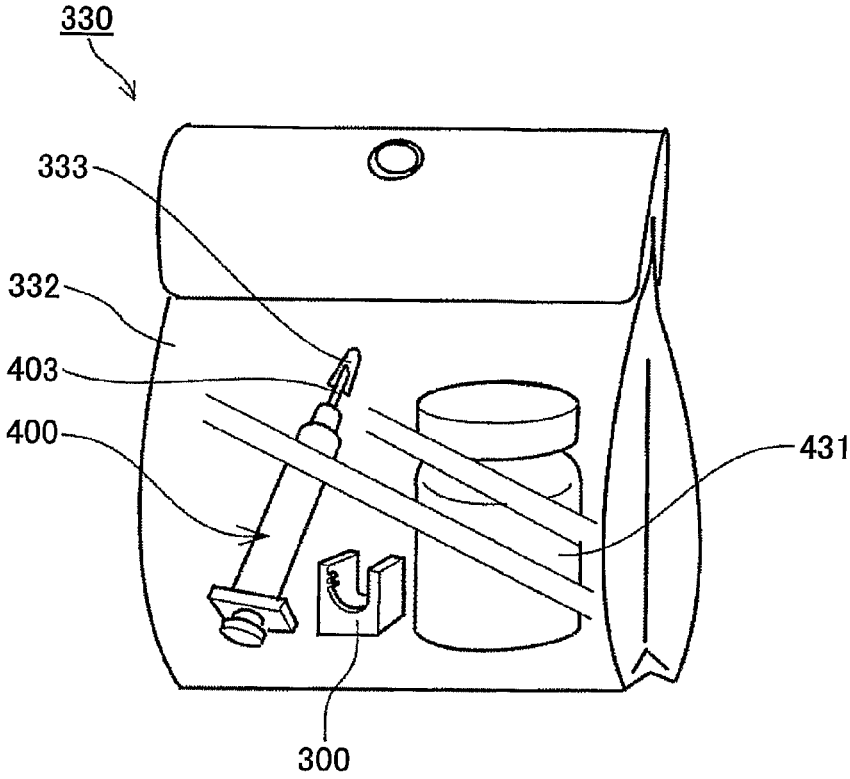
FIG. 57 is a schematic view showing an example of an ink charging kit of Embodiment 13.

An ink charging kit of Embodiment 13 according to the present invention will be described with reference to FIG. 57. FIG. 57 schematically shows an example of the ink charging kit. The ink charging kit 330 includes an ink charging jig 300 or ink charging jig 310, a charger 400, and an ink container 331 accommodating ink in a package body 332. A cover 333 is provided in a tip end of a 403 of the charger 400. A package body 332 is not limited to a bag and may be a casing.

A method of charging the ink using the ink charging kit 330 is similar to that in Embodiment 10.

The ink charging kit 330 includes the ink charging jig 300 or ink charging jig 310, the charger 400 having the 403 inserted into the ink supplying portion (moving unit) 125 and to be held by the ink charging jig 300 or ink charging jig 310, and the ink charging kit 330 for including the ink charging jig 300 or ink charging jig 310 and the charger 400. The ink charging jig 300 or ink charging jig 310 is attached to the ink cartridge 10 to make the ink supplying portion (moving unit) 125 face the opening 104 and the 403 is inserted into the ink supplying portion (moving unit) 125. Then, the ink can be charged. As a result, workability of charging the ink into the ink cartridge 10 can be improved even when the ink supplying portion (moving unit) 125 is shielded from an outside.

Figure 58:
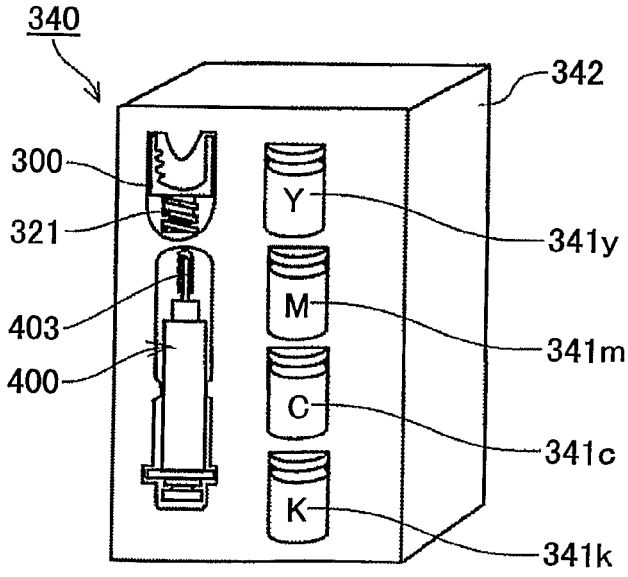
FIG. 58 is a schematic view showing an example of an ink charging kit of Embodiment 13.

Another ink charging kit of Embodiment 13 according to the present invention will be described with reference to FIG. 58. FIG. 58 schematically shows an example of the ink charging kit. An ink charging kit 340 is formed by including a portion integrally connecting an ink charging jig 300 to an elastic member 321 and a charger 400 described in Embodiment 12, and ink containers 341*y*, 341*m*, 341*c*, and 341*k* in a package body 342.

Before charging an ink using the ink charging kit 340, the charger 400 is engaged with the elastic member 321. A method of charging the ink using the ink charging kit 340 is similar to that in Embodiment 10.

An ink charging jig Embodiments 10 to 13 is used to charge an ink. The ink charging jig included an ink accommodating unit configured to accommodate the ink; a cartridge casing accommodating the ink accommodating unit; an ink supplying unit which is connected to the ink accommodating unit and is to be inserted by a supplying nozzle from an imaging apparatus; and a moving unit configured to move a part of the ink supplying unit between an ink supplying position where the charging nozzle is inserted in the ink supplying unit and a shielding position where the ink supplying unit is shielded from an outside, the ink charging jig, including: a positioning unit which engages the cartridge casing and determines a position of the charging nozzle of the charging unit; and an engaging unit which engages the moving unit in a state where the position of the charging unit is determined and moves the part of the ink supplying unit to the ink supplying position.

An ink charging jig of Embodiments 10 to 13 further includes: a hold unit configured to hold the charging unit having the charging nozzle.

The ink charging jig of Embodiments 10 to 13 is configured such that the positioning unit engages a cutout in the cartridge casing at a position facing the moving unit.

The ink charging jig of Embodiments 10 to 13 is configured such that the moving unit has a pinion and the engaging unit has a rack engaging the pinion.

The ink charging jig of Embodiments 10 to 13 is configured such that the moving unit has a cam and the engaging unit has a counter cam face contacting the cam.

The ink charging jig of Embodiments 10 to 13 is used to charge an ink to the ink cartridge including: an ink accommodating unit configured to accommodate the ink; a cartridge casing accommodating the ink accommodating unit; an ink supplying unit which is connected to the ink accommodating unit and is to be inserted by a supplying nozzle from an imaging apparatus; and a moving unit configured to move a part of the ink supplying unit between an ink supplying position where the charging nozzle is inserted in the ink supplying unit and a shielding position where the ink supplying unit is shielded from an outside, the ink charging device, including: the charging jig according to the preceding aspects; and a charging unit which is held by the ink charging jig by an elastic member to move forward and back and has the charging nozzle inserted in the ink supplying unit.

An ink charging method of Embodiments 10 to 13 charges an ink to the ink cartridge. The ink charging method included an ink accommodating unit configured to accommodate the ink; a cartridge casing accommodating the ink accommodating unit; an ink supplying unit which is connected to the ink accommodating unit and is to be inserted by a supplying nozzle from an imaging apparatus; and a moving unit configured to move a part of the ink supplying unit between an ink supplying position where the charging nozzle is inserted in the ink supplying unit and a shielding position where the ink supplying unit is shielded from an outside, the ink charging method, including: moving the ink supplying unit to the ink supplying position by the charging jig according to the preceding aspects; and inserting the charging nozzle of the ink supplying unit into the ink supplying unit; and charging the ink via the charging nozzle.

An ink charging method an ink charging kit of Embodiments 10 to 13 is used to charge an ink to the ink cartridge. The ink charging method includes an ink accommodating unit configured to accommodate the ink; a cartridge casing accommodating the ink accommodating unit; an ink supplying unit which is connected to the ink accommodating unit and is to be inserted by a supplying nozzle from an imaging apparatus; and a moving unit configured to move a part of the ink supplying unit between an ink supplying position where the charging nozzle is inserted in the ink supplying unit and a shielding position where the ink supplying unit is shielded from an outside, the ink charging kit, including: the charging jig according to the preceding aspects; a charging unit which is held by the ink charging jig to move forward and backward by an elastic member and has the charging nozzle inserted in the ink supplying unit.

The ink charging method an ink charging kit of Embodiments 10 to 13 is configured such that the package body further includes a charging ink.

Next, Embodiments 14 to 17 of the present invention will be described. Embodiments 14 and 15 relate to an ink charging jig, an ink charging device, an ink charging method, and an ink charging kit for charging the ink into an ink cartridge of the Embodiments 7 and 9. When ink cartridges described in Embodiments 7 and 9 are used, since an ink supply port is in a shielded position shielded from an outside, it becomes difficult to charge an ink. An ink charging jig, an ink charging device, an ink charging method, and an ink charging kit described below can improve workability in charging an ink into an ink cartridge of which an ink supplying port is shielded from an outside.

Embodiment 14

Figure 59:
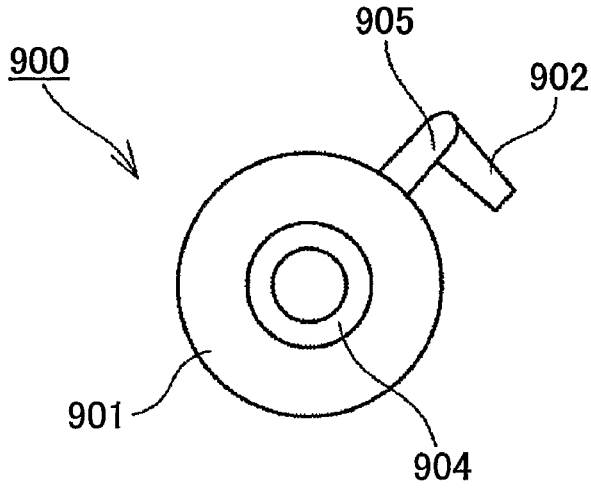
FIG. 59 is a front view of the ink charging jig of Embodiment 14.
Figure 60:
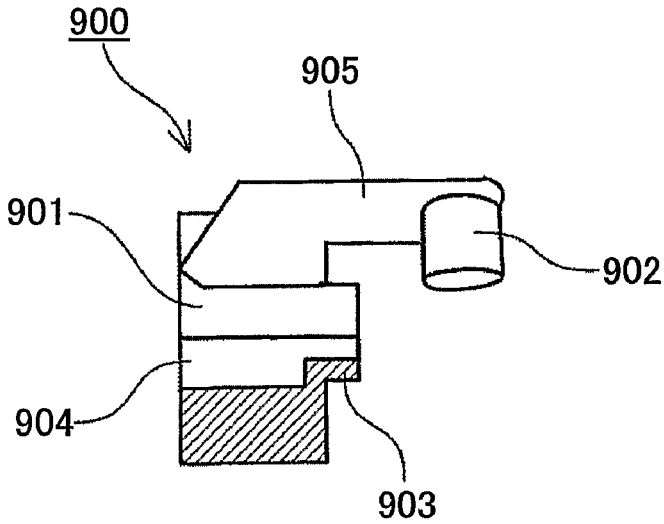
FIG. 60 is a partially cross-sectioned side view of the ink charging jig.
Figure 61:
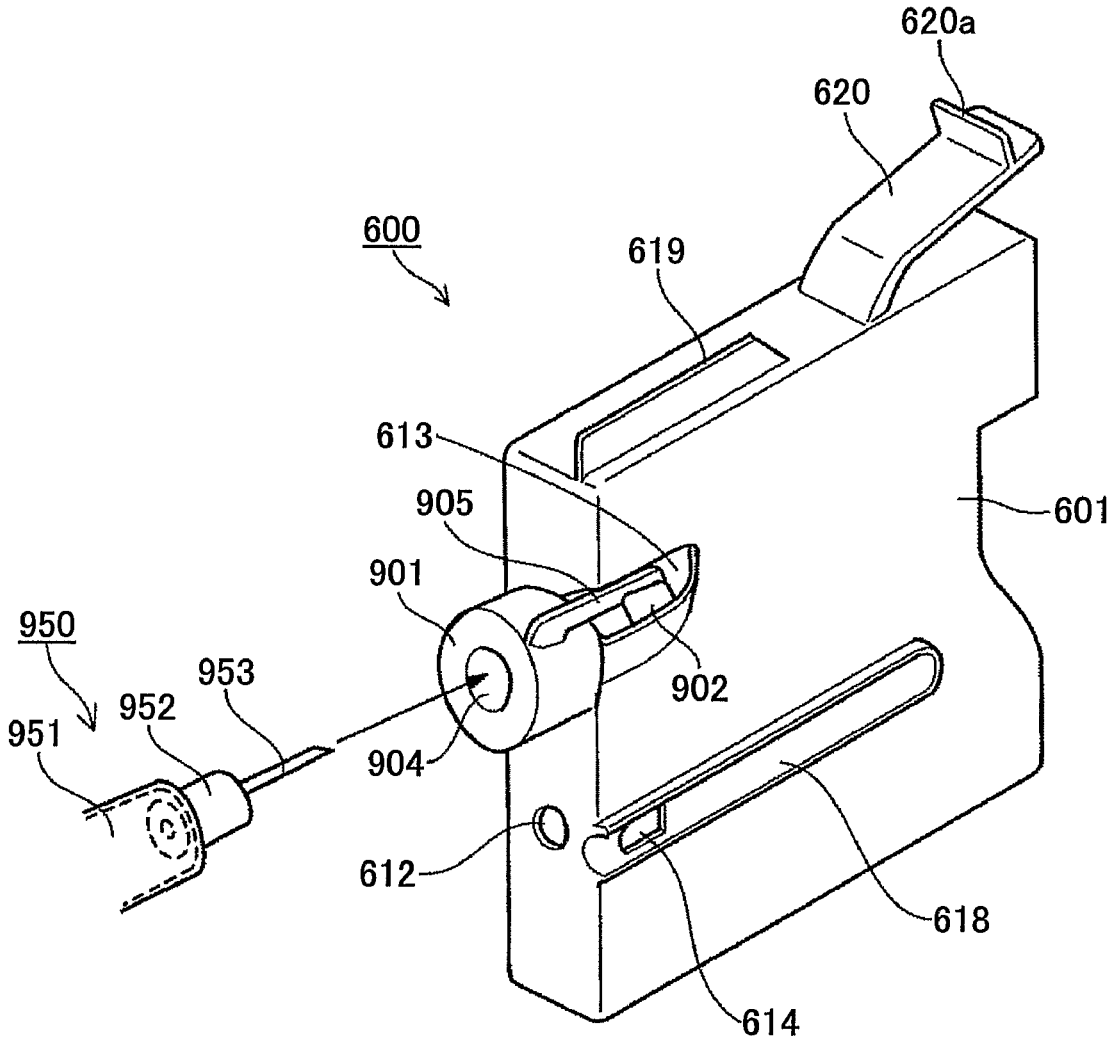
FIG. 61 is a perspective view of an ink cartridge and a part of the ink charging jig before charging an ink into the ink cartridge.

An ink charging jig of Embodiment 14 according to the present invention will be described with reference to FIGS. 59 through 61. FIG. 59 is a front view of the ink charging jig of the Embodiment 14. FIG. 60 is a partially cross-sectioned side view of the ink charging jig. FIG. 61 is a perspective view of an ink cartridge and a part of the ink charging jig before charging the ink into the ink cartridge.

Referring to FIG. 61, an ink charging jig 900 is attached to an 611 of a cartridge casing 601. The ink charging jig 900 includes a holder 901 to which a charger 950 is attached and a fixture 902 for fixing a rotating member (moving unit) 621 at a position enabling the charging nozzle (nozzle member) 953 to pierce the rotating member (moving unit) 621. The holder 901 constitutes a main body of the ink charging jig 900.

The holder 901 includes a boss 903 to be embedded in an 611 of the cartridge casing 601 and a 904 for receiving a cylindrical part 952 provided on a front surface of a charger body 951 of the charger 950.

Referring to FIG. 61, the fixture 902 is held by the holder 901 via an arm 905, intrudes inside the cartridge casing 601 via an opening 613 shown in FIG. 41A, through which a trigger 703 shown in FIG. 41A pushing a rotating member (moving unit) 621 shown in FIG. 34 passes, and fixes the rotating member (moving unit) 621 by intervening between the pushed portion (starting unit) 627 shown in FIG. 41A and an inner wall surface of the cartridge casing 601.

Referring to FIG. 61, the charger 950 includes the charger body 951, the charger body 951 integrally formed with the cylindrical part 952, and the charging nozzle (nozzle member) 953, and has a structure similar to a so-called syringe.

Referring to FIGS. 59 and 60, an ink charging device of Embodiment 14 includes the ink charging jig 900 and the charger 950. Although the syringe-like charger has been exemplified as the charger 950, a device of charging an ink from an ink tank via a tube or the like to the charging nozzle (nozzle member) 953 with an ink sending pump may be used.

An ink charging method of charging an ink into an ink bag or the like using the ink charging jig 900 and the charger 950 of Embodiment 14 will be described. Referring to FIG. 61, the ink charging jig 900 is attached to the cartridge casing 601 by embedding the boss 903 of the holder 901 in a 611 of the ink cartridge 600. Referring to FIG. 33, a fixture 902 intervenes between a pushed portion (starting unit) 627 of a rotating member (moving unit) 621 and an inner wall surface of the cartridge casing 601 while rotating the rotating member (moving unit) 621 and fixes the rotating member (moving unit) 621 to a position enabling a charging nozzle (nozzle member) 953 to pierce an ink supplying port 622. Since the fixture 902 receives a force of an elastic part 629 and fixed between the pushed portion (starting unit) 627 and an inner wall surface of a cartridge casing 601.

By inserting the cylindrical part 952 into the 904 of the ink charging jig 900, the charging nozzle (nozzle member) 953 pierces an ink supplying port 622 and stops at a predetermined position. Thereafter, an ink is charged into the ink bag 602 of the ink cartridge 600 by operating the charger 950.

As for the ink charging jig 900, since the ink charging jig 900 includes the fixture 902 for fixing the rotating member (moving unit) 621 at the position enabling the charging nozzle (nozzle member) 953 to pierce the rotating member (moving unit) 621 and the holder 901 to which the ink charging jig 900 is attached, the ink supplying port 622 moves to the ink supplying position by the rotating member (moving unit) 621 when the ink charging jig 900 is attached to the ink cartridge 600, and the charging nozzle (nozzle member) 953 is inserted into the ink supplying port 622, and the ink can be charged via the ink supplying port 622. Therefore, workability of charging the ink into the ink cartridge 600 can be improved.

As for the ink charging device, since the ink charging device includes the ink charging jig 900 and the charger 950, the ink charging jig 900 is attached to the ink cartridge 600, the rotating member (moving unit) 621 is fixed to the position enabling the charging nozzle (nozzle member) 953 to pierce the ink supplying port 622, and the ink can be charged through the charging nozzle (nozzle member) 953, whereby workability of charging the ink into the ink cartridge 600 can be improved.

As for the ink charging method, since the rotating member (moving unit) 621 is fixed at the position enabling the charging nozzle (nozzle member) 953 to pierce the ink supplying port 622 and the ink can be charged through the charging nozzle (nozzle member) 953, workability of charging the ink into the ink cartridge 600 can be improved.

Embodiment 15

Figure 62:
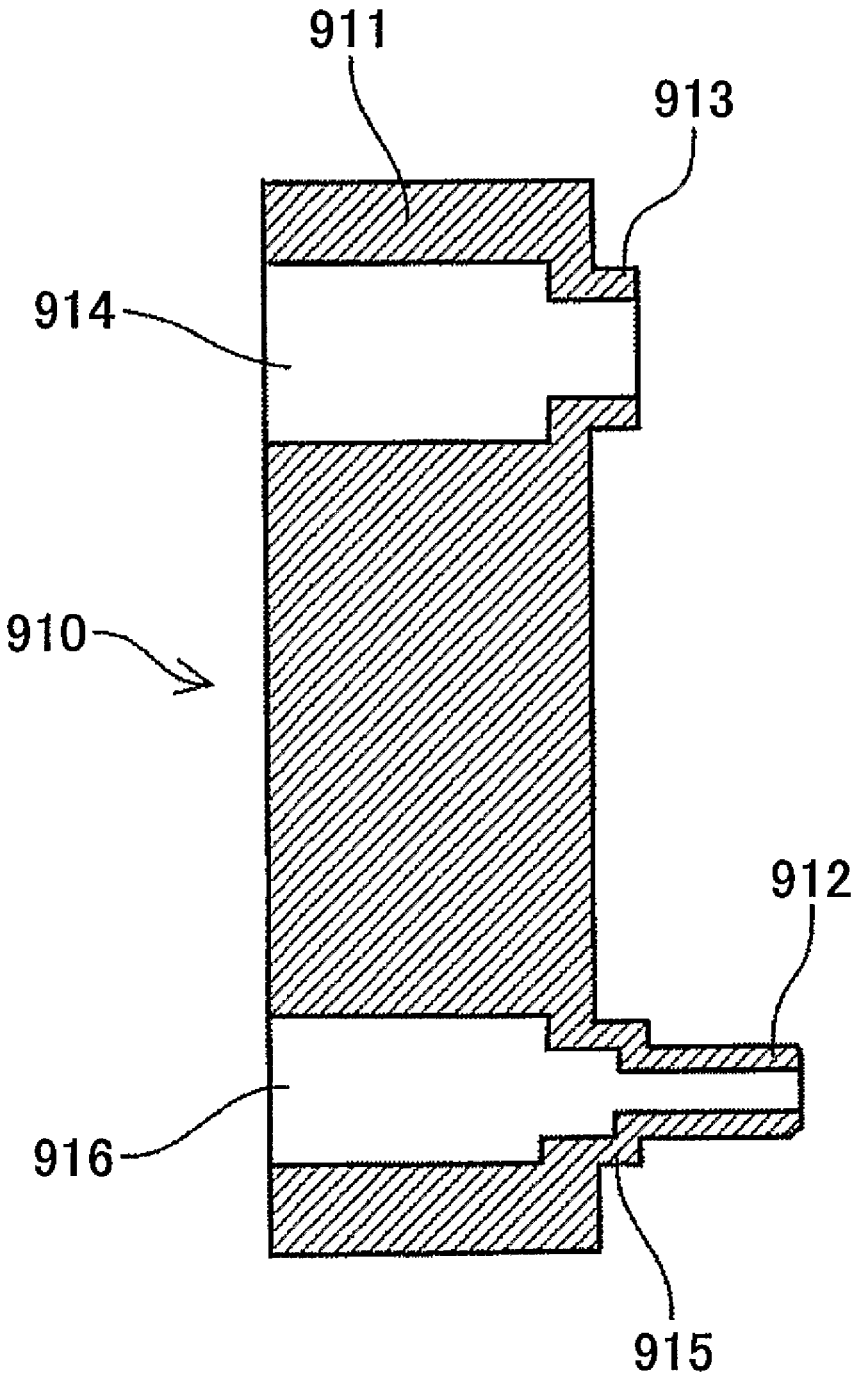
FIG. 62 is a cross-sectional view of the ink charging jig of Embodiment 15.
Figure 63:
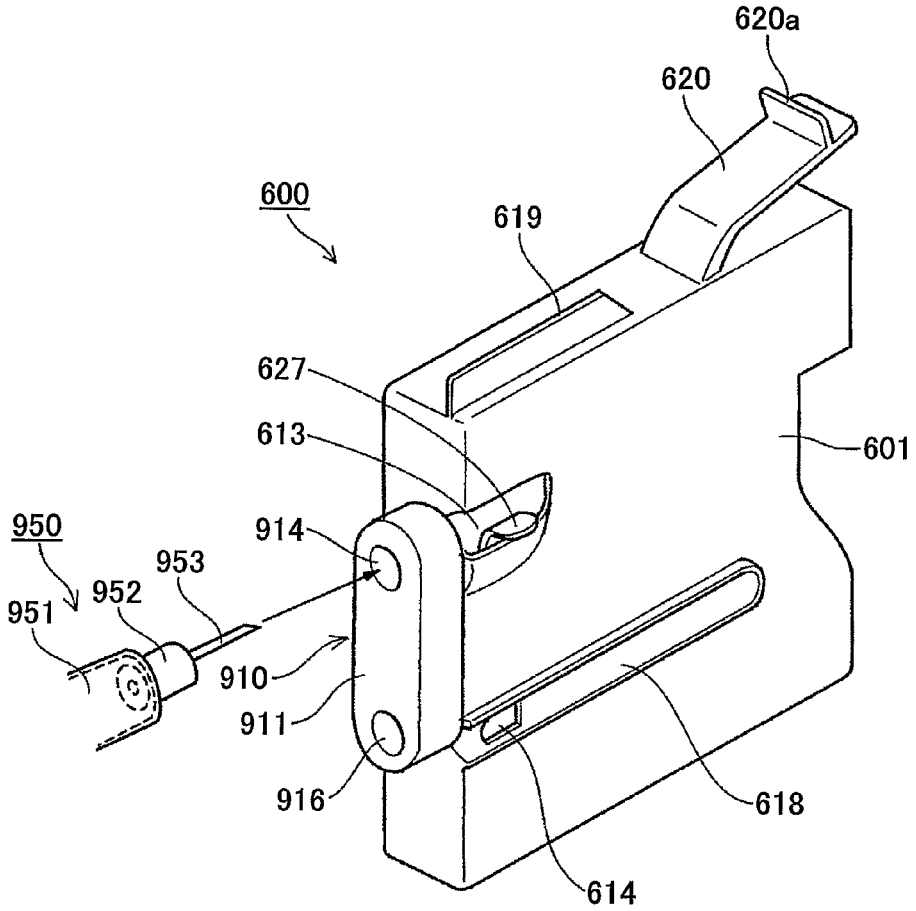
FIG. 63 is a perspective view of an ink cartridge and a part of the ink charging jig before charging the ink into the ink cartridge.

An ink charging jig of Embodiment 15 according to the present invention will be described with reference to FIGS. 62 to 63. FIG. 62 is a cross-sectional view of the ink charging jig of the Embodiment 15. FIG. 63 is a perspective view of an ink cartridge and a part of the ink charging jig before charging the ink into the ink cartridge.

The ink charging jig 910 includes a jig main body 911 for holding a charging nozzle (nozzle member) 953 of a charger 950 and a fixing part 912 for fixing a rotating member (moving unit) 621 at a position enabling the charging nozzle (nozzle member) 953 to pierce an ink supplying port 622. The charger 950 charges an ink through the charging nozzle (nozzle member) 953 piercing the ink supplying port 622.

The jig main body 911 includes a boss 913 to be embedded in an 611 of the cartridge casing 601 and a positioning hole 914 for receiving a cylindrical part 952 provided on a front surface of a charger body 951 of the charger 950.

The fixing part 912 is formed integrally with the jig main body 911 and has an outer peripheral shape enabled to be inserted into the nozzle connector 623. A step-like ring 915 is formed at a root of the fixing part 912 in a step-like ring shape. The step-like ring 915 is embedded in an 612 shown in FIG. 33 of the cartridge casing 601. By embedding the fixing part 912 in the nozzle connector 623 shown in FIG. 33, the rotating member (moving unit) 621 is fixed to a n ink supplying position.

The jig main body 911 has the fixing part 912, the step-like ring 915 and an air through hole 916 penetrating the jig main body 911. The air through hole 916 lets air inside an 603 shown in FIG. 32 out when the ink is charged and an ink bag 602 shown in FIG. 32 is inflated. By this, an air pressure inside the 603 becomes the same as an atmospheric pressure inside the 603, whereby a charging operation is not prevented.

When the ink is charged using the ink charging jig 910, the boss 913 of the jig main body 911 is embedded in the 611 shown in FIG. 33 of the cartridge casing 601, the step-like ring 915 is embedded in the 612 shown in FIG. 33 of the cartridge casing 601, and the fixing part 912 is inserted into the nozzle connector 623 of the rotating member (moving unit) 621 to fix the rotating member (moving unit) 621 at the ink supplying position. In this case, the rotating member (moving unit) 621 is biased by an elastic part 629 shown in FIG. 34 onto a side of shielding from outside. Therefore, a pushed portion (starting unit) 627 shown in FIG. 34 is pushed inward and moved to a position where the nozzle connector 623 of the rotating member (moving unit) 621 faces the 612.

Thereafter, the fixing part 912 is inserted into the nozzle connector 623 of the rotating member (moving unit) 621.

By inserting the cylindrical part 952 into the positioning hole 914 of the ink charging jig 910, the charging nozzle (nozzle member) 953 pierces an ink supplying port 622 and stops at a predetermined position. Thereafter, an ink is charged into the ink bag 602 of the ink cartridge 600 by operating the charger 950.

Embodiment 16

Figure 64:
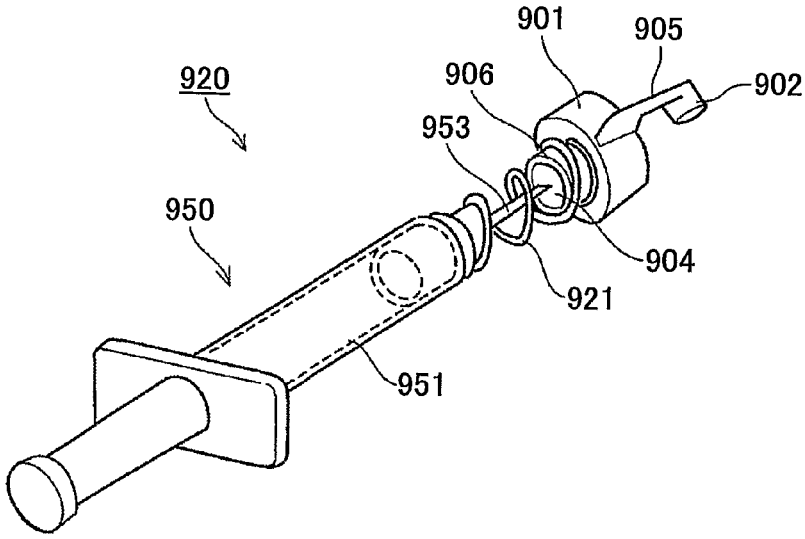
FIG. 64 is a perspective view of an ink charging device of Embodiment 15.

An ink charging device of Embodiment 16 according to the present invention will be described with reference to FIG. 64. FIG. 64 is a perspective view of an ink charging device of Embodiment 15. An example of an ink charging device 920 is formed by connecting the ink charging jig 910 and the charger 950 with an elastic member 921 such as a spring. The ink charging jig 900 is provided with a 906 inserted in an end of the elastic member 921.

Referring to also FIG. 32, the charger 950 is prevented from approaching the ink charging jig 900 until an ink supplying port 622 of an ink cartridge 600 is moved to an ink supplying position with the ink charging jig 900. The fixture 902 of the ink charging jig 900 is required to rotate the rotating member (moving unit) 621 while receiving a resistance force of the elastic part 629. Therefore, a force for compressing the elastic member 921 is set larger than a force for compressing the elastic part 629.

By this, the charger 950 can be inserted after the rotating member (moving unit) 621 is completely rotated by pushing the ink charging jig 900. Therefore, it is possible to prevent the charger 950 from being inserted into the rotating member (moving unit) 621 while the rotating member (moving unit) 621 rotates.

Embodiment 17

Figure 65:
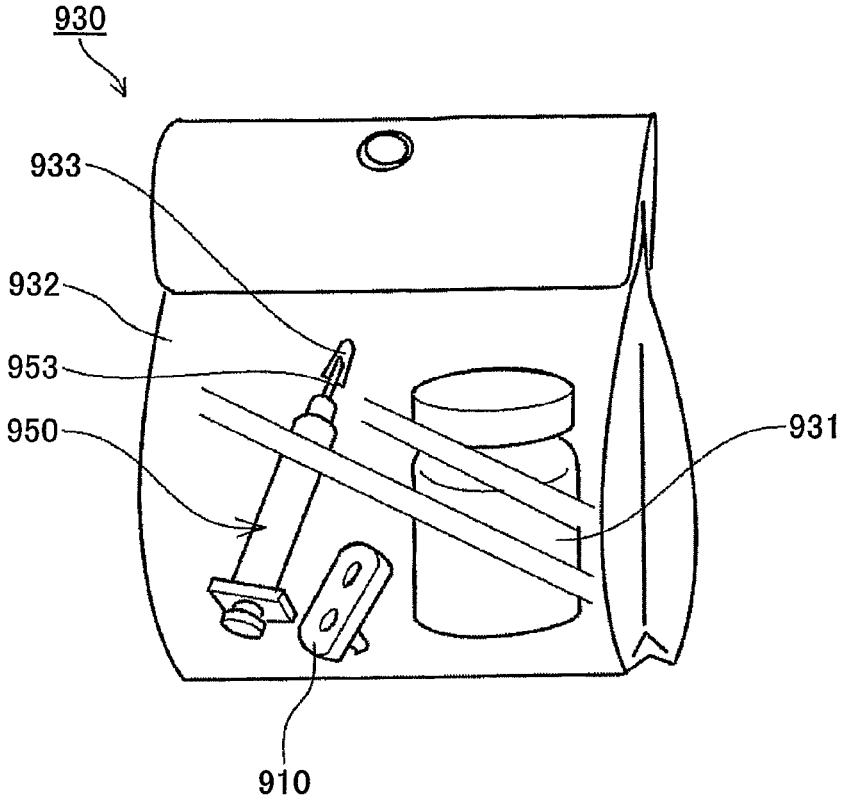
FIG. 65 is a schematic view of an example of an ink charging kit.

An ink charging kit of Embodiment 17 according to the present invention will be described with reference to FIG. 65. FIG. 65 schematically shows an example of the ink charging kit. The ink charging kit 930 includes an ink charging jig 910, a charger 950, and an ink container 931 accommodating ink in a package body 932. A cover 933 is provided on a tip end of a charger 950 of a charging nozzle (nozzle member) 953. A package body 932 is not limited to a bag and may be a casing.

A method of charging the ink using the ink charging kit 930 is similar to that in Embodiment 14.

Referring to also FIG. 32, the ink charging kit 930 includes the ink charging jig 910, the charger 950 having the charging nozzle (nozzle member) 953 inserted into an ink supplying port 622 and to be held by the ink charging jig 910, and the package body 932 for holding the ink charging jig 910 and the charger 950. The ink charging jig 910 is attached to an ink cartridge 600 to move the ink supplying port 622 to an ink supplying position and the charging nozzle (nozzle member) 953 is inserted into the ink supplying port 622. Then, the ink can be charged. As a result, workability of charging the ink into the ink cartridge 600 can be improved even when the ink supplying port 622 is shielded from the outside.

Another ink charging kit of Embodiment 17 according to the present invention will be described with reference to FIG. 66. FIG. 66 schematically shows an example of the ink charging kit. An ink charging kit 940 is formed by including a portion integrally connecting an ink charging jig 900 to an elastic member 921 and a charger 950 described in Embodiment 15, and ink containers 941*y*, 941*m*, 941*c*, and 941*k* in a package body 942.

Before charging an ink using the ink charging kit 940, the charger 950 is engaged with the elastic member 921.

In the above embodiments, the ink cartridge is a pressurized type in which ink is supplied by pressuring an ink bag from the outside. However, the above embodiments can be similarly applied to an ink cartridge of a suction type in which an ink is suctioned via a hollow needle from an ink bag.

An ink charging jig Embodiments 14 to 17 is used to charge an ink in an ink cartridge. The ink charging jig includes an ink accommodating unit configured to accommodate the ink; a cartridge casing accommodating the ink accommodating unit; an ink supplying unit which is connected to the ink accommodating unit and is to be inserted by a supplying nozzle from an imaging apparatus; a moving unit configured to move the ink supplying unit between an ink supplying position where the charging nozzle is inserted in the ink supplying unit and a shielding position where the ink supplying unit is shielded from an outside, the ink charging jig, including: a fixing unit which fixes the moving unit at the ink supplying position; and a holding unit configured to hold the charging nozzle.

An ink charging jig Embodiments 14 to 17 is configured such that the fixing unit fixes a part protruding from the cartridge casing to the cartridge casing.

The ink charging jig Embodiments 14 to 17 is configured such that the ink cartridge includes: an air accommodating unit configured to hermetically pack the ink accommodating unit inside the air accommodating unit and receive an air in a space between the air accommodating unit and the ink accommodating unit; and a nozzle connector configured to connect an air nozzle member injecting the air from an imaging apparatus to the space between the air accommodating unit and the ink accommodating unit, wherein the fixing unit fixes the nozzle connector at a position where the charging nozzle is connected.

The ink charging jig Embodiments 14 to 17 is configured such that the fixing unit includes an air through hole connecting the air accommodating unit to an outside of the cartridge casing.

An ink charging device of Embodiments 14 to 17 is used to charge an ink in an ink cartridge. The ink charging device includes an ink accommodating unit configured to accommodate the ink; a cartridge casing accommodating the ink accommodating unit; an ink supplying unit which is connected to the ink accommodating unit and is to be inserted by a supplying nozzle from an imaging apparatus; a moving unit configured to move the ink supplying unit between an ink supplying position where the charging nozzle is inserted in the ink supplying unit and a shielding position where the ink supplying unit is shielded from an outside, the ink charging device, including: the ink charging jig according to the preceding aspects; and a charging unit which is held by the ink charging jig by an elastic member to move forward and back and has the charging nozzle inserted in the ink supplying unit.

An ink charging method of Embodiments 14 to 17 charges an ink in an ink cartridge. The ink charging method includes an ink accommodating unit configured to accommodate the ink; a cartridge casing accommodating the ink accommodating unit; an ink supplying unit which is connected to the ink accommodating unit and is to be inserted by a supplying nozzle from an imaging apparatus; a moving unit configured to move the ink supplying unit between an ink supplying position where the charging nozzle is inserted in the ink supplying unit and a shielding position where the ink supplying unit is shielded from an outside, the ink charging method, including: using the ink charging jig according to the preceding aspects; fixing the moving unit at the ink supplying position; inserting the charging nozzle in the ink supplying unit; and charging the ink via the charging nozzle.

An ink charging kit of Embodiments 14 to 17 is used to charge an ink in an ink cartridge. The ink charging kit includes an ink accommodating unit configured to accommodate the ink; a cartridge casing accommodating the ink accommodating unit; an ink supplying unit which is connected to the ink accommodating unit and is to be inserted by a supplying nozzle from an imaging apparatus; a moving unit configured to move the ink supplying unit between an ink supplying position where the charging nozzle is inserted in the ink supplying unit and a shielding position where the ink supplying unit is shielded from an outside, the ink charging kit, including: the ink charging jig according to the preceding aspects; a charging unit which is held by the ink charging jig to move forward and backward by an elastic member and has the charging nozzle inserted in the ink supplying unit; and a package body configured to accommodate the charging jig and the charging unit.

The ink charging kit of Embodiments 14 to 17 is configured such that the package body further includes a charging ink.

The present invention is not limited to these embodiments, but variations and modifications may be made without departing from the scope of the present invention.

The present application is based on Japanese Priority Applications No. 2008-249423 filed on Sep. 29, 2008, No. 2009-160364 filed on Jul. 7, 2009, No. 2009-160421 filed on Jul. 7, 2009, No 2009-138055 filed on Jun. 9, 2009, and No. 2009-065382 filed on Mar. 18, 2009 with the Japan Patent Office, the entire contents of which are hereby incorporated by reference.

The invention claimed is:

1. An ink cartridge that is attachable to and detachable from an imaging apparatus, the ink cartridge comprising: an ink accommodating unit; and a cartridge casing having an opening, wherein the ink accommodating unit comprises:

an ink accommodating body accommodating an ink; and an ink supplying portion which includes a nozzle insertion path and is connected to the ink accommodating body to enable suction of the ink via the opening of the cartridge casing by a suction nozzle of the imaging apparatus, wherein the ink supplying portion is held by the cartridge casing so that the ink supplying portion is rotatable relative to the cartridge casing between a position where the nozzle insertion path faces the opening of the cartridge casing and a position where the nozzle insertion path faces an inner wall surface of the cartridge casing, and when the ink cartridge is attached to the imaging apparatus the ink supplying portion is rotated to direct the nozzle insertion path toward the opening of the ink cartridge, and when the ink cartridge is detached from the imaging apparatus the ink supplying portion is rotated to direct the nozzle insertion path toward the inner wall surface of the cartridge casing.

2. The ink cartridge according to claim 1, wherein the ink accommodating unit is configured to bend at a part between the ink accommodating body and the ink supplying portion along with the rotation of the ink supplying portion.

3. The ink cartridge according to claim 1, wherein the ink accommodating unit further comprises:

a biasing unit configured to rotate the ink supplying portion to the position where the nozzle insertion path faces the inner wall surface of the cartridge casing.

4. The ink cartridge according to claim 1, wherein the ink supplying portion includes an information memory unit storing information about the ink or information about the ink cartridge.

5. The ink cartridge according to claim 1, wherein the ink supplying portion includes a pinion integrally formed in it, and the ink supplying portion is rotated by engaging a rack of the imaging apparatus.

6. The ink cartridge according to claim 1, wherein the ink supplying portion includes a cam integrally formed in it, and the ink supplying portion is rotated by a force applied through the cam.

7. An ink cartridge that is attachable to and detachable from an imaging apparatus, the ink cartridge comprising:

an cartridge casing having an opening;

an ink accommodating body accommodating an ink;

a nozzle insertion unit which includes a nozzle insertion path and is connected to the ink accommodating body to enable suction of the ink via the opening of the cartridge casing by a suction nozzle of the imaging apparatus;

a shielding unit configured to shield the nozzle insertion path from the outside; and a moving unit configured to move the nozzle insertion unit to a position where the nozzle insertion path faces the suction nozzle when the ink cartridge is attached to the imaging apparatus and to move the nozzle insertion unit to a position where the nozzle insertion path faces the shielding unit when the ink cartridge is detached from the imaging apparatus.

8. An ink cartridge that can be attached to and detached from an imaging apparatus, the ink cartridge comprising:

an ink accommodating unit accommodating an ink;

a cartridge casing accommodating the ink accommodating unit;

an ink supplying port connected to the ink accommodating unit and enabling insertion of a hollow needle of the imaging apparatus;

a moving unit configured to move the ink supplying port between an ink supplying position where the hollow needle is inserted and a shielding position where the ink supplying port is shielded from the outside; and a starting unit configured to contribute an ink supply to the imaging apparatus when the ink cartridge is attached to the imaging apparatus.

9. The ink cartridge according to claim 8, wherein the starting unit is drawn inside the cartridge casing when the ink supplying port is in the shielded position, and protrudes outside the cartridge casing when the ink supplying port is in the ink supplying position.

10. The ink cartridge according to claim 8, wherein the ink supplying port is held to be rotatable relative to the cartridge casing, and the moving unit rotates the ink supplying port when the ink cartridge is attached to the imaging apparatus.

11. The ink cartridge according to claim 10, wherein a direction of an axis around which the moving unit rotates is the same as a direction of inserting the hollow needle.

12. The ink cartridge according to claim 10, wherein the moving unit is integrally formed with the ink supplying port.

13. The ink cartridge according to claim 10, wherein the starting unit is provided opposite to the ink supplying port with respect to the axis around which the moving unit rotates.

14. The ink cartridge according to claim 8, further comprising:

an air accommodating unit configured to hermetically seal the ink accommodating unit inside the air accommodating unit and to receive an air in a space between the air accommodating unit and the ink accommodating unit; and a nozzle connector configured to connect an air nozzle member injecting the air from the imaging apparatus to the space between the air accommodating unit and the ink accommodating unit.

15. The ink cartridge according to claim 14, wherein the nozzle connector is moved between a connecting position where the air nozzle member is connected and a shielding position shielded from an outside.

* * * * *